US010952569B2

(12) United States Patent
Grosz, Jr. et al.

(10) Patent No.: US 10,952,569 B2
(45) Date of Patent: Mar. 23, 2021

(54) PREMATURE REPLACEMENT PREVENTION OR DETERRENCE FOR MULTIPLE ROLL SHEET PRODUCT DISPENSERS

(71) Applicant: GPCP IP HOLDINGS LLC, Atlanta, GA (US)

(72) Inventors: John William Grosz, Jr., Ripon, WI (US); Timothy Andrew Robertson, Appleton, WI (US); Nathan Patrick Roche, Atlanta, GA (US); Jacob Edward Malesky, Neenah, WI (US); Ryan Alexander Kantor, Atlanta, GA (US); Roy J. Rozek, Neenah, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 364 days.

(21) Appl. No.: 15/974,985

(22) Filed: May 9, 2018

(65) Prior Publication Data

US 2018/0325332 A1 Nov. 15, 2018

Related U.S. Application Data

(60) Provisional application No. 62/564,581, filed on Sep. 28, 2017, provisional application No. 62/537,531,
(Continued)

(51) Int. Cl.

| | |
|---|---|
| ***A47K 10/36*** | (2006.01) |
| ***A47K 10/38*** | (2006.01) |
| ***A47K 10/32*** | (2006.01) |

(52) U.S. Cl.

CPC ..... *A47K 10/3687* (2013.01); *A47K 10/3656* (2013.01); *A47K 10/3836* (2013.01);
(Continued)

(58) Field of Classification Search

CPC ..... A47K 10/38; A47K 10/3687; A47K 10/3656; A47K 10/3836; A47K 2010/3233; A47K 2010/3681; A47K 2010/3253

See application file for complete search history.

(56) References Cited

U.S. PATENT DOCUMENTS

| | | | |
|---|---|---|---|
| 3,620,466 | A | 11/1971 | Bump |
| 3,656,699 | A | 4/1972 | Schnyder et al. |

(Continued)

FOREIGN PATENT DOCUMENTS

| | | | |
|---|---|---|---|
| EP | 1559356 | A2 | 8/2005 |
| EP | 1559357 | A2 | 8/2005 |

(Continued)

OTHER PUBLICATIONS

International Search Report and Written Opinion for International Application PCT/US2018/31970 dated Sep. 10, 2018.

(Continued)

*Primary Examiner* — William A. Rivera

(74) *Attorney, Agent, or Firm* — Nelson Mullins Riley & Scarborough LLP

(57) ABSTRACT

Improvements to sheet product dispensers configured to hold multiple product rolls are provided herein. An example sheet product dispenser comprises a housing defining a dispensing position and a reserve position. The housing is configured to hold a first roll of sheet product in the dispensing position and a second roll of sheet product in the reserve position, where a user can receive a portion of the first roll of sheet product that is in the dispensing position. The sheet product dispenser includes a roll replacement feature that is configured to enable installation of a replacement roll of sheet product into the reserve position. The sheet product dispenser includes a restrictive access feature configured to prevent installation of the replacement roll of
(Continued)

sheet product directly into the dispensing position in an instance in which the roll replacement feature enables installation of the replacement roll of sheet product in the reserve position.

19 Claims, 38 Drawing Sheets

Related U.S. Application Data filed on Jul. 27, 2017, provisional application No. 62/504,222, filed on May 10, 2017.

(52) U.S. Cl.
CPC ..... *A47K 2010/3233* (2013.01); *A47K 2010/3253* (2013.01); *A47K 2010/3681* (2013.01)

(56) References Cited

U.S. PATENT DOCUMENTS

| | | | | |
|---|---|---|---|---|
| 5,265,816 | A | 11/1993 | Collins | |
| 5,310,129 | A * | 5/1994 | Whittington | A47K 10/3836 242/560.3 |
| 5,441,189 | A | 8/1995 | Formon et al. | |
| 5,524,835 | A | 6/1996 | Collins | |
| 5,601,253 | A | 2/1997 | Formon et al. | |
| 5,749,538 | A | 5/1998 | Brown et al. | |
| 5,954,256 | A * | 9/1999 | Niada | A47K 10/3836 225/34 |
| 6,056,233 | A | 5/2000 | Von Schenk | |
| 6,439,502 | B1 | 8/2002 | Gemmell et al. | |
| 6,491,251 | B1 | 12/2002 | Stanland et al. | |
| 6,616,087 | B1 | 9/2003 | Chern | |
| 6,648,267 | B2 | 11/2003 | Stanland et al. | |
| 6,988,689 | B2 | 1/2006 | Thomas et al. | |
| 7,014,140 | B2 | 3/2006 | Elliott et al. | |
| 7,083,138 | B2 | 8/2006 | Elliott et al. | |
| 7,107,888 | B2 | 9/2006 | Blume et al. | |
| 7,114,676 | B2 | 10/2006 | Elliott et al. | |
| 7,127,974 | B2 | 10/2006 | Blume et al. | |
| 7,182,288 | B2 | 2/2007 | Denen et al. | |
| D543,402 | S | 5/2007 | Geoking et al. | |
| D543,745 | S | 6/2007 | Geoking et al. | |
| 7,270,292 | B2 | 9/2007 | Rasmussen | |
| 7,275,708 | B2 | 10/2007 | Lewis et al. | |
| D556,482 | S | 12/2007 | Geoking et al. | |
| 7,325,767 | B2 | 2/2008 | Elliott et al. | |
| 7,325,768 | B2 | 2/2008 | Byrd et al. | |
| 7,354,015 | B2 | 4/2008 | Byrd et al. | |
| 7,374,128 | B2 | 5/2008 | Hendrix et al. | |
| 7,389,716 | B2 | 6/2008 | Blume et al. | |
| 7,422,174 | B2 | 9/2008 | Elliott et al. | |
| 7,461,810 | B2 | 12/2008 | Goeking et al. | |
| 7,789,001 | B2 | 9/2010 | Blume et al. | |
| 7,841,558 | B2 | 11/2010 | Elliott et al. | |
| 7,861,964 | B2 | 1/2011 | Cittadino et al. | |
| 8,162,252 | B2 | 4/2012 | Cittadino et al. | |
| 8,356,767 | B2 | 1/2013 | Formon et al. | |
| 8,915,463 | B2 | 12/2014 | Hagleitner | |
| 8,960,588 | B2 | 2/2015 | Byrd et al. | |
| 9,090,422 | B2 | 7/2015 | Horikawa | |
| 9,138,110 | B2 | 9/2015 | Knight et al. | |
| 9,601,913 | B2 | 3/2017 | Killen | |
| 9,604,811 | B2 | 3/2017 | Case et al. | |
| 9,648,995 | B2 | 5/2017 | Elliott et al. | |
| D818,737 | S | 5/2018 | Cross | |
| D818,738 | S | 5/2018 | Cross | |
| 2002/0050544 | A1 * | 5/2002 | Stanland | A47K 10/3656 242/559.2 |
| 2004/0035976 | A1 | 2/2004 | Byrd et al. | |
| 2004/0135027 | A1 | 7/2004 | Elliott et al. | |
| 2004/0173071 | A1 | 9/2004 | Blume et al. | |
| 2005/0077419 | A1 | 4/2005 | Thomas et al. | |
| 2005/0085368 | A1 | 4/2005 | Blume et al. | |
| 2005/0167543 | A1 | 8/2005 | Elliott et al. | |
| 2005/0167544 | A1 | 8/2005 | Elliott et al. | |
| 2006/0000941 | A1 | 1/2006 | Lewis et al. | |
| 2006/0102770 | A1 | 5/2006 | Geoking et al. | |
| 2006/0108467 | A1 | 5/2006 | Elliott et al. | |
| 2006/0065095 | A1 | 9/2006 | Ambrose | |
| 2006/0279020 | A1 | 12/2006 | Elliott et al. | |
| 2007/0012150 | A1 | 1/2007 | Blume et al. | |
| 2007/0068354 | A1 | 3/2007 | Blume et al. | |
| 2007/0290094 | A1 | 12/2007 | Anderson | |
| 2009/0065627 | A1 | 3/2009 | Goeking et al. | |
| 2009/0072072 | A1 | 3/2009 | Elliott et al. | |
| 2009/0272836 | A1 | 11/2009 | Byrd et al. | |
| 2009/0314874 | A1 * | 12/2009 | Kling | A47K 10/38 242/560 |
| 2011/0139920 | A1 | 6/2011 | Formon et al. | |
| 2012/0292428 | A1 | 11/2012 | Tracy et al. | |
| 2013/0320128 | A1 | 12/2013 | Cittadino et al. | |
| 2016/0037979 | A1 | 2/2016 | Mattheeussen et al. | |

FOREIGN PATENT DOCUMENTS

| | | | |
|---|---|---|---|
| EP | 1669310 | A2 | 6/2006 |
| KR | 101254920 | B1 | 4/2013 |
| WO | WO 2006/007199 | A1 | 1/2006 |
| WO | WO 2011/075236 | A1 | 6/2011 |
| WO | WO 2013/016416 | A1 | 1/2013 |
| WO | WO 2015/038935 | A1 | 3/2015 |
| WO | WO 2017/084689 | A1 | 5/2017 |

OTHER PUBLICATIONS

Sep. 10, 2018 Search Report issued in International Patent Application No. PCT/US2018/031970.

Sep. 10, 2018 Written Opinion issued in International Patent Application No. PCT/US2018/031970.

Zoro; Georgia-Pacific Jumbo Toilet Paper Dispenser Product Details; website visited Jul. 20, 2018; <https://www.zoro.com/georgia-pacific-toilet-paper-dispr-jumbo-13-12-in-h-58150/i/G2242974/feature-product?gclid=EAIaQobchmI6bWD-Nit2glVCFgch2jjqvleaqyasabegix9vd_bwe>.

GP Pro Catalog; Mfg. 56787 Dispn Tissue Compact HiCap KeyLock Product Details; website visited Jul. 20, 2018. <http://catalog.gppro.com/catalog/6281/11161?filter=FULL>.

San Jamar; Twin 9" JBT Dispenser Product Details; website visited Jul. 20, 2018. <https://www.sanjamar.com/product/twin-9-jbt-dispenser/>.

YouTube; Compact High Capacity Tissue Dispenser—Full Instructions; website visited Jul. 20, 2018. <https://www.youtube.com/watch?v=2aPVKOXrl7c>.

GP Pro Catalog; Mfg. 56602 Disp Tissue PacBlue Ult KeyLock 4 Roll Product Details (PBU 4 Roll Rotary); website visited Jul. 20, 2018. <http://catalog.gppro.com/catalog/13624/29111?filter=FULL>.

GP Pro Catalog; Mfg. 56744A Dispn Tissue Compact Quad Product Details (Compact Quad Auto Transfer); website visited Jul. 20, 2018. <http://catalog.gppro.com/catalog/6281/29492?filter=FULL>.

GP Pro Catalog; Mft. 59209 Dispn Tissue 9" Jumbo—2 Roll Product Details (JBT Jr. Side-by-Side); website visited Jul. 20, 2018. <http://catalog.gppro.comicatalog/6286/16580?filter=FULL>.

GP Pro Catalog; Mfg. 56780 Dispn Tissue Compact HiCap Product Details (Compact High Capacity); website visited Jul. 20, 2018. <http://catalog.gppro.com/catalog/6281/10373?filter=FULL>.

* cited by examiner

PREMATURE REPLACEMENT PREVENTION OR DETERRENCE FOR MULTIPLE ROLL SHEET PRODUCT DISPENSERS

CROSS-REFERENCE TO RELATED APPLICATION(S)

This application claims priority to U.S. provisional Patent Application No. 62/564,581, filed Sep. 28, 2017, entitled "High Capacity Sheet Product Dispensers and Associated Features"; U.S. provisional Patent Application No. 62/537,531, filed Jul. 27, 2017, entitled "High Capacity Sheet Product Dispensers and Associated Features"; and U.S. provisional Patent Application No. 62/504,222, filed May 10, 2017, entitled "High Capacity Sheet Product Dispensers and Associated Features", each of which is hereby incorporated by reference in its entirety.

FIELD OF THE INVENTION

Example embodiments of the present invention generally relate to dispensers and, more particularly to, sheet product dispensers with multiple rolls of sheet product.

BACKGROUND

Sheet product dispensers (e.g., tissue dispensers, napkin dispensers, and paper towel dispensers), provide on-demand sheet product to a user from a supply of sheet product stored within the dispenser, such as in roll form. Some sheet product dispensers provide sheet product (e.g., bath tissue) that is accessible to the user for removal of a portion thereof. Such example tissue dispensers may require a user to tear or remove a portion of the sheet product. In such examples, perforations on the sheet product and/or cutting arrangements on the dispenser may be used to enable separation of the sheet product for use (e.g., form a dispensed portion). In this regard, in some cases, the sheet product dispensers may include unperforated sheet product.

It is desirable to provide improvements in current sheet product dispensers that may be related to, for example, loading, handling, storage, dispensing consistency, reduction in waste and mess in stall, hygiene, capacity, among many others.

BRIEF SUMMARY

Some example embodiments of the present invention seek to provide improvements for sheet product dispensers. For example, some sheet product dispensers may provide one or more features or designs that aim to provide for prevention or deterrence of premature removal or replacement of the dispensing product roll—such as to avoid unnecessary waste. Other possible benefits of various described embodiments may include, for example, providing for easy loading (e.g., drop-in loading) to enable quick and error free replacement, improved hygiene, increased capacity while maintaining a smaller footprint, automatic replacement of the dispensing product roll, reduction in overall waste, installation versatility, among many others.

For example, some sheet product dispensers are designed to hold multiple product rolls. In such example sheet product dispensers, one of the product rolls may be in a dispensing position, such that a user (e.g., a consumer) may access and cause dispensing of that product roll. Additionally, however, the sheet product dispenser may include one or more reserve rolls that are held within the housing of the sheet product dispenser. Upon depletion of the product roll being dispensed from, a reserve roll may be moved (automatically or manually) into the dispensing position for dispensing therefrom.

It is desirable to cause utilization of as much of the product roll in the dispensing position before it is replaced—thereby reducing overall waste. In some cases, however, a maintainer (e.g., janitor, dispenser operator, etc.) may prematurely replace the active product roll that is in the dispensing position with a full replacement product roll, thereafter discarding the previously active product roll that may still have some usable sheet product—thereby resulting in unnecessary waste. This premature replacement could be due to any number of reasons, but is often because the maintainer may wish to provide a completely full dispenser (even if there are sufficient reserve product rolls in the dispenser for usage prior to the maintainer's next scheduled visit). Some embodiments of the present invention seek to prevent or make difficult such premature replacement of the dispensing product roll—thereby preventing or reducing such waste. In this regard, some various embodiments of the present invention provide some form of a restrictive access feature that prevents a user from being able to remove and/or replace an active product roll installed in the dispensing position.

Such an improvement (and others described herein) may be particularly useful for high capacity sheet product dispensers. High capacity sheet product dispensers are useful for providing on-demand sheet product to a large number of sequential users without a need to replace the sheet product rolls often. In this regard, some example embodiments of the present invention provide sheet product dispensers that are designed to hold a large capacity of sheet product. Such example sheet product dispensers may provide a small number of sheet product rolls (e.g., one or two) that each have a very large amount of sheet product or a larger number of sheet product rolls (e.g., three or more) that have a smaller amount of sheet product; with each dispenser, however, including an overall high or large capacity of sheet product. In some embodiments, such sheet product dispensers may be tissue dispensers that are positioned relative to a bathroom fixture (such as in a bathroom stall).

An example embodiment of the present invention provides a sheet product dispenser comprising a housing defining a dispensing position and a reserve position. The housing is configured to hold a first roll of sheet product in the dispensing position and a second roll of sheet product in the reserve position. The housing is configured to enable a user to receive a portion of the first roll of sheet product that is in the dispensing position. The sheet product dispenser includes a roll replacement feature that is configured to enable installation of a replacement roll of sheet product into the reserve position. The sheet product dispenser further includes a restrictive access feature configured to prevent installation of the replacement roll of sheet product directly into the dispensing position in an instance in which the roll replacement feature enables installation of the replacement roll of sheet product in the reserve position.

In some embodiments, the restrictive access feature is further configured to prevent, when the first roll of sheet product is in the dispensing position, removal of the first roll of sheet product and installation of the replacement roll of sheet product directly into the dispensing position in an instance in which the roll replacement feature enables installation of the replacement roll of sheet product in the reserve position.

In some embodiments, the restrictive access feature is configured to permanently prevent installation of the replacement roll of sheet product directly into the dispensing position such that there is no emergency access that enables installation of the replacement roll of sheet product directly into the dispensing position.

In some embodiments, the restrictive access feature is configured to permanently prevent removal of the first roll of sheet product in an instance in which an amount of sheet product remaining on the first roll of sheet product is greater than a removal threshold amount of sheet product.

In some embodiments, the sheet product dispenser further comprises an emergency access feature that enables a maintainer to at least one of manipulate or bypass the restrictive access feature to enable installation of the replacement roll of sheet product directly into the dispensing position.

In some embodiments, the sheet product dispenser is configured to enable selection by an installer of either enabling emergency access or disabling emergency access. The restrictive access feature is configured to permanently prevent installation of the replacement roll of sheet product directly into the dispensing position in an instance in which emergency access is disabled. A maintainer is able to at least one of manipulate or bypass the restrictive access feature to enable installation of the replacement roll of sheet product directly into the dispensing position in an instance in which emergency access is enabled.

In some embodiments, the roll replacement feature comprises a cover that is movable between a closed position and an open position, and the restrictive access feature comprises a blocking feature that covers at least the dispensing position to prevent installation of the replacement roll of sheet product directly into the dispensing position. In some embodiments, the blocking feature is fixedly attached to the housing such that it is not movable. In some embodiments, the sheet product dispenser further comprises a roll movement feature that is selectively actuable to enable movement of the first roll of sheet product away from the blocking feature and the dispensing position to enable the replacement roll of sheet product to replace the first roll of sheet product. In some embodiments, the cover is configured to prevent a user from being able to selectively actuate the roll movement feature when the cover is in the closed position.

In some embodiments, the blocking feature is selectively movable between a first position and a second position. When in the first position, the blocking feature covers at least the dispensing position to prevent installation of the replacement roll of sheet product directly into the dispensing position and, when in the second position, the blocking feature does not cover the dispensing position so as to enable installation of the replacement roll of sheet product directly into the dispensing position. In some embodiments, the cover is configured to prevent a user from being able to selectively move the blocking feature to the second position when the cover is in the closed position.

In some embodiments, the cover is configured to cover the blocking feature when the cover is in the closed position.

In some embodiments, the cover is not configured to cover the blocking feature when the cover is in the closed position.

In some embodiments, the blocking feature is formed at least partially of a flexible material that can be flexed to enable installation of the replacement roll of sheet product directly into the dispensing position while the blocking feature is flexed from an original position.

In some embodiments, the sheet product dispenser further comprises a roll movement feature that is configured to automatically move the first roll of sheet product out of the dispensing position in an instance in which the first roll of sheet product is depleted below a predetermined depletion threshold.

In some embodiments, the sheet product dispenser further comprises a depletion access feature that is configured to, in an instance in which the first roll of sheet product is depleted below a predetermined depletion threshold, automatically enable a maintainer the ability to at least one of manipulate or bypass the restrictive access feature to enable installation of the replacement roll of sheet product directly into the dispensing position.

In some embodiments, the roll replacement feature comprises an opening in the housing that enables insertion of the replacement roll of sheet product into the housing, and the restrictive access feature comprises a portion of the housing that covers the dispensing position. In some embodiments, the housing is configured to be installed such that the reserve position is generally vertically above and aligned with the dispensing position. Alternatively, in some embodiments, the housing is configured to be installed such that the reserve position is generally horizontally aligned with the dispensing position.

In another example embodiment, a sheet product dispenser comprises a housing defining a dispensing position and a reserve position. The housing is configured to hold a first roll of sheet product in the dispensing position and a second roll of sheet product in the reserve position. The housing is configured to enable a user to receive a portion of the first roll of sheet product that is in the dispensing position. The sheet product dispenser also includes a roll replacement feature that is configured to enable installation of a replacement roll of sheet product into the reserve position. The sheet product dispenser further includes a restrictive access feature configured to prevent, when the first roll of sheet product is installed in the dispensing position, removal of the first roll of sheet product in an instance in which an amount of sheet product remaining on the first roll of sheet product is greater than a removal threshold amount of sheet product and the roll replacement feature enables installation of the replacement roll of sheet product in the reserve position.

In some embodiments, the restrictive access feature is configured to permanently prevent removal of the first roll of sheet product in an instance in which the amount of sheet product remaining on the first roll of sheet product is greater than the removal threshold amount of sheet product such that there is no emergency access that enables premature removal of the first roll of sheet product.

In some embodiments, the sheet product dispenser further comprises an emergency access feature that enables a maintainer to at least one of manipulate or bypass the restrictive access feature to enable removal of the first roll of sheet product in an instance in which the amount of sheet product remaining on the first roll of sheet product is greater than the removal threshold amount of sheet product.

In yet another example embodiment, a sheet product dispenser comprises a housing, a first cover portion, and a second cover portion. The first cover portion is configured to cover at least a first reserve roll position for a first product roll. The first cover portion is rotatably attached to the housing and configured to move between a closed position in which the first cover portion covers at least the first reserve roll position and an open position in which the first cover portion is removed from covering at least the first reserve roll position to enable installation of a replacement product roll into at least the first reserve roll position. The second cover portion is configured to cover at least a dispensing roll position for a second product roll so as to prevent installation of a replacement product roll into the dispensing roll position.

In some embodiments, the first cover portion is configured to cover the second cover position when the first cover portion is in the closed position.

In some embodiments, the housing is sized to hold a plurality of reserve product rolls. The first cover portion is configured to cover a plurality of reserve roll positions and, when in the open position, the first cover portion is removed from covering the plurality of reserve roll positions to enable installation of one or more replacement product rolls in the plurality of reserve roll positions.

In some embodiments, the sheet product dispenser further comprises a rotary device that comprises a plurality of spindles. Each of the plurality of spindles are configured to hold a product roll. The rotary device is configured to automatically move a spindle from a reserve roll position into the dispensing roll position in an instance in which a product roll in the dispensing roll position becomes sufficiently depleted.

In some embodiments, the sheet product dispenser comprises a rotation activation mechanism that is configured to be operated to enable rotation of the rotary device to enable a maintainer to rotate a spindle out of the dispensing roll position and away from the second cover portion so as to enable installation of a replacement product roll thereon.

In some embodiments, the second cover portion is fixedly attached to the housing.

In some embodiments, the sheet product dispenser further comprises a dispensing roll access mechanism that is configured to be operated to cause the second cover portion to move from a closed position to an open position. In the closed position, the second cover portion covers at least the dispensing roll position so as to prevent installation of a replacement product roll into the dispensing roll position. In the open position, the second cover portion is removed from covering the dispensing roll position so as to enable installation of a replacement product roll into the dispensing roll position.

In some embodiments, the dispensing roll access mechanism comprises a release mechanism that is not accessible when the first cover portion is in the closed position.

In some embodiments, the dispensing roll access mechanism comprises a release mechanism that is activated by operation of one or more finger latches. In some embodiments, the one or more finger latches comprises a first finger latch and a second finger latch, wherein the first finger latch must be activated before the second finger latch can be activated.

In yet another example embodiment, a cartridge for a sheet product dispenser is provided. The cartridge comprises a housing defining a dispensing position and a reserve position. The housing is configured to hold a first roll of sheet product in the dispensing position and a second roll of sheet product in the reserve position. When the cartridge is received within a housing of the sheet product dispenser: a user is able to receive a portion of the first sheet product roll that is in the dispensing position; the cartridge is configured to automatically transfer the second roll of sheet product to the dispensing position in an instance in which the first roll of sheet product has been depleted below a roll depletion threshold; and the cartridge is incapable of being removed until an amount of sheet product remaining in the cartridge is depleted below a cartridge depletion threshold.

In yet another example embodiment, a sheet product dispenser comprises a housing and at least one roll holder attached to the housing and configured to receive a sheet product roll. The sheet product dispenser further comprises an indicator on the housing surrounding the at least one roll holder. The indicator includes an indication feature that is spaced outwardly in a radial direction from the at least one roll holder. The indication feature provides an indication of a need for replacement of the sheet product roll. The indication feature is hidden from view of a user until the sheet product roll is depleted below a depletion threshold.

In some embodiments, the indication feature is a line around the at least one roll holder that matches an outline of a theoretical sheet product roll with an amount of product remaining that is below the depletion threshold. In some embodiments, the line defines one or more patterns or colors. In some embodiments, the indication feature includes a written instruction.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 9A:
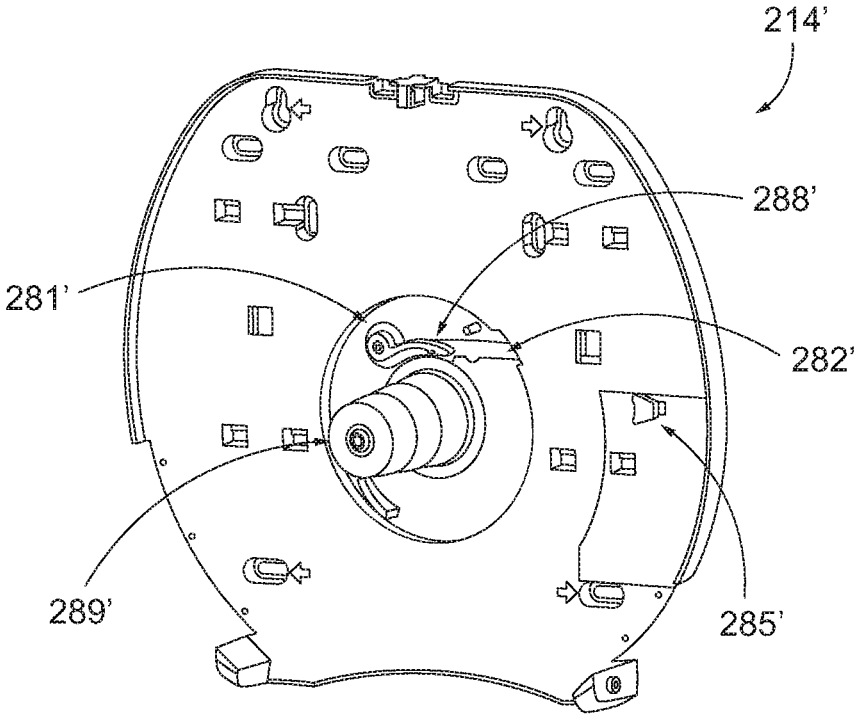
Figure 9B:
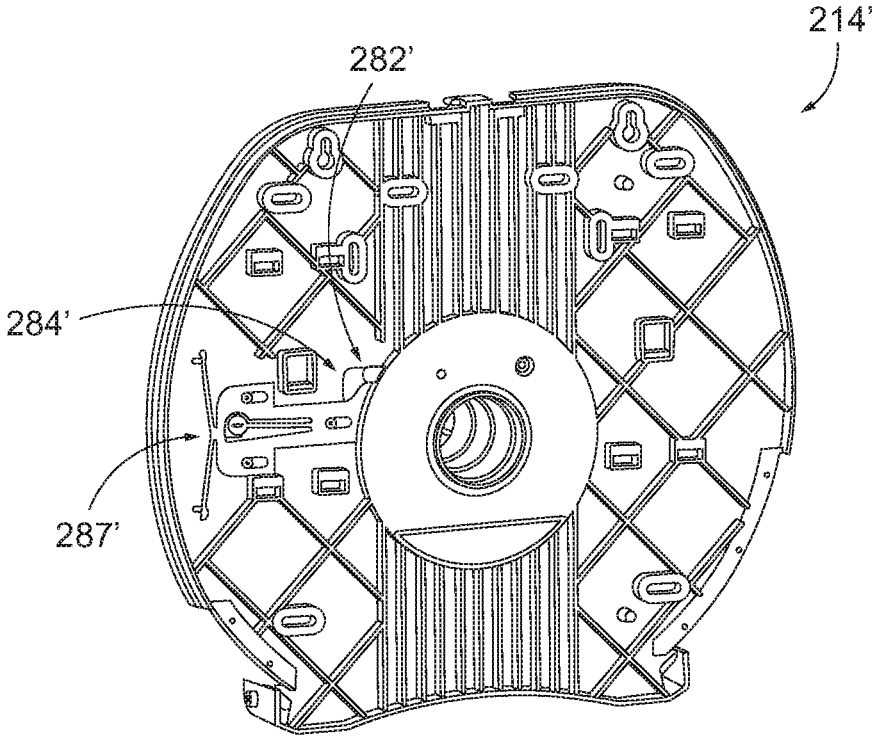
Figure 10A:
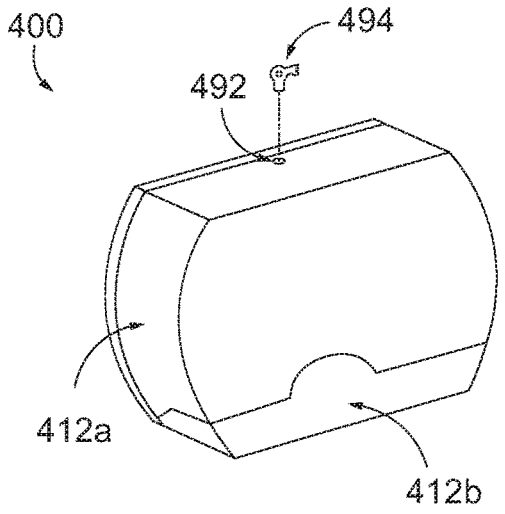
Figure 11A:
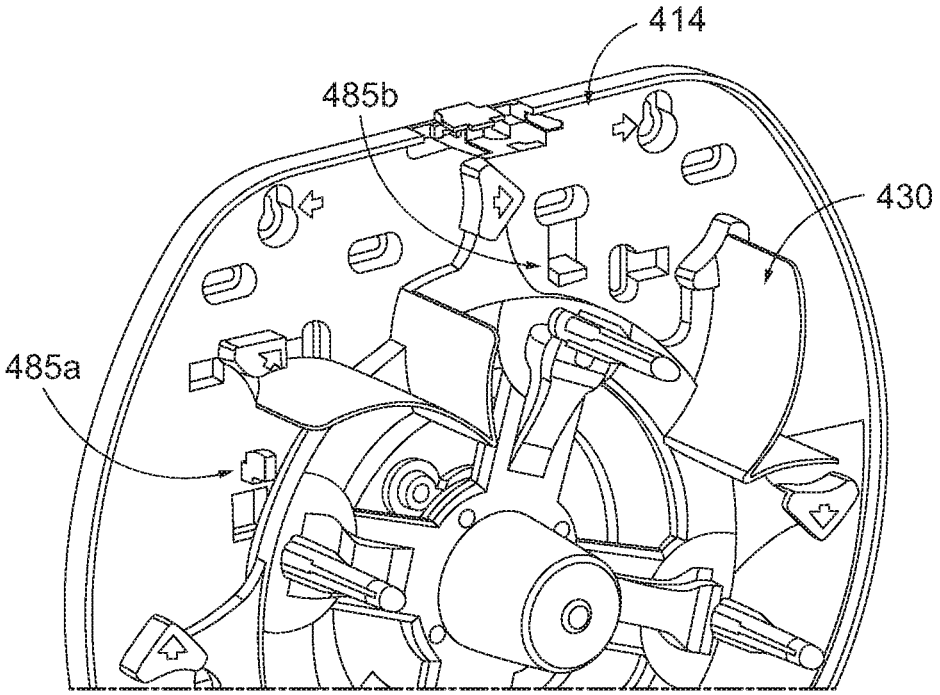
Figure 11B:
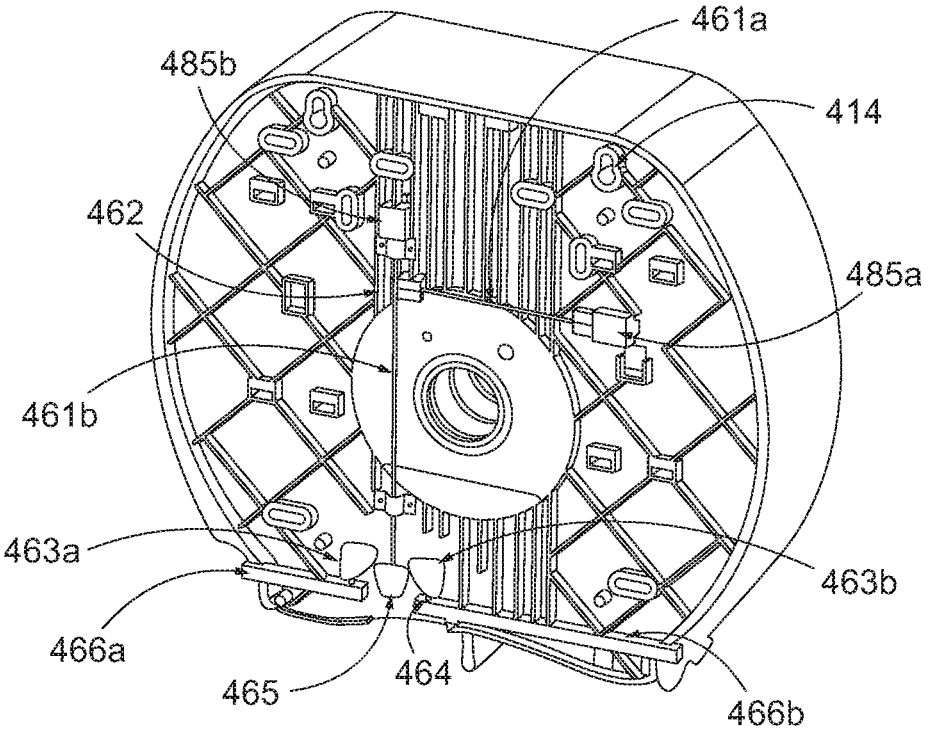
Figure 11C:
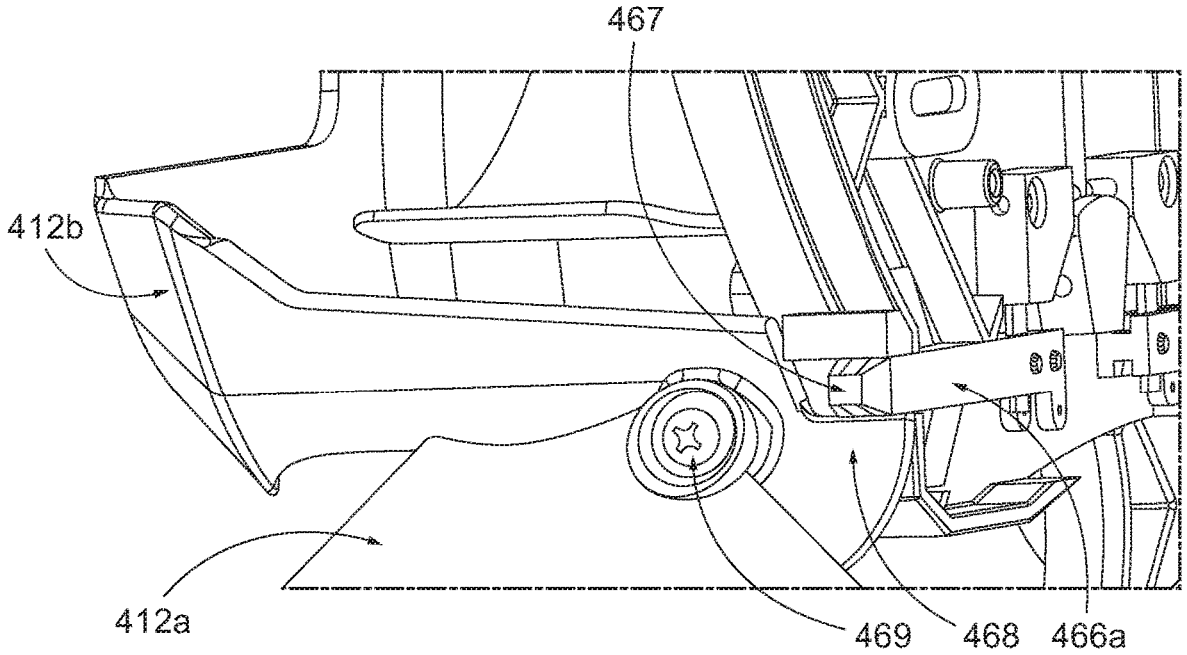
Figure 11D:
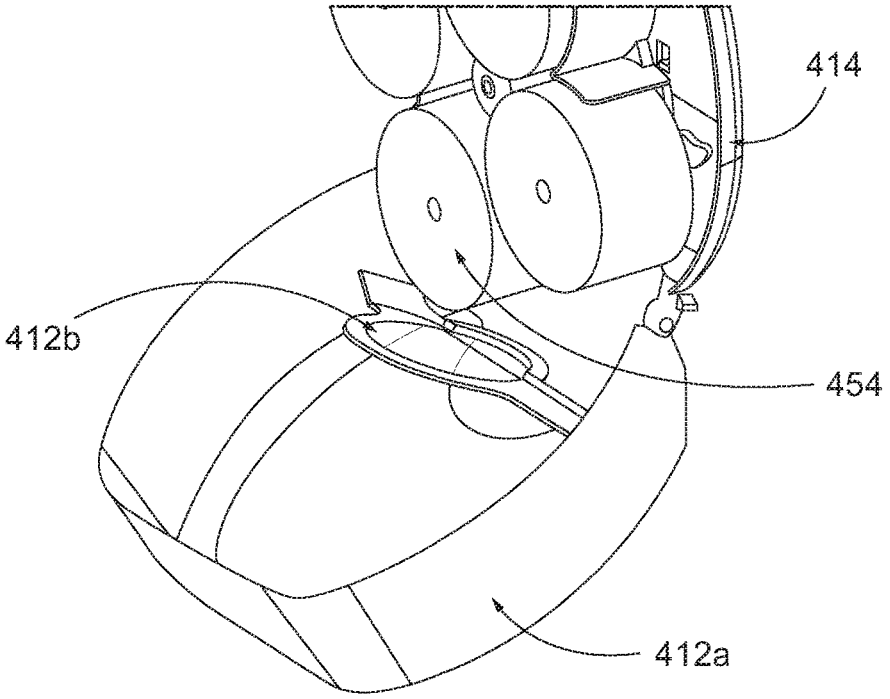
Figure 12A:
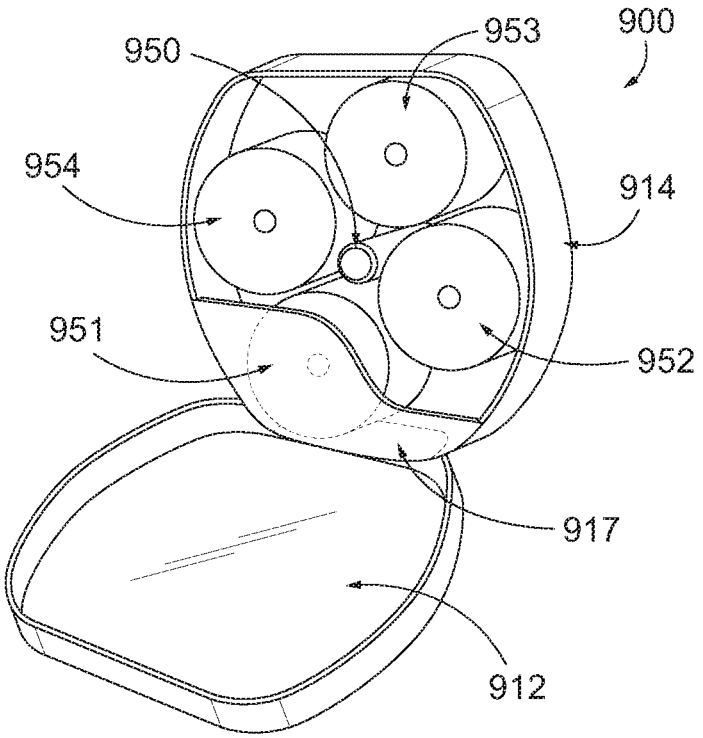
Figure 12B:
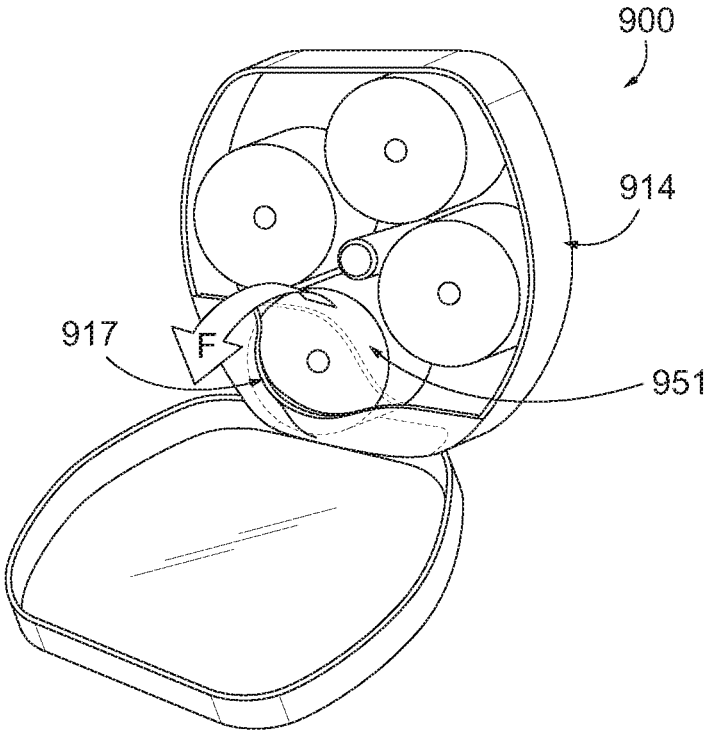
Figure 13A:
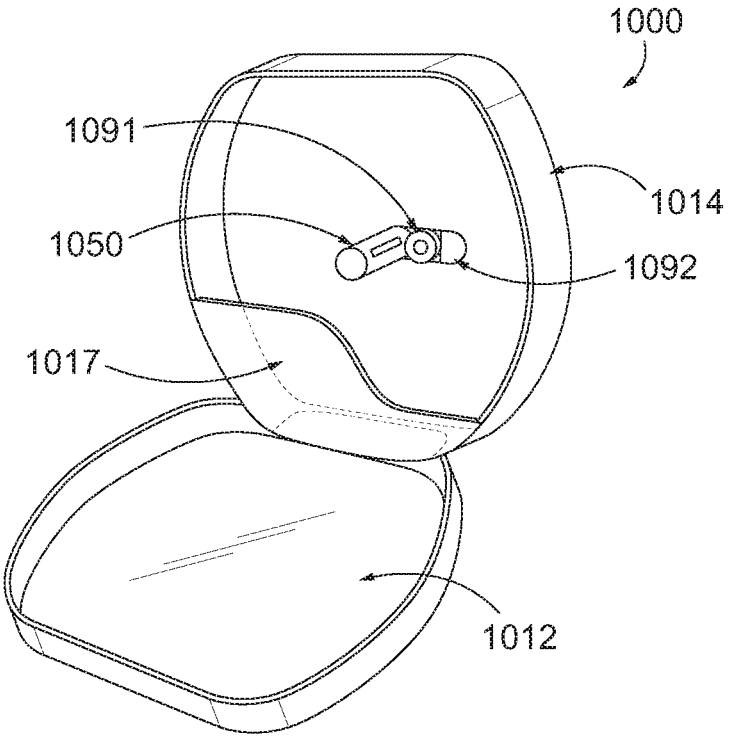
Figure 13B:
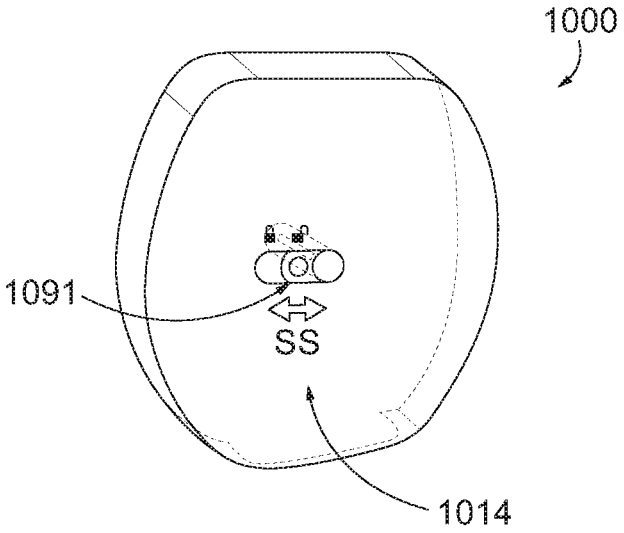
Figure 14A:
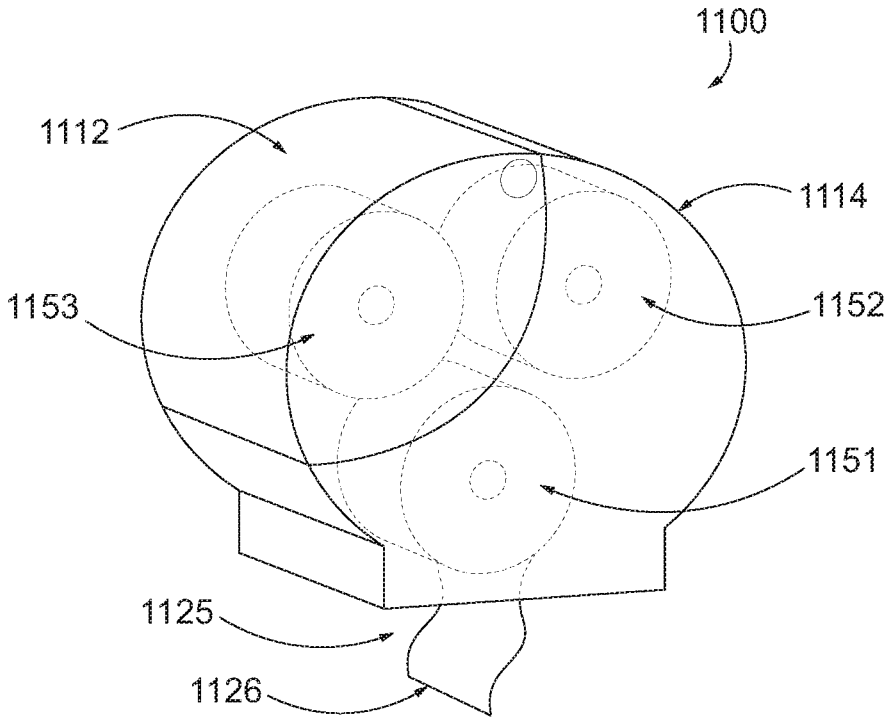
Figure 14B:
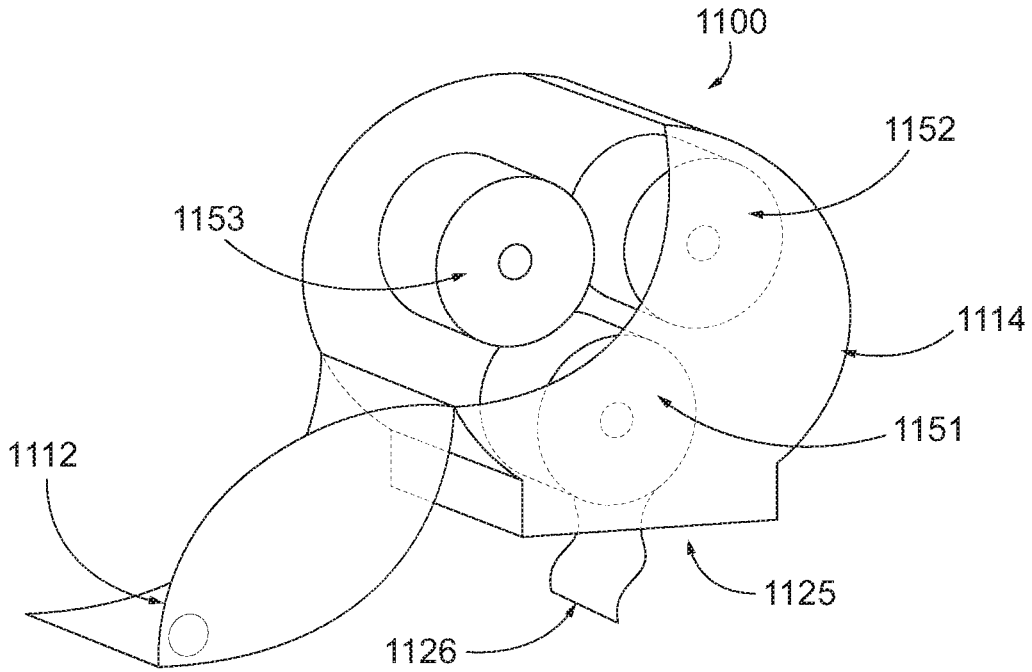
Figure 15:
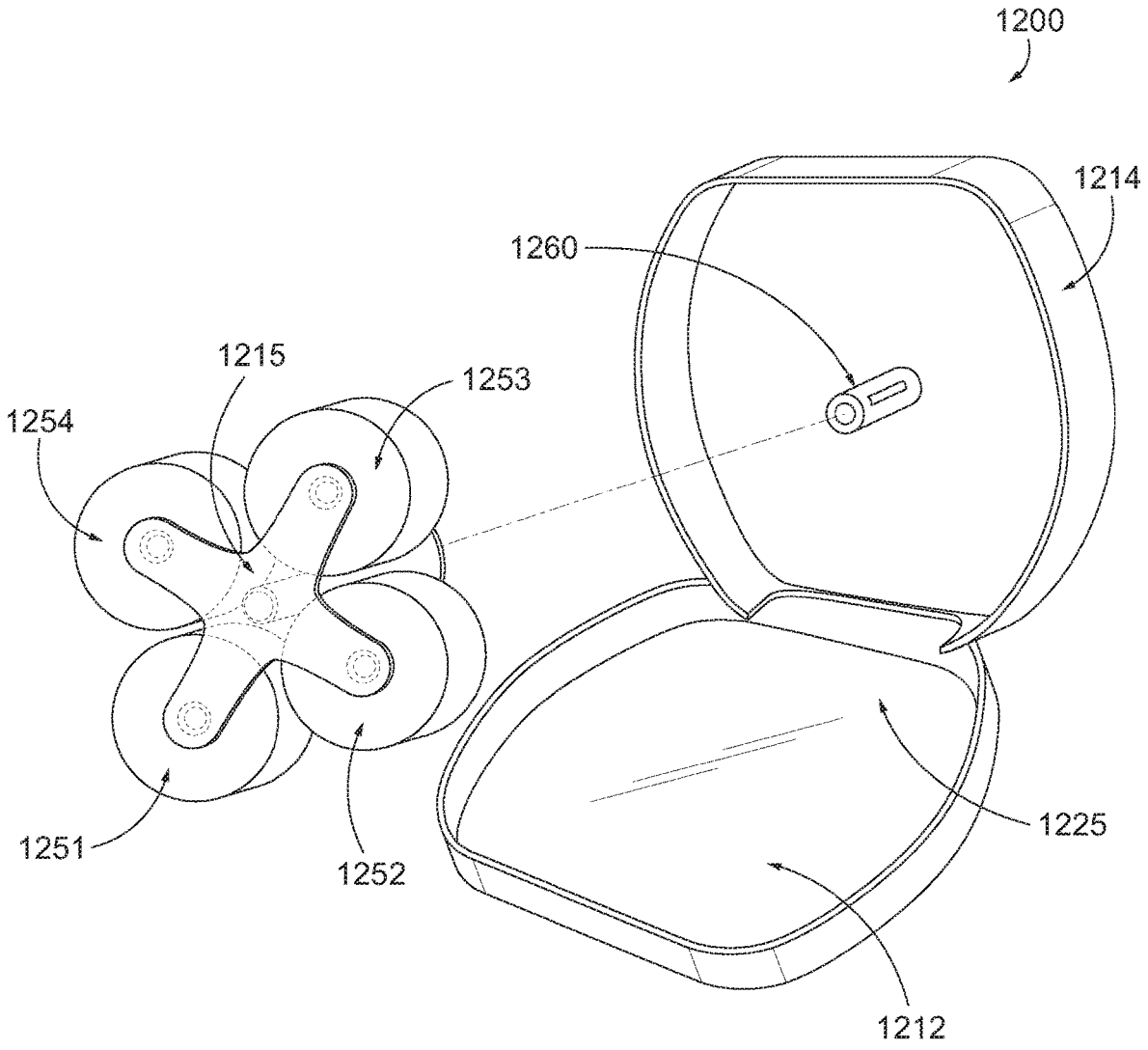
Figure 16A:
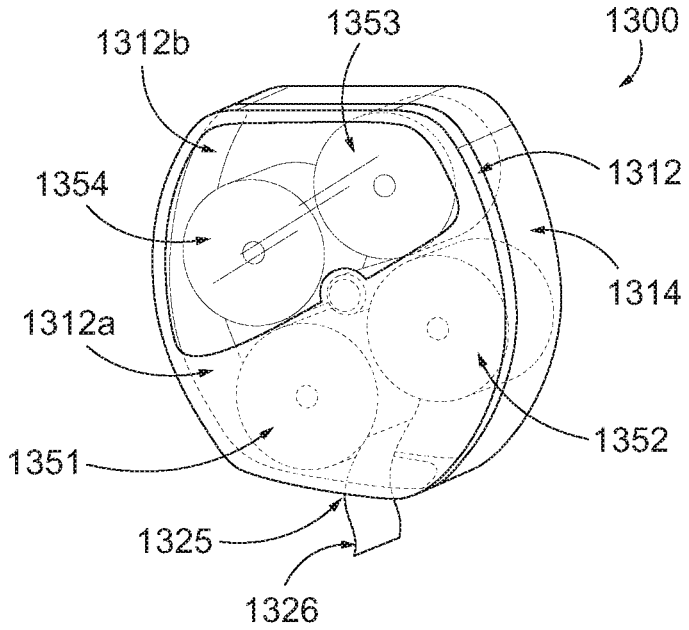
Figure 16B:
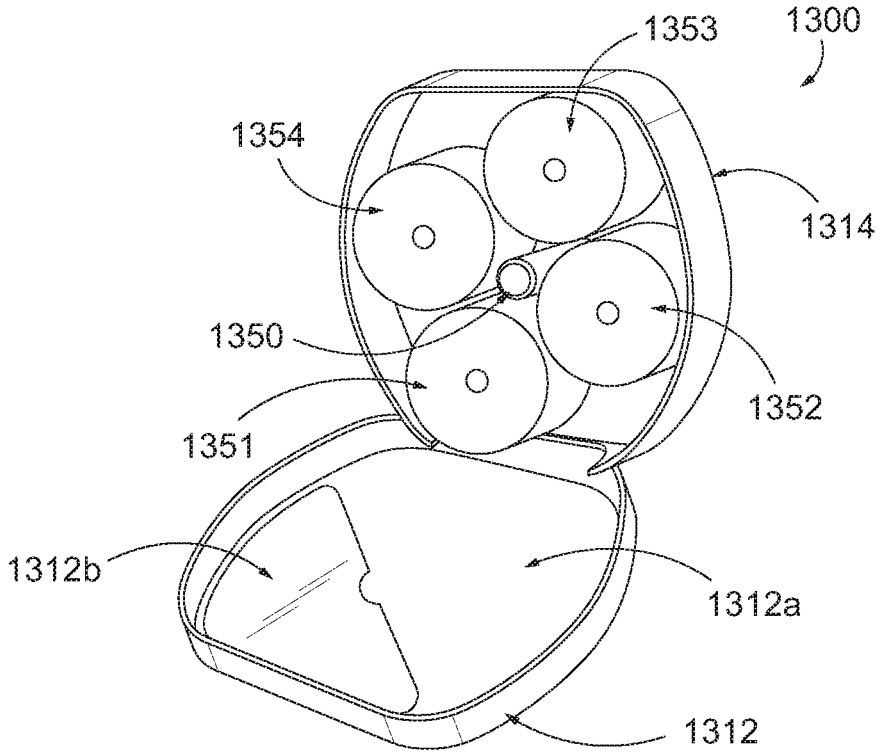
Figure 17:
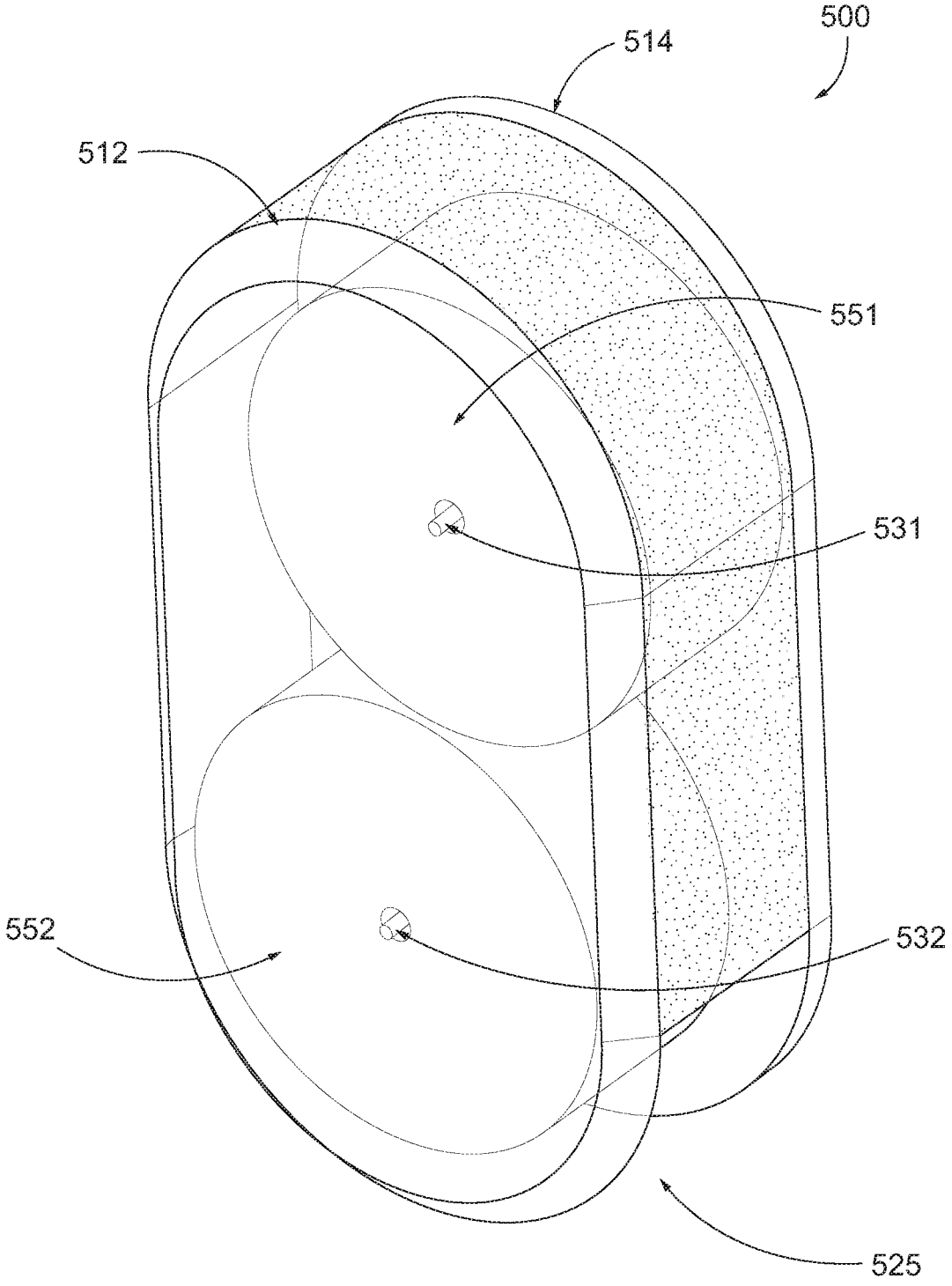
Figure 18A:
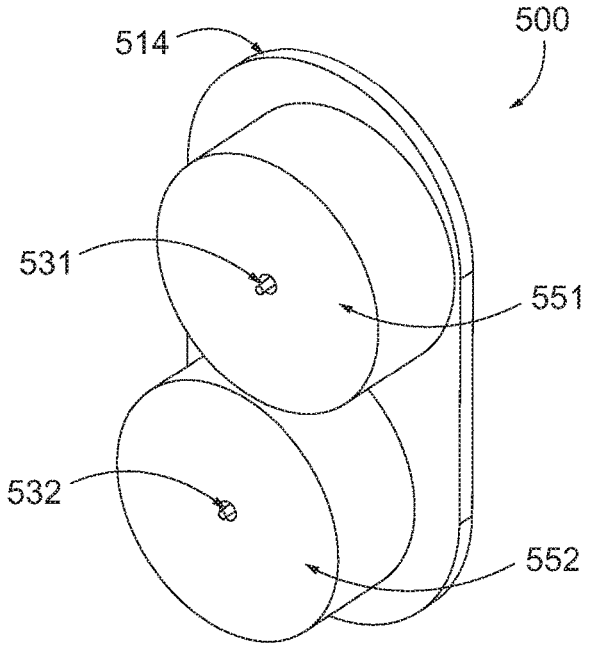
Figure 18B:
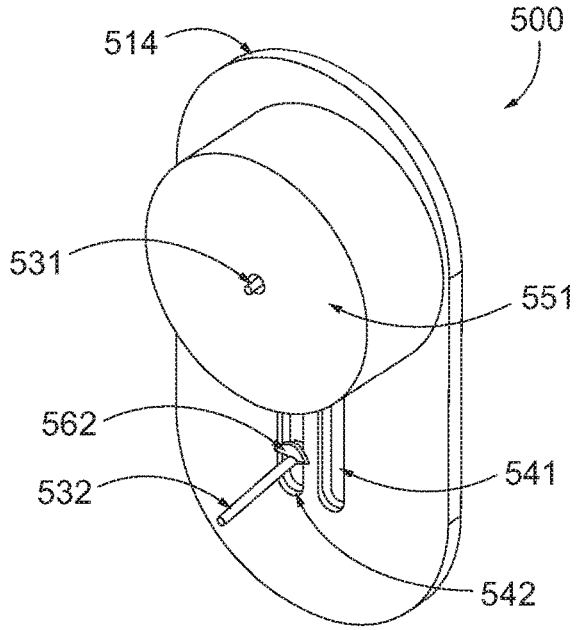
Figure 18C:
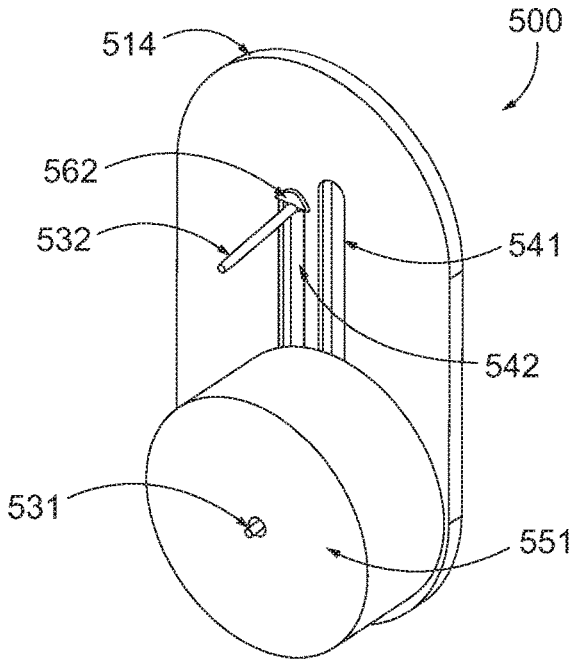
Figure 19A:
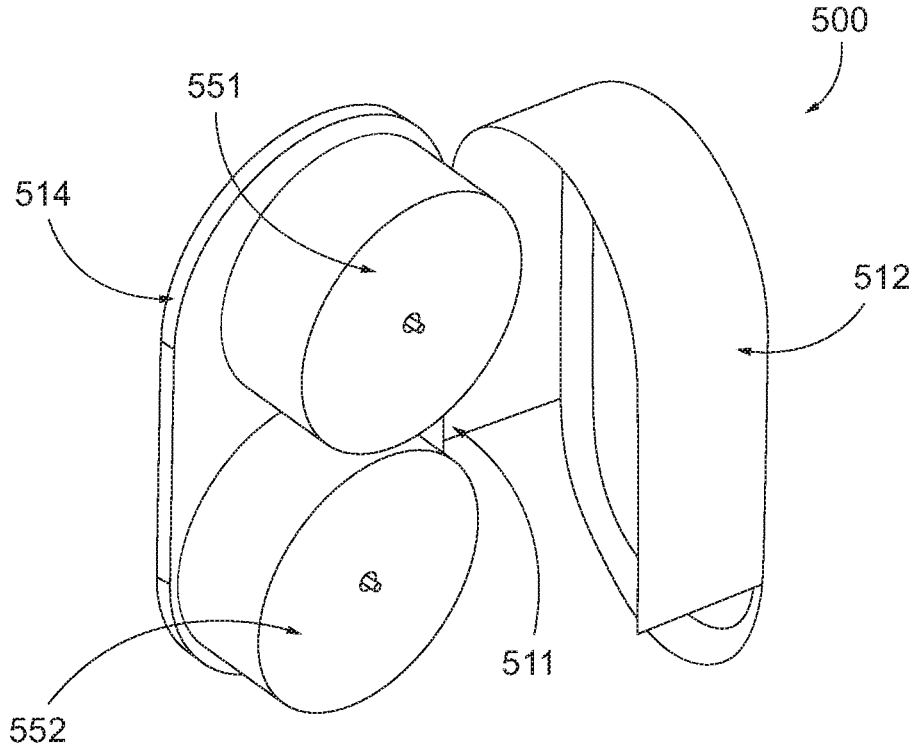
Figure 19B:
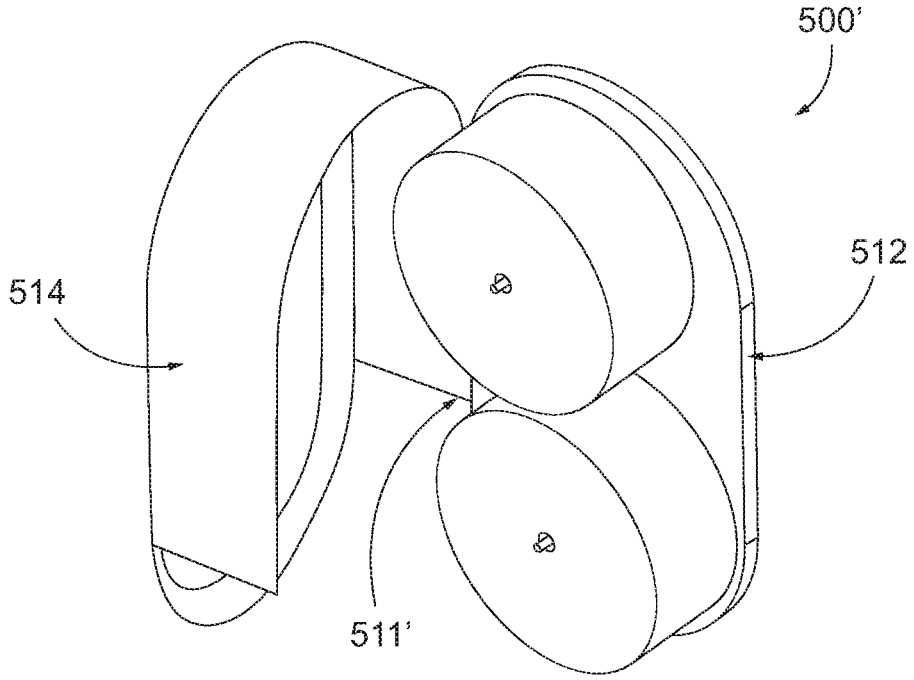
Figure 20A:
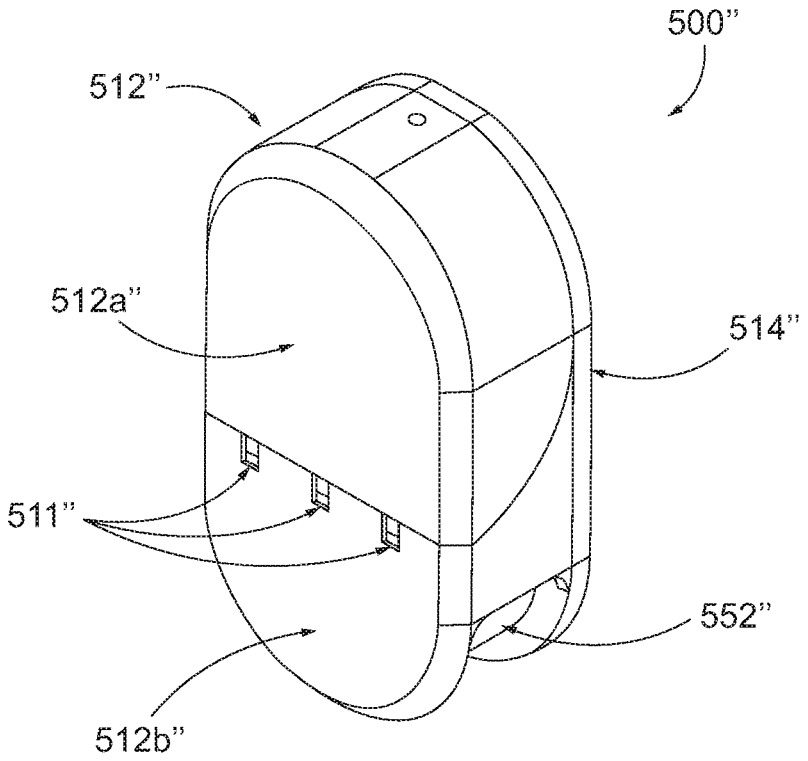
Figure 20B:
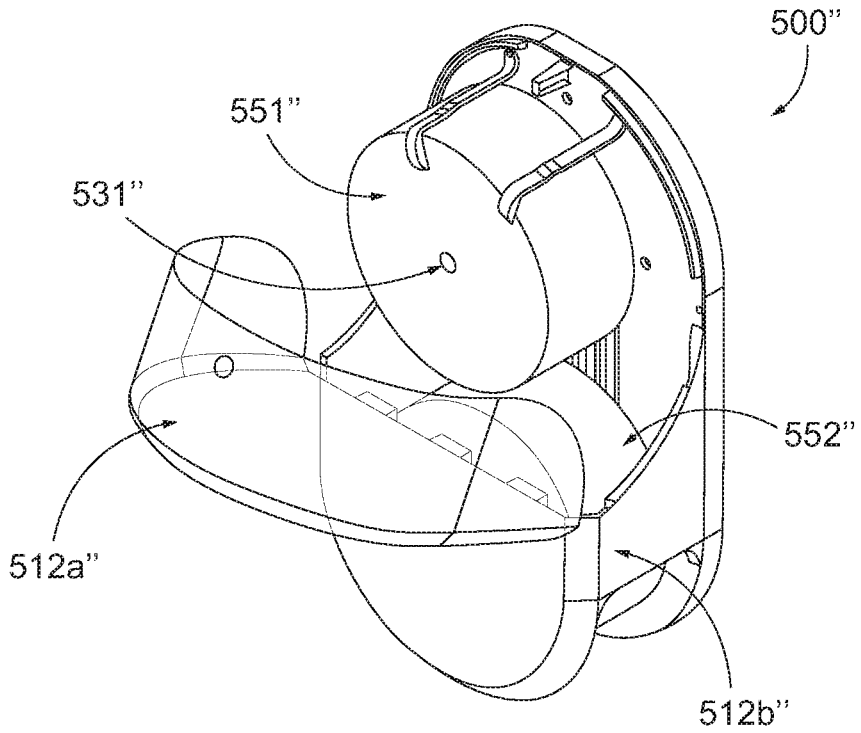
Figure 21:
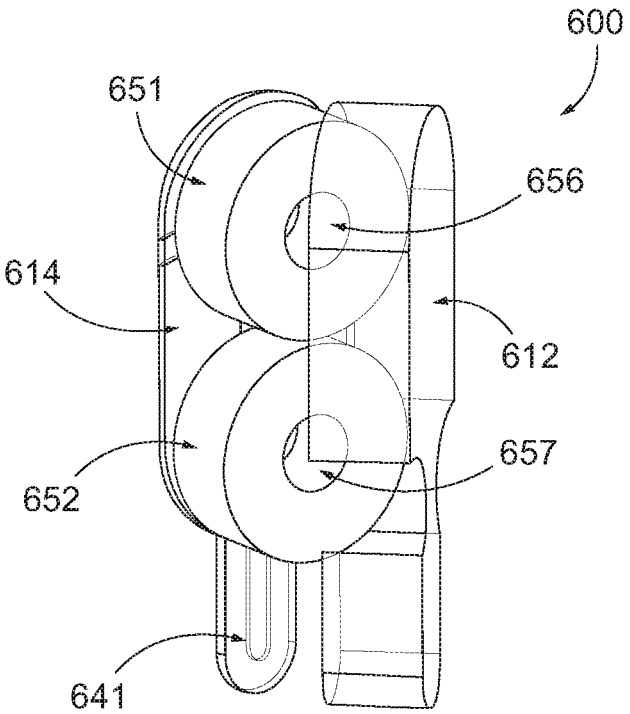
Figure 22A:
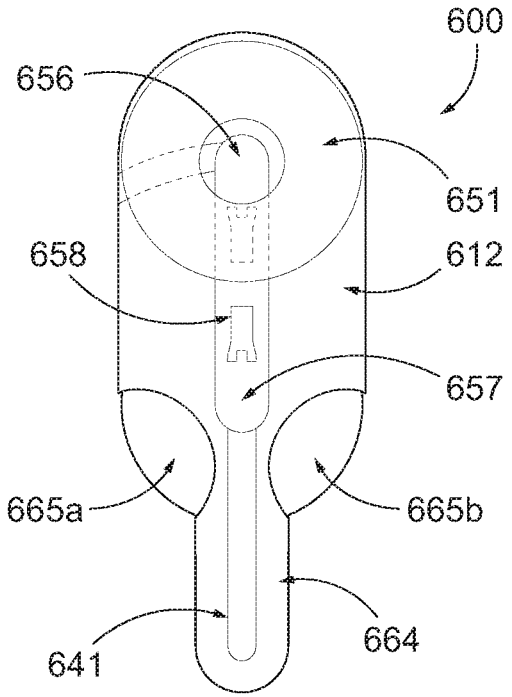
Figure 22B:
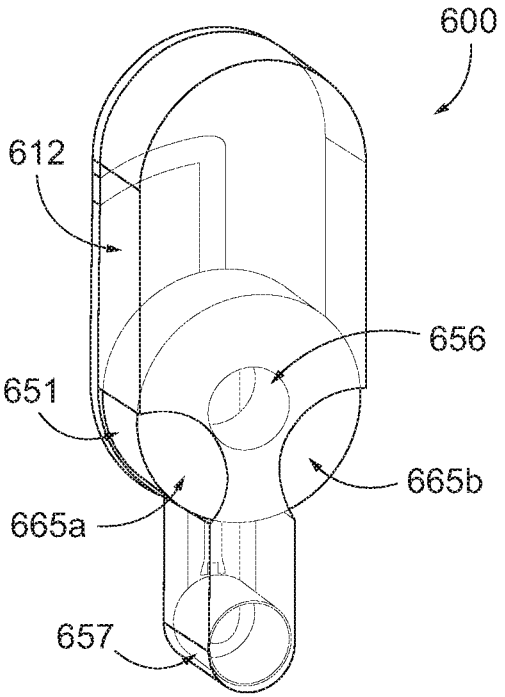
Figure 23A:
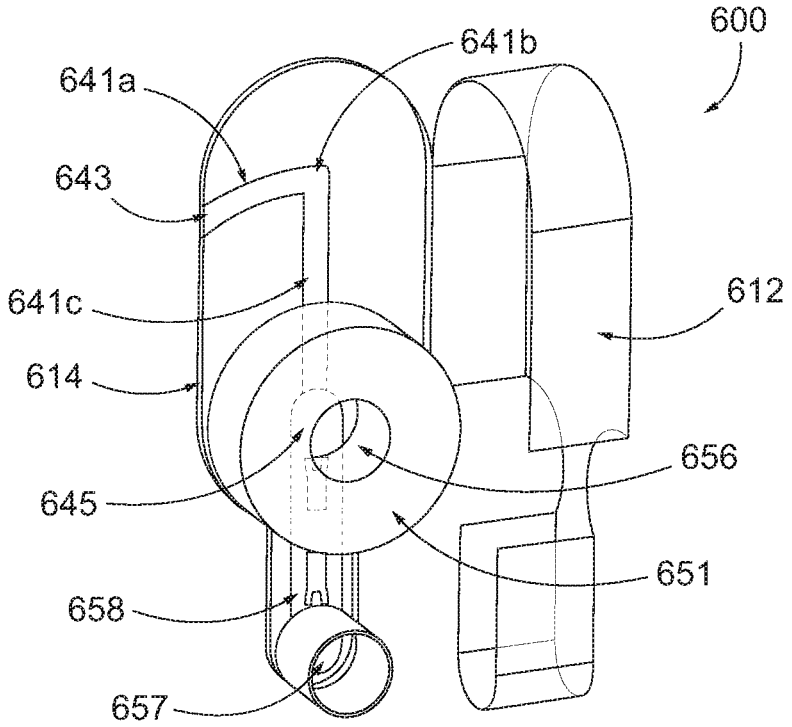
Figure 23B:
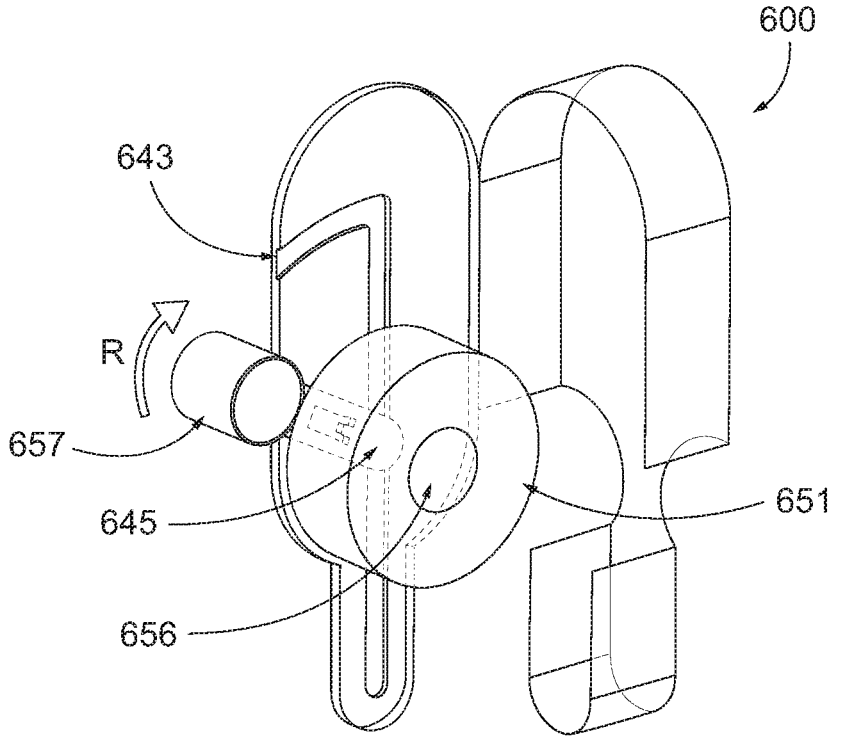
Figure 24A:
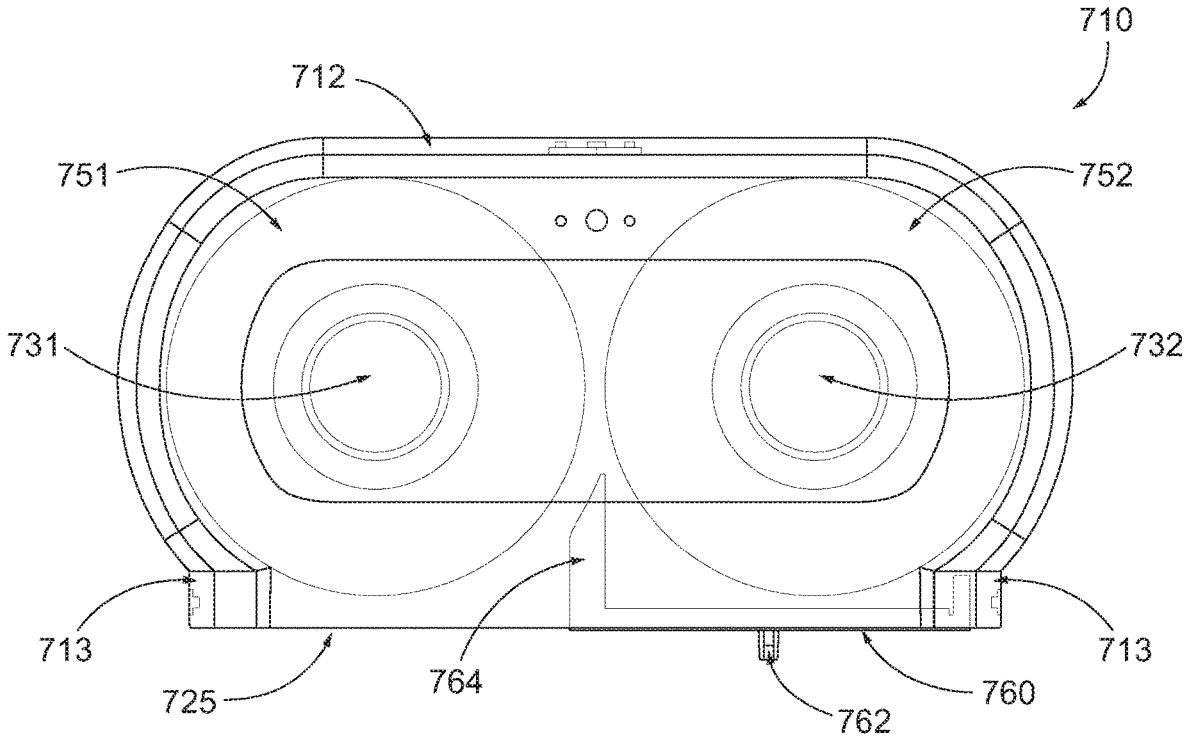
Figure 24B:
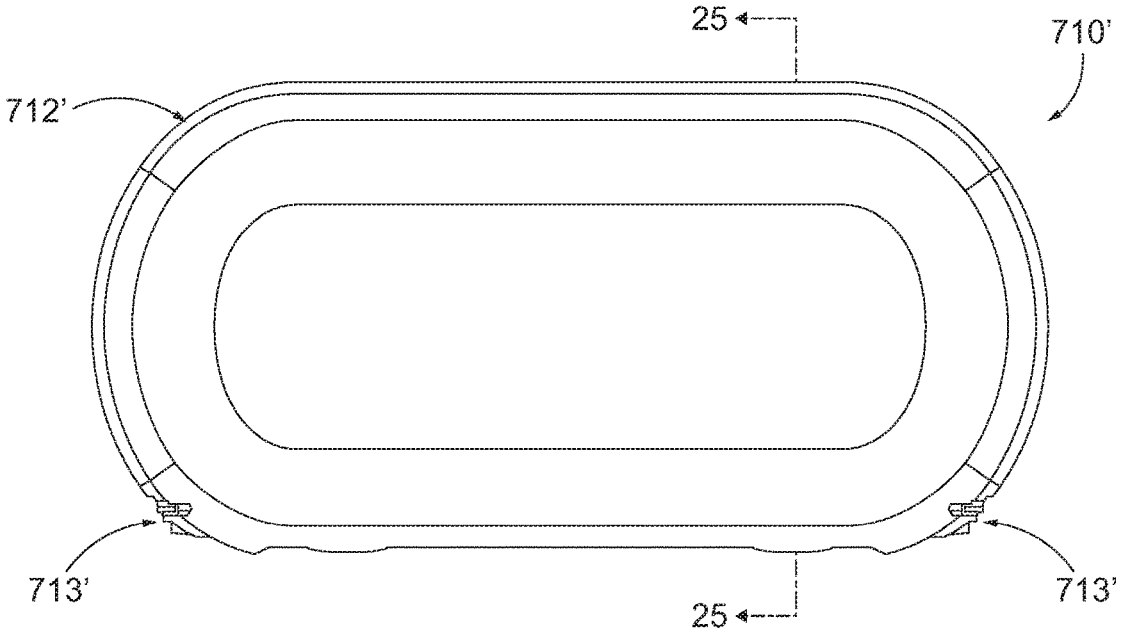
Figure 24C:
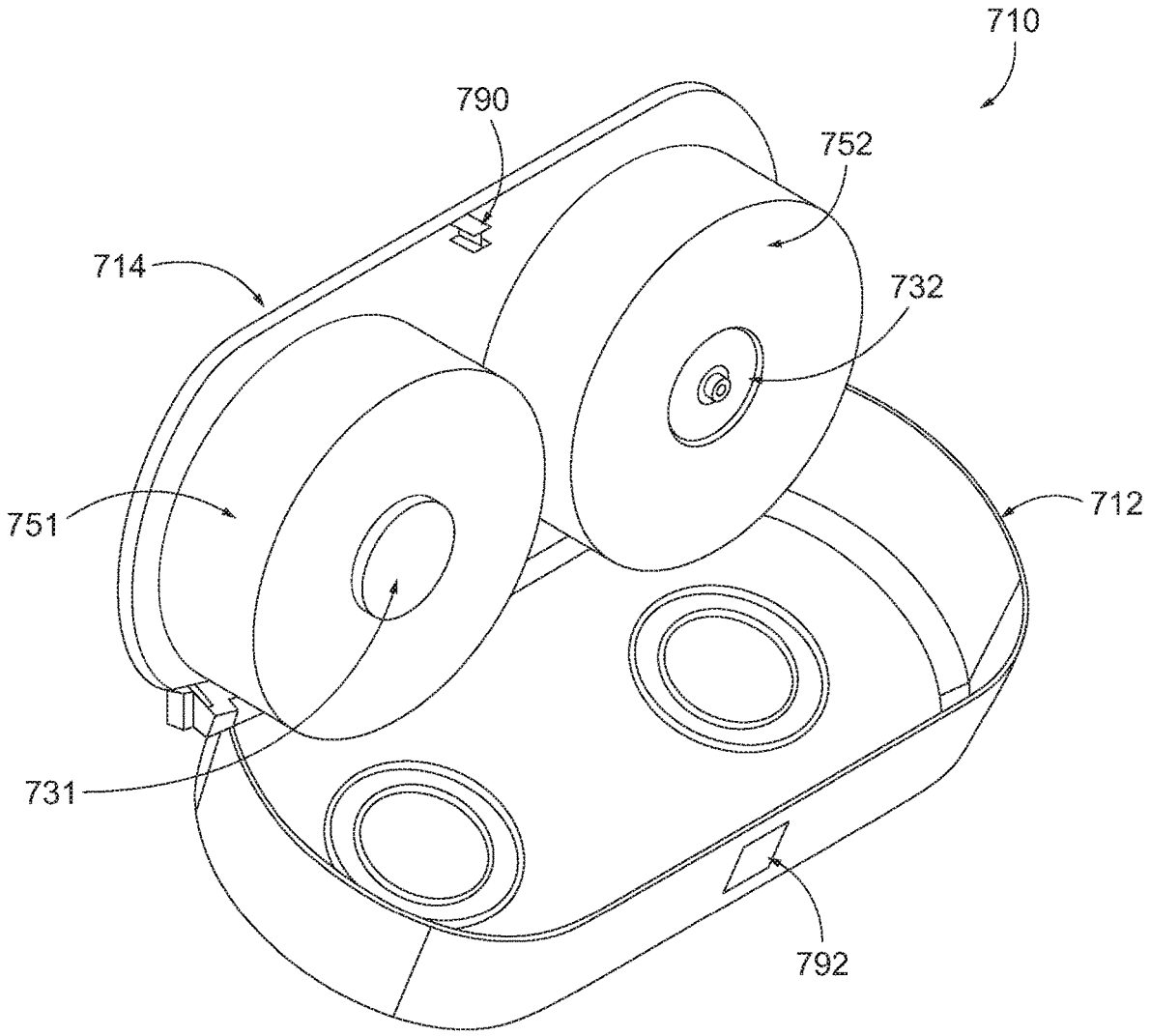
Figure 25:
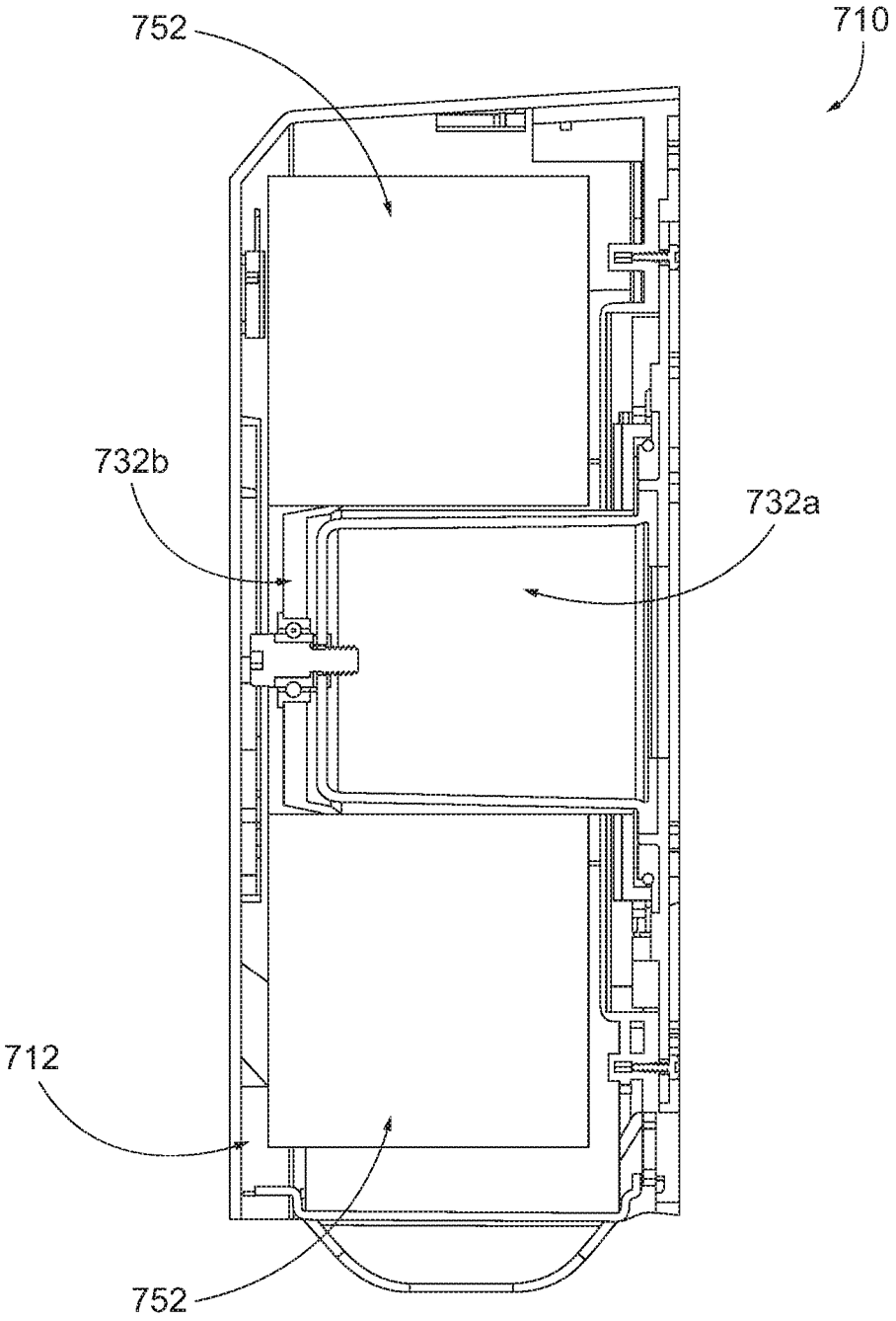
Figure 26A:
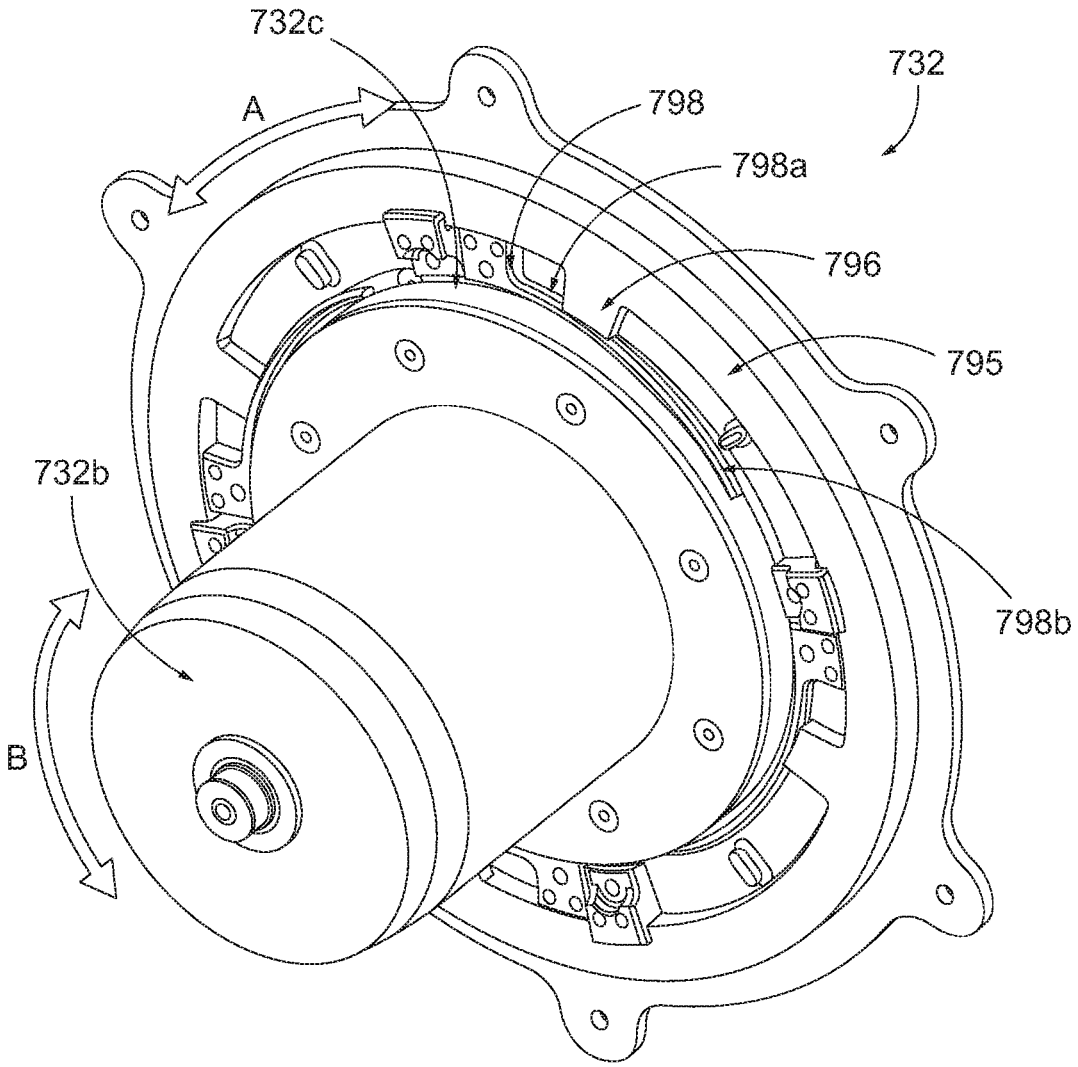
Figure 26B:
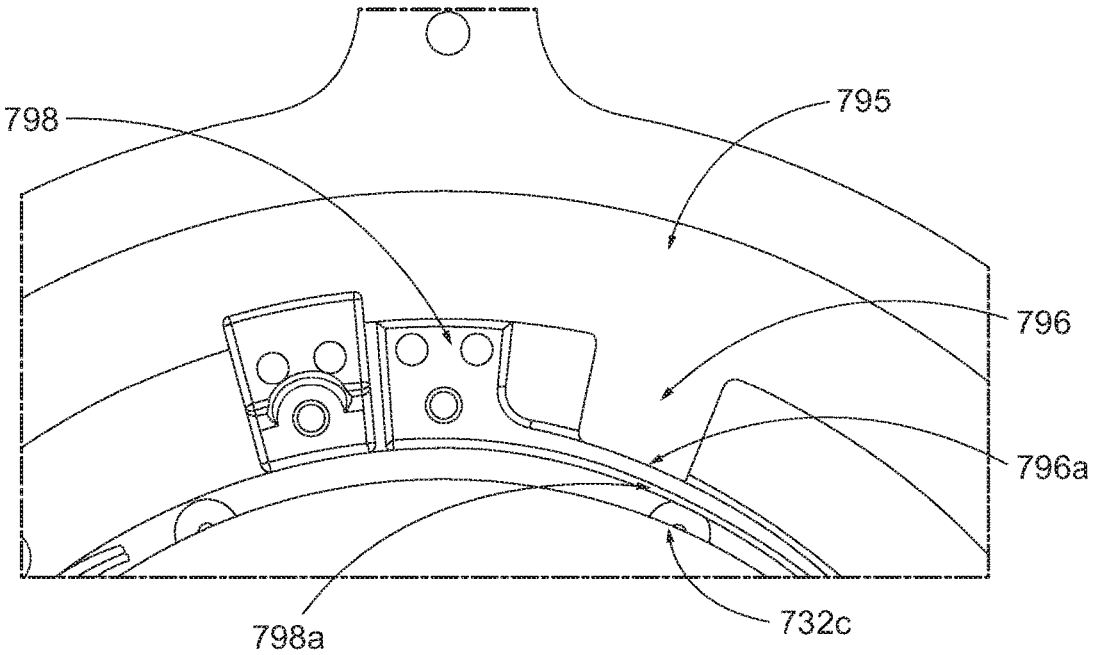
Figure 26C:
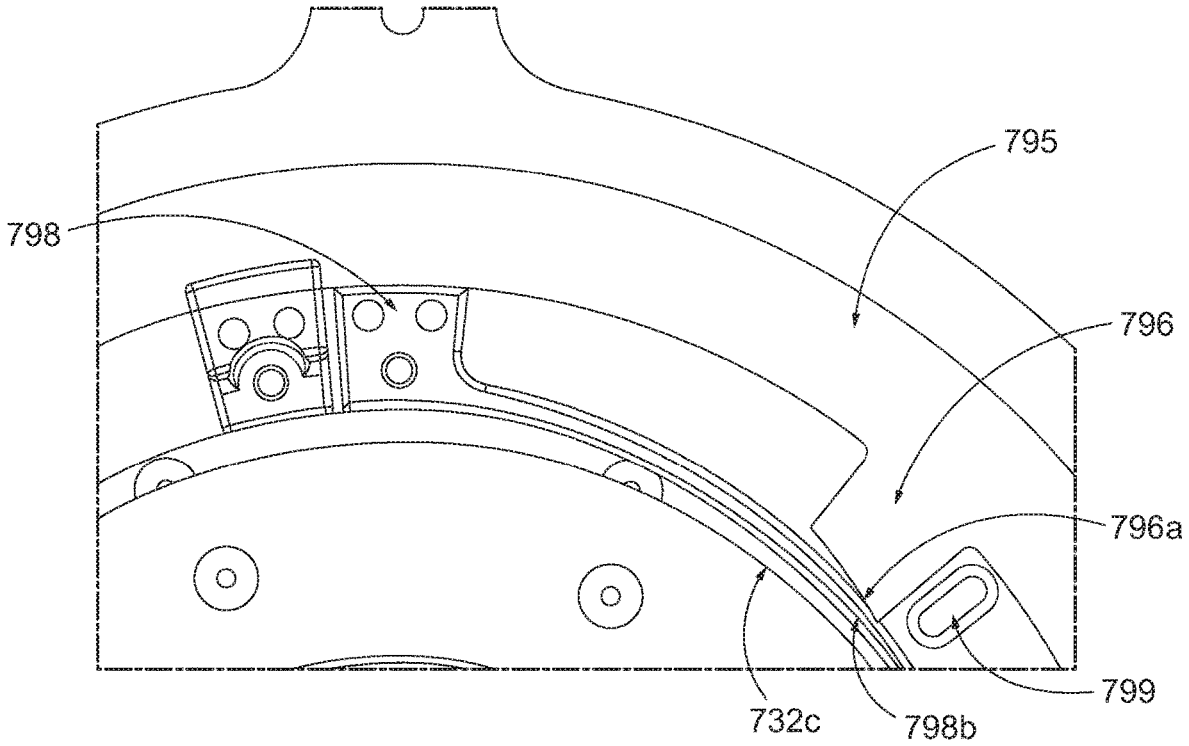
Figure 27A:
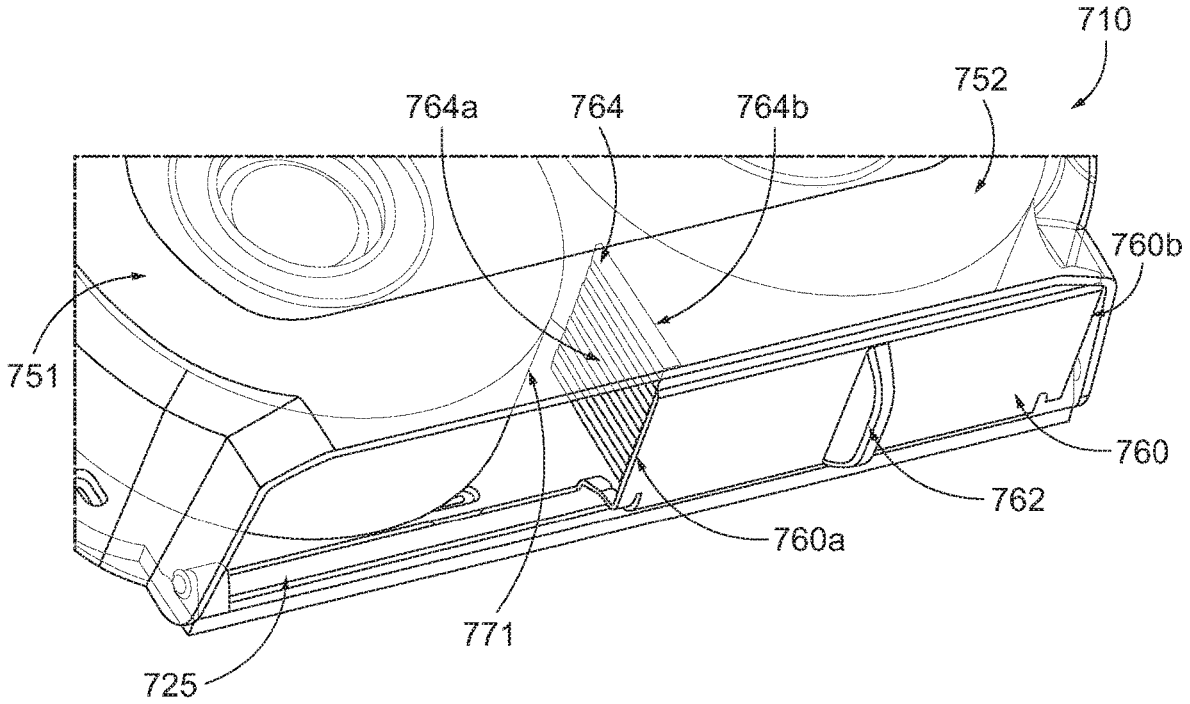
Figure 27B:
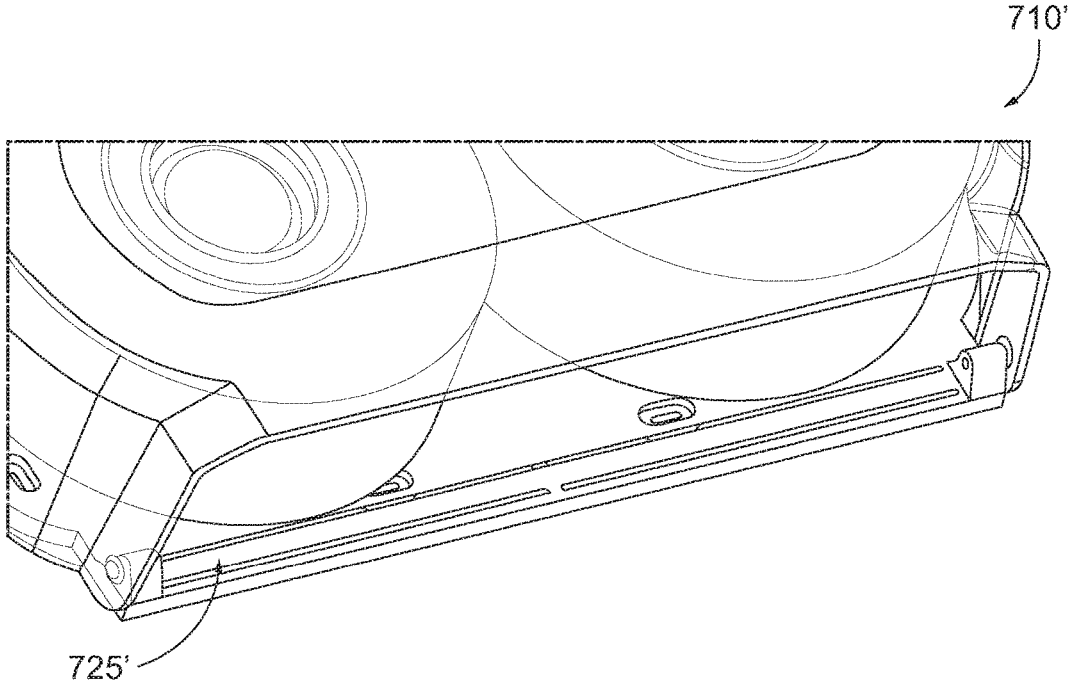
Figure 28:
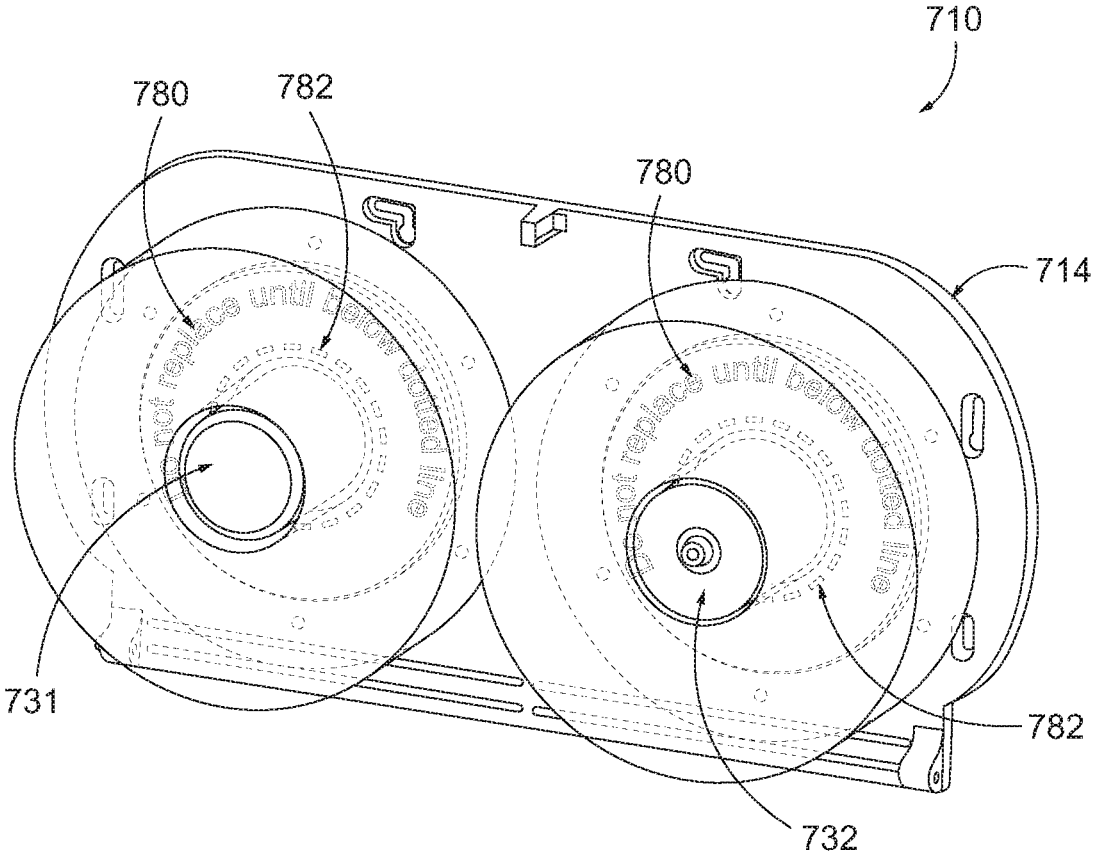
Figure 29:
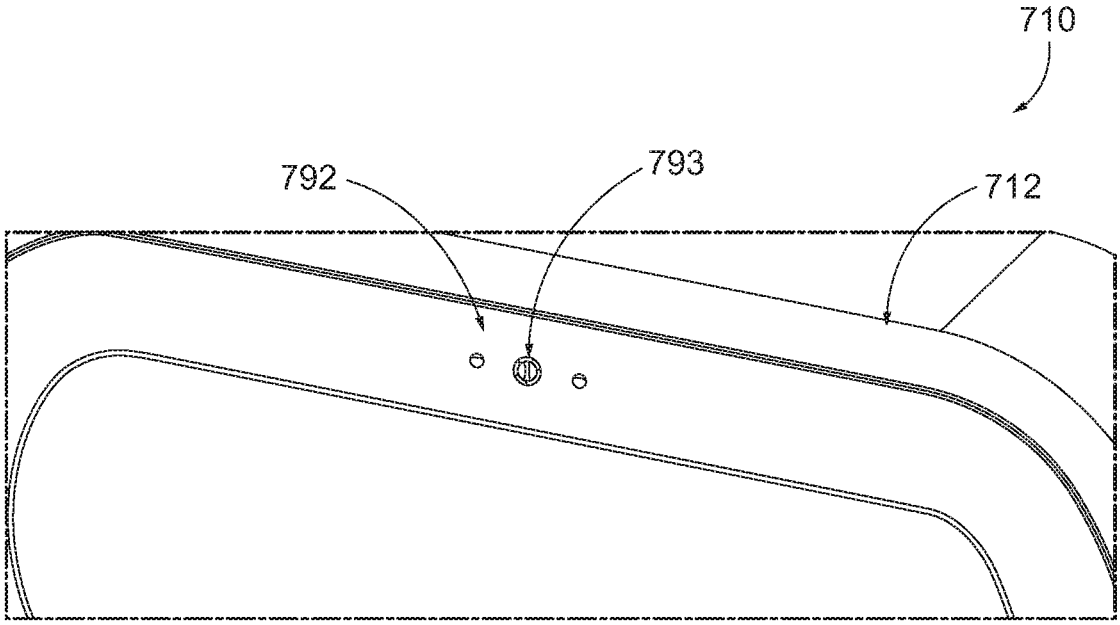
Figure 30A:
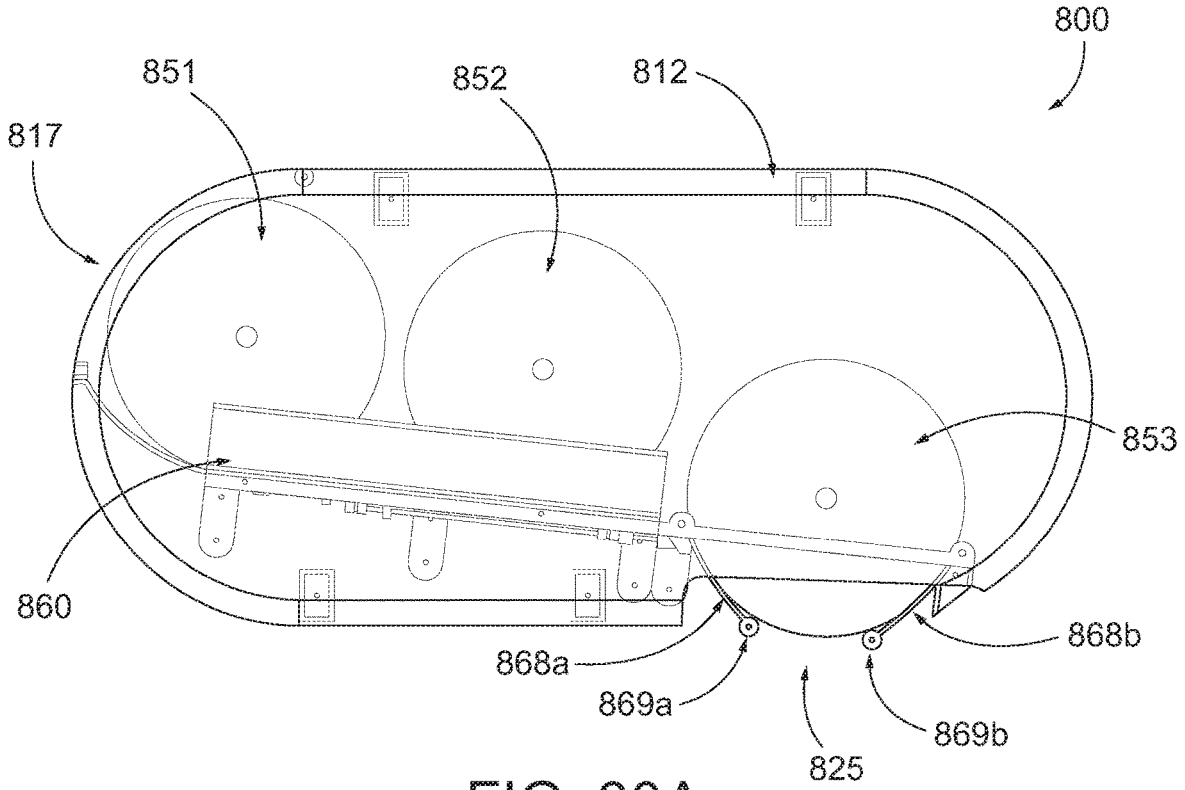
Figure 30B:
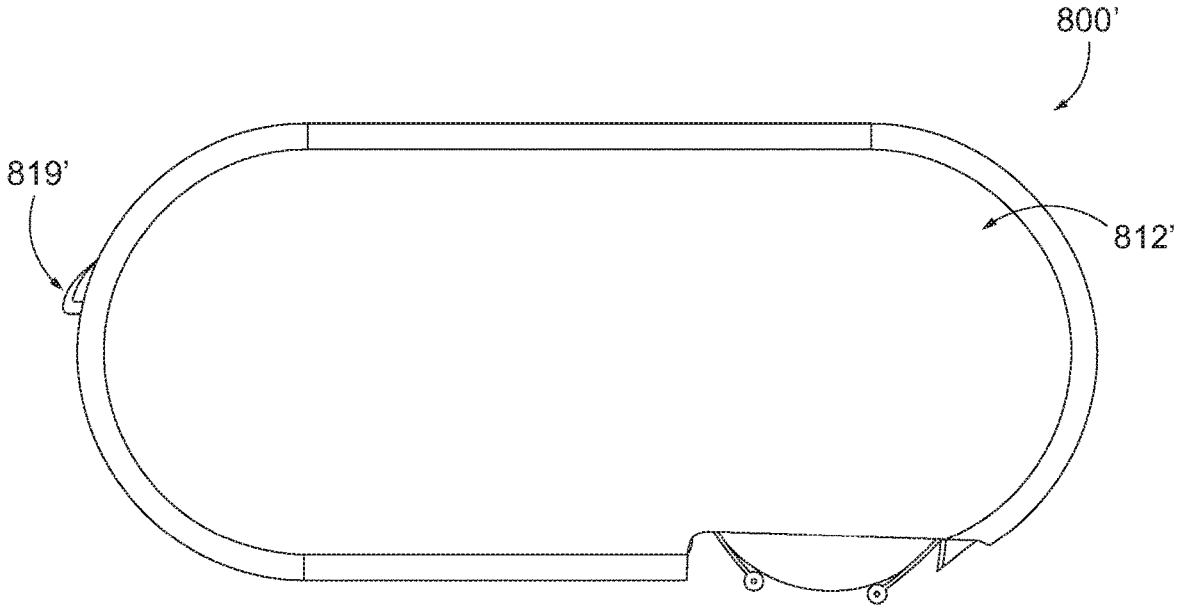
Figure 31A:
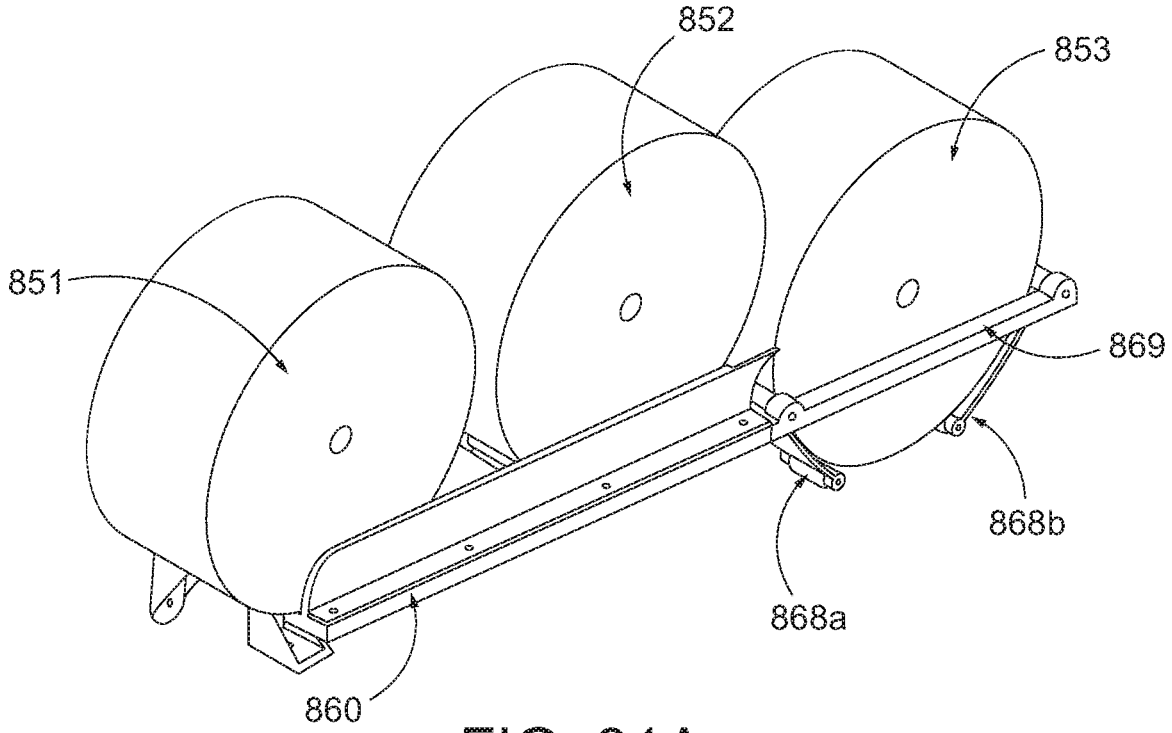
Figure 31B:
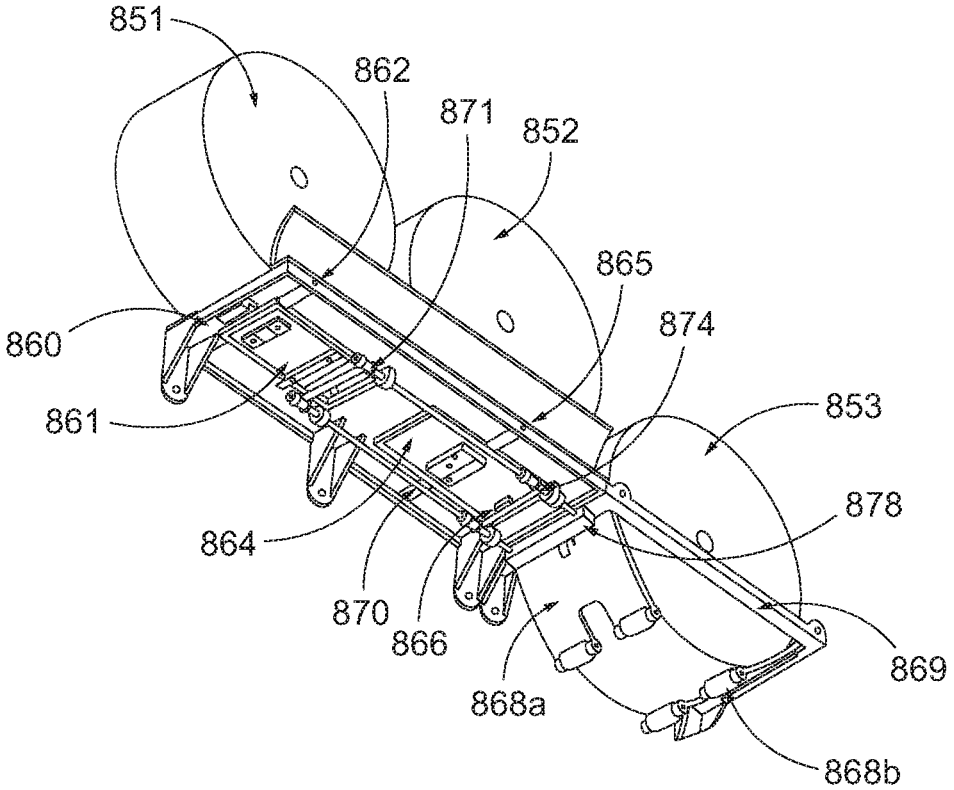
Figure 33A:
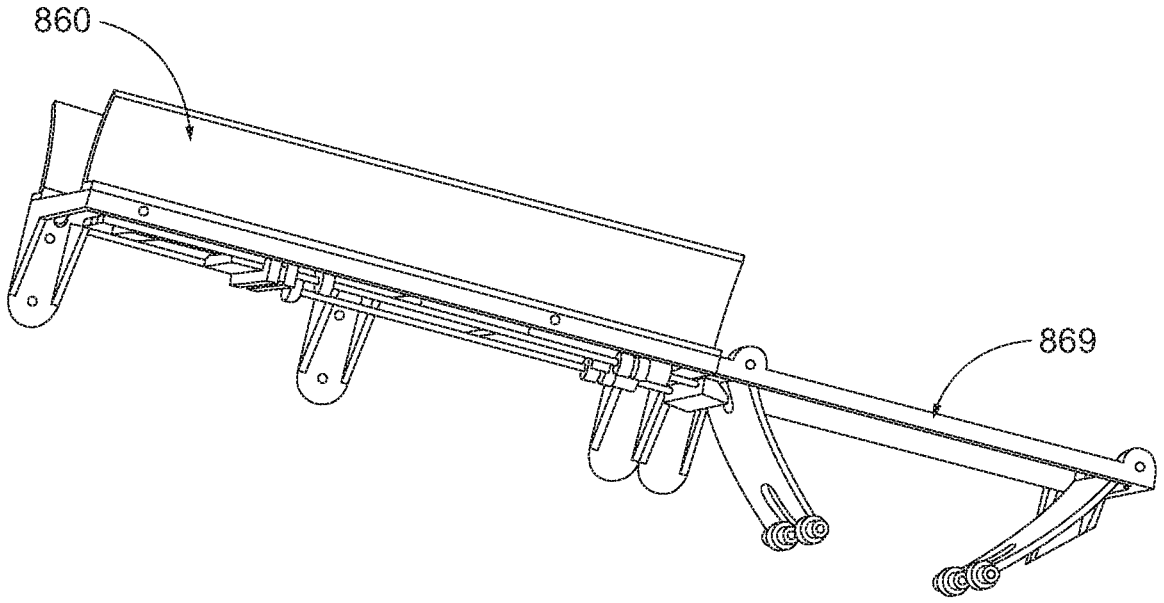
Figure 33B:
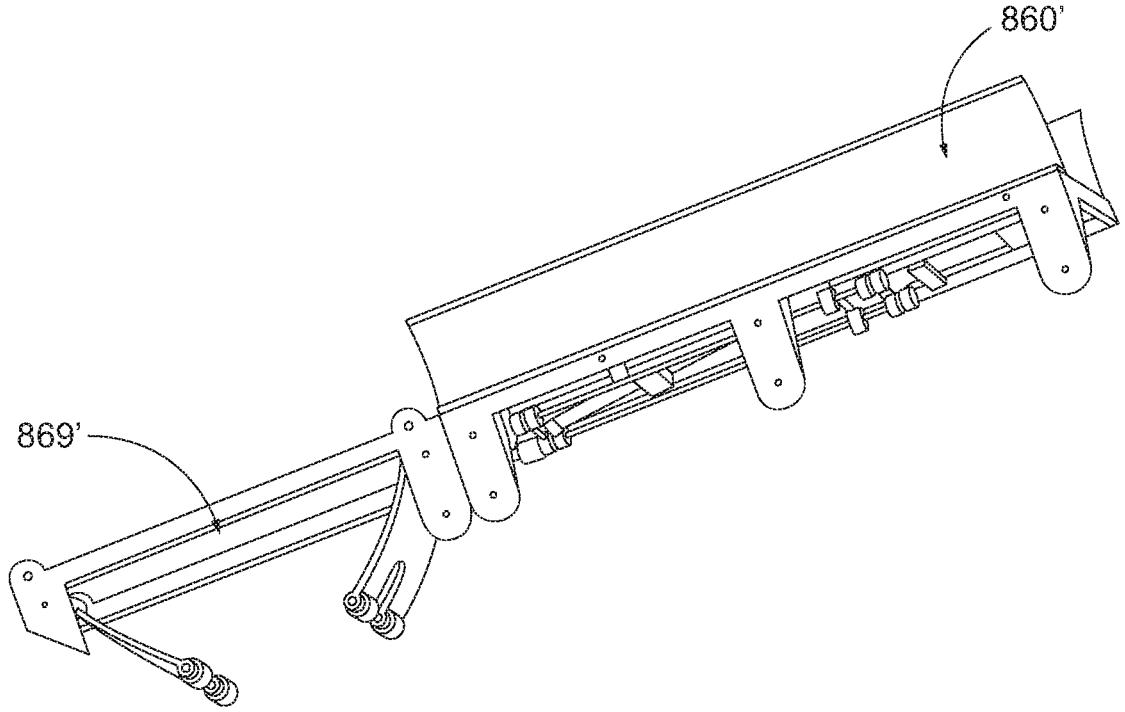
Figure 34A:
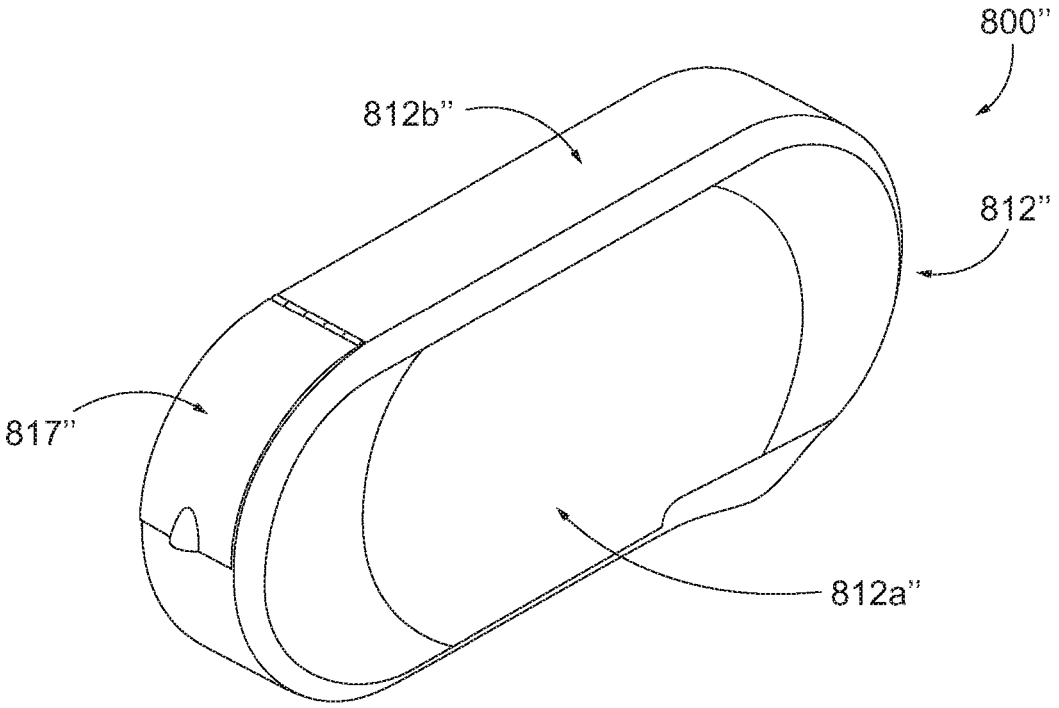
Figure 34B:
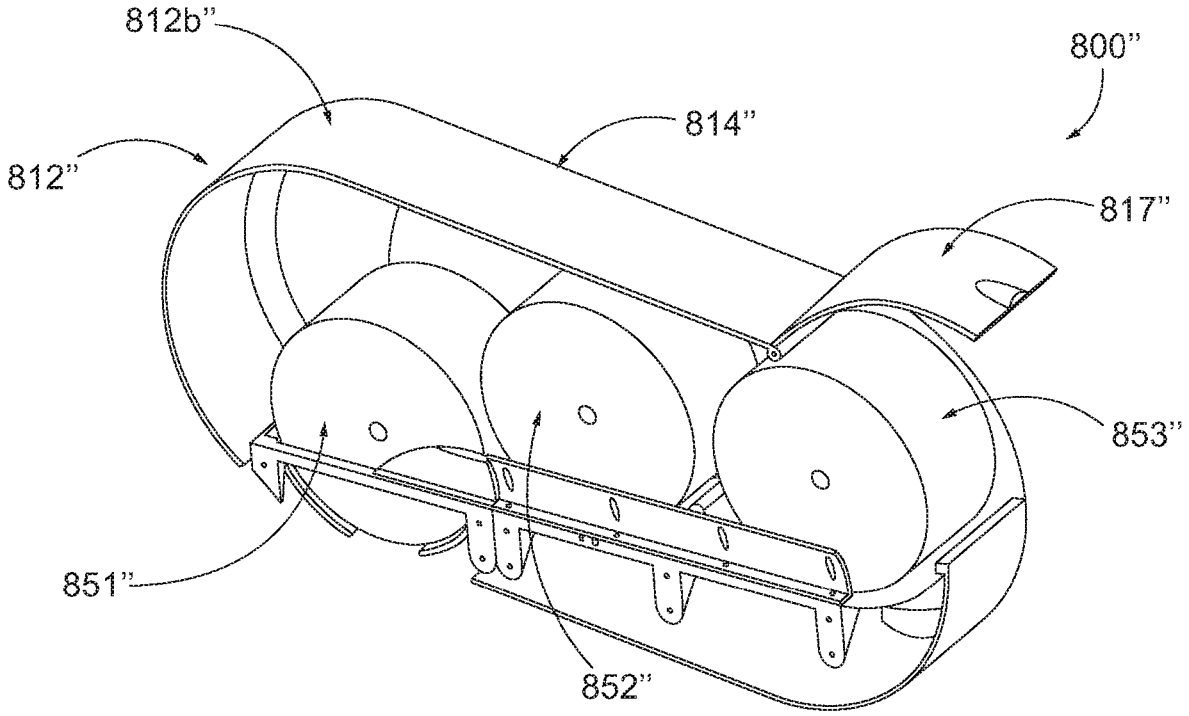

FIGS. 9A-B show a back housing of an example sheet product dispenser, where a release mechanism is provided for enabling rotation of the rotary mechanism, in accordance with example embodiments described herein;

FIG. 10A illustrates an example process for opening the first portion of the cover using a key, in accordance with example embodiments described herein;

FIGS. 10B-F illustrate various mechanisms for enabling opening of a second portion of the cover, in accordance with example embodiments described herein;

FIG. 11A shows a back housing and rotary device for an example sheet product dispenser, in accordance with example embodiments described herein;

FIG. 11B shows a rear perspective view of the example sheet product dispenser of FIG. 11A, in accordance with example embodiments described herein;

FIG. 11C shows a close up view of a pivot axis for the first portion of the cover and the second portion of the cover, in accordance with example embodiments described herein;

FIG. 11D shows the example sheet product dispenser of FIG. 11A with the second portion of the cover in the open position, in accordance with example embodiments described herein;

FIGS. 12A-B show an example sheet product dispenser, wherein a restrictive access feature is configured to flex, in accordance with example embodiments described herein;

FIGS. 13A-B show an example sheet product dispenser, wherein an installer is capable of setting whether emergency access to replace or remove a product roll in the dispensing position is allowed, in accordance with example embodiments described herein;

FIGS. 14A-B show an example sheet product dispenser, where a portion of the cover is capable of being opened to enable a replacement roll to be installed, in accordance with example embodiments described herein;

FIG. 15 shows an exploded view of an example sheet product dispenser and cartridge for installation into the sheet product dispenser, in accordance with example embodiments described herein;

FIGS. 16A-B show an example sheet product dispenser with a window that is positioned to provide visual access to only one or more reserve rolls within the sheet product dispenser, in accordance with example embodiments described herein;

FIG. 17 shows a perspective view of another example sheet product (e.g., tissue) dispenser, where a cover of the tissue dispenser is partially transparent and shows two product rolls arranged in a generally vertical fashion, in accordance with some embodiments discussed herein;

FIGS. 18A-C illustrate repositioning of a reserve product roll in the example dispenser of FIG. 17 upon depletion of the dispensing product roll, in accordance with example embodiments described herein;

FIGS. 19A-B show perspective views of an example sheet product dispenser such as shown in FIG. 17, wherein the side the cover is hinged on is configurable, in accordance with some embodiments discussed herein;

FIG. 20A shows a perspective view of another example sheet product (e.g., tissue) dispenser that holds two product rolls in a vertical arrangement, wherein a portion of the cover of the dispenser is configured to open to enable insertion and/or replacement of the reserve product roll, in accordance with example embodiments described herein;

FIG. 20B shows a perspective view of the example sheet product dispenser of FIG. 20A, wherein the portion of the cover is open, in accordance with example embodiments described herein;

FIG. 21 shows a perspective view of another example sheet product (e.g., tissue) dispenser, wherein the cover is open, in accordance with some embodiments discussed herein;

FIGS. 22A-22B illustrate transfer of a sheet product roll from a reserve position to a dispensing position within the example sheet product dispenser of FIG. 21, in accordance with some embodiments discussed herein;

FIGS. 23A-23B illustrate rotation of a roll holder to provide a maintainer with the ability to load a new sheet product roll in the reserve position, in accordance with some embodiments discussed herein;

FIG. 24A shows a front view of an example sheet product (e.g., tissue) dispenser, where a cover of the tissue dispenser is partially transparent and shows two side-by-side product rolls, in accordance with some embodiments discussed herein;

FIG. 24B shows a front view of another example sheet product dispenser with two side-by-side product rolls, in accordance with some embodiments discussed herein;

FIG. 24C shows a perspective view of the example sheet product dispenser of FIG. 24B, where the cover is open, in accordance with some embodiments discussed herein;

FIG. 25 shows a cross-sectional view taken along line 25-25 of the example sheet product dispenser of FIG. 24B, in accordance with some embodiments discussed herein;

FIG. 26A shows a perspective view of a rotatable roll holder for an example sheet product dispenser, in accordance with some embodiments discussed herein;

FIGS. 26B-C show a close-up view of an adjustment feature for the rotatable roll holder shown in FIG. 24A, in accordance with some embodiments discussed herein;

FIG. 27A shows a close-up view of a lower portion of the example sheet product dispenser of FIG. 26A, in accordance with some embodiments discussed herein;

FIG. 27B shows a close-up view of the lower portion of the example sheet product dispenser of FIG. 24A, wherein a sliding dispensing door has been removed, in accordance with some embodiments discussed herein;

FIG. 28 illustrates example indicators for the example sheet product dispenser of FIG. 24B, in accordance with some example embodiments discussed herein;

FIG. 29 shows a close-up view of a latch configuration for the example sheet product dispenser of FIG. 24B, in accordance with example embodiments described herein;

FIG. 30A shows a front view of another example sheet product (e.g., tissue) dispenser, where a cover of the tissue dispenser is partially transparent and shows three product rolls arranged in a generally horizontal fashion, in accordance with some embodiments discussed herein;

FIG. 30B shows a front view of another example sheet product dispenser that is similar to the tissue dispenser of FIG. 30A, where the cover is opaque, in accordance with example embodiments described herein;

FIGS. 31A-B show perspective views of a transfer rail and three product rolls for the example sheet product dispenser of FIG. 30A, in accordance with example embodiments described herein;

FIGS. 32A-E illustrate repositioning of reserve product rolls in the example dispenser of FIG. 30A upon depletion of the dispensing product roll, in accordance with example embodiments described herein;

FIGS. 33A-B show perspective views of a transfer rail for an example sheet product dispenser such as shown in FIG. 30A, wherein the side the dispensing product roll is presented on is configurable, in accordance with some embodiments discussed herein;

FIG. 34A shows a perspective view of another example sheet product (e.g., tissue) dispenser that holds three product rolls in a generally horizontal arrangement, wherein at least a portion of the cover of the dispenser is configured to open to enable insertion and/or replacement of, at least, one or more of the reserve product rolls, in accordance with example embodiments described herein; and FIG. 34B shows a perspective view of the example tissue dispenser of FIG. 34A, wherein the portion of the cover is removed, in accordance with example embodiments described herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example product dispensers may be a maintainer (e.g., a maintenance person, a janitor, a facility manager, etc.); a consumer (e.g., a person receiving a dispensed portion of the product); or an installer (e.g., a person installing the dispenser, such as on a wall of a bathroom).

Example Sheet Product Dispensers Described Herein

The described embodiments of the present invention generally relate to sheet product dispensers and, more particularly to mechanical (non-automated) sheet product dispensers. In this regard, FIGS. 1A-34B show various example sheet product dispensers that represent various example embodiments of the present invention. As noted above, the following describes various improvements to sheet product dispensers. In such a regard, some sheet product dispensers described herein may provide one or more features or designs that aim to provide for prevention or deterrence of premature removal or replacement of the dispensing product roll—such as to avoid unnecessary waste. Other possible benefits of various described embodiments may include, for example, providing for easy loading (e.g., drop-in loading) to enable quick and error free replacement, improved hygiene, automatic replacement of the dispensing product roll, increased capacity while maintaining a smaller footprint, reduction in overall waste, installation versatility, among many others.

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipers, wrapping paper, aluminum foil, wax paper, plastic wrap, food wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

The following descriptions of the illustrated sheet product dispensers are not meant to be limiting, as some embodiments of the present invention contemplate use with other types of sheet product dispensers, such as low (or lower) capacity tissue dispensers, automated tissue dispensers, napkin dispensers, paper towel dispensers, among others. For example, certain described embodiments herein may be utilized with automated tissue product dispensers. In such example embodiments, the automated tissue product dispenser may have components (e.g., housing, roll holders, etc.) that are utilized with various embodiments of the present invention described herein. Additional information regarding example automated tissue product dispensers, including components and functionality thereof, can be found in U.S. Pat. Nos. 8,162,252 and 7,861,964, both of which are assigned to the owner of the present invention and incorporated by reference in their entireties. Similarly, certain described embodiments herein may be utilized with example automatic paper towel dispensers. In such example embodiments, the example automatic paper towel dispenser may have components (e.g., housing, roll holders, etc.) that are utilized with various embodiments of the present invention described herein. Additional information regarding example automatic paper towel dispensers, including components and functionality thereof, can be found in U.S. Pat. No. 7,182,288, which is assigned to the owner of the present invention and incorporated by reference in its entirety. As another example, certain described embodiments herein may be utilized with mechanical sheet product dispensers. In such example embodiments, the mechanical sheet product dispenser may have components (e.g., housing, roll holders, etc.) that are utilized with various embodiments of the present invention described herein. Additional information regarding non-automated (mechanical) product dispensers, including components and functionality thereof, can be found in U.S. Pat. Nos. 7,270,292 and 5,441,189, both of which are assigned to the owner of the present invention and incorporated by reference in their entireties. As a further example, certain described embodiments herein may be utilized with napkin product dispensers. In such example embodiments, the napkin dispenser may have components (e.g., housing, roll holders, etc.) that are utilized with various embodiments of the present invention described herein. Additional information regarding example napkin product dispensers, including components and functionality thereof, can be found in U.S. Pat. No. 9,604,811, which is assigned to the owner of the present invention and incorporated by reference in its entirety.

Example Multi-Roll Rotary Sheet Product Dispenser

FIGS. 1A-16B illustrate example sheet product (e.g., tissue) dispensers that include a plurality of tissue product rolls (e.g., high capacity product rolls) positioned on a rotary device. Such example sheet product dispensers may include one or more features that provide benefits or improvements to prior dispensers. While such features may be described with respect to the below example tissue dispensers, some embodiments of the present invention contemplate use of such features with other sheet product dispensers, such as some of the example sheet product dispensers described herein.

Figure 1A:
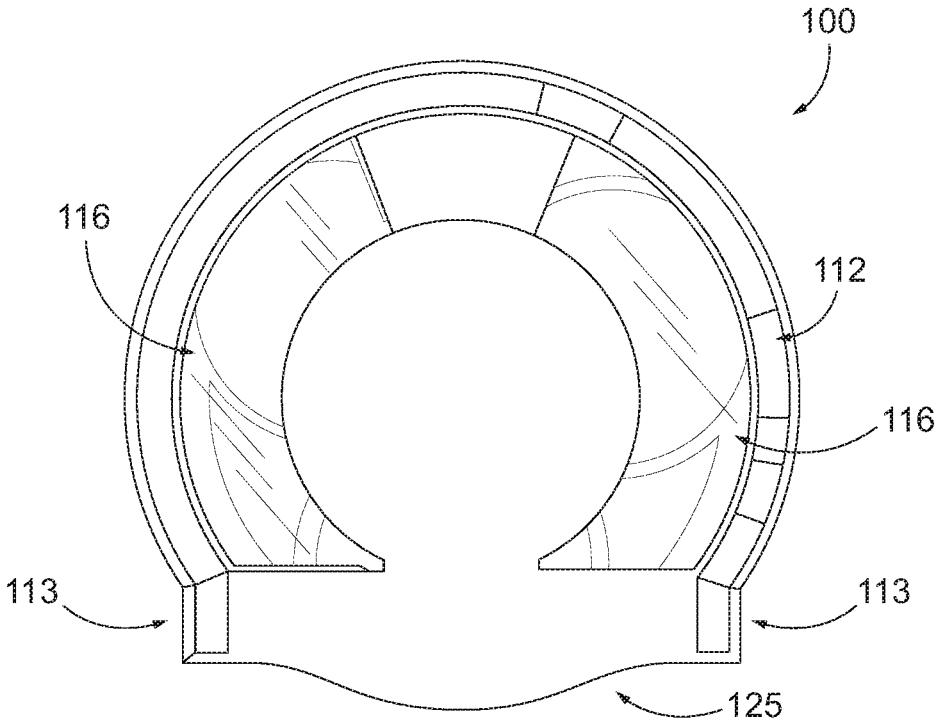
FIG. 1A shows a front view of an example sheet product (e.g., tissue) dispenser that holds three product rolls, in accordance with example embodiments described herein.
Figure 1B:
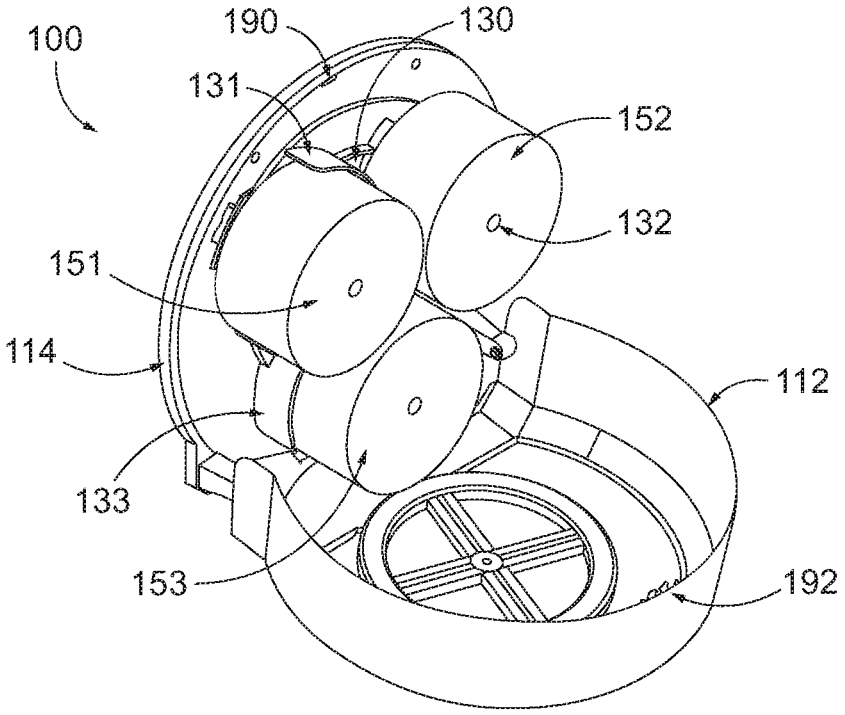
FIG. 1B shows a perspective view the example tissue dispenser of FIG. 1A with a cover open, in accordance with example embodiments described herein.

FIGS. 1A-1B show an example tissue dispenser 100 that includes three product rolls 151, 152, 153 that are positioned in circular manner around a rotary mechanism 130. The tissue dispenser 100 includes a housing with a cover 112 that is movable between a closed position (shown in FIG. 1A) and an open position (shown in FIG. 1B) through use of a latch 190, 192. The tissue dispenser 100 includes a first product roll 151 that is held on a first roll holder/spindle (e.g., associated with a first shield/visual indicator 131) of the rotary device 130, a second product roll 152 that is held on a second roll holder/spindle (e.g., associated with a second shield/visual indicator 132) of the rotary device 130, and a third product roll 153 that is held on a third roll holder/spindle (e.g., associated with a third shield/visual indicator 133) of the rotary device 130. A dispensing opening 125 enables a user to access and tear off (e.g., using perforations) a portion of the tissue product (e.g., a tail of the tissue product may hang down through the dispensing opening 125). In the depicted embodiment, a third product roll 153 is positioned in a dispensing position such that a user can access product from the third product roll 153 through the dispensing opening 125.

In some embodiments, the sheet product dispenser may include a housing (e.g., cover 112 and base portion 114) that is sized to receive a maximum amount of product with maintaining a minimum necessary footprint. In some embodiments, each product roll includes a large capacity of tissue product (e.g., 811 feet of tissue product), such that the entire capacity of the tissue dispenser 100 is high (e.g., approximate 2,433 feet).

In some embodiments, the cover 112 (or portions thereof, such as one or more windows 116) may be transparent, partially transparent, or translucent such that a user can visually determine an amount of product remaining within the dispenser.

In some embodiments, the sheet product dispenser 100 may be sized and/or designed to provide increased coverage for improved hygiene compliance. For example, the tissue dispenser 100 in FIG. 1A includes extra coverage for the product rolls 151, 152, 153 in the form of a lower portion 113 of the housing. FIG. 5C also illustrates another example tissue dispenser 100" that includes extra coverage for the dispensing roll in the form of a lower portion 113" of the housing. Such extra coverage may prevent a user (who may have dirty hands) from touching certain portions of the product roll (e.g., a side surface of the product roll), as less of the product roll is available for interaction with the user—thereby providing more beneficial hygiene.

Figure 2A:
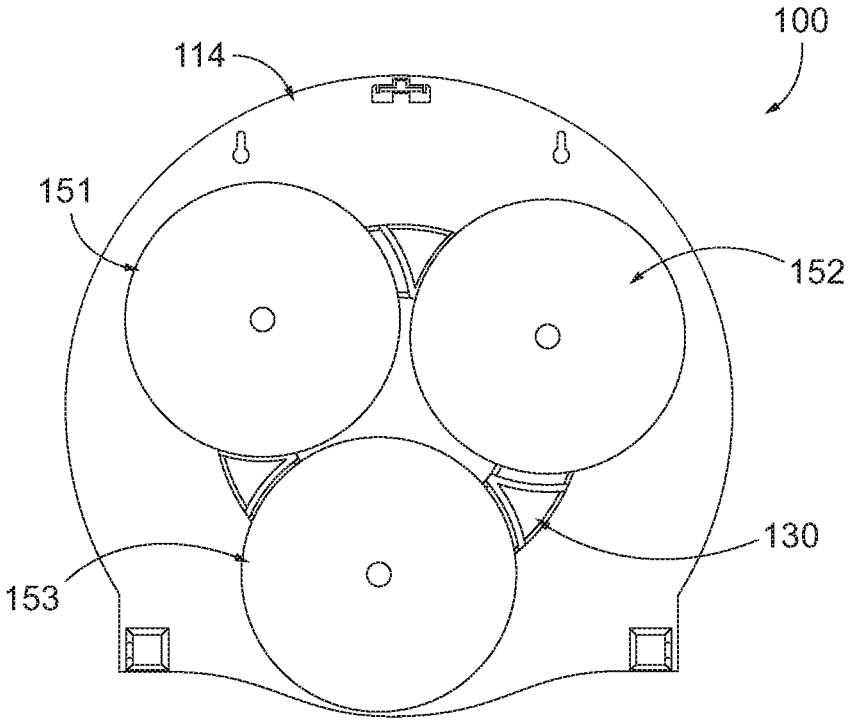
FIGS. 2A-2B show front views of the example tissue dispenser of FIG. 1A with the cover removed, in accordance with example embodiments described herein.
Figure 2B:
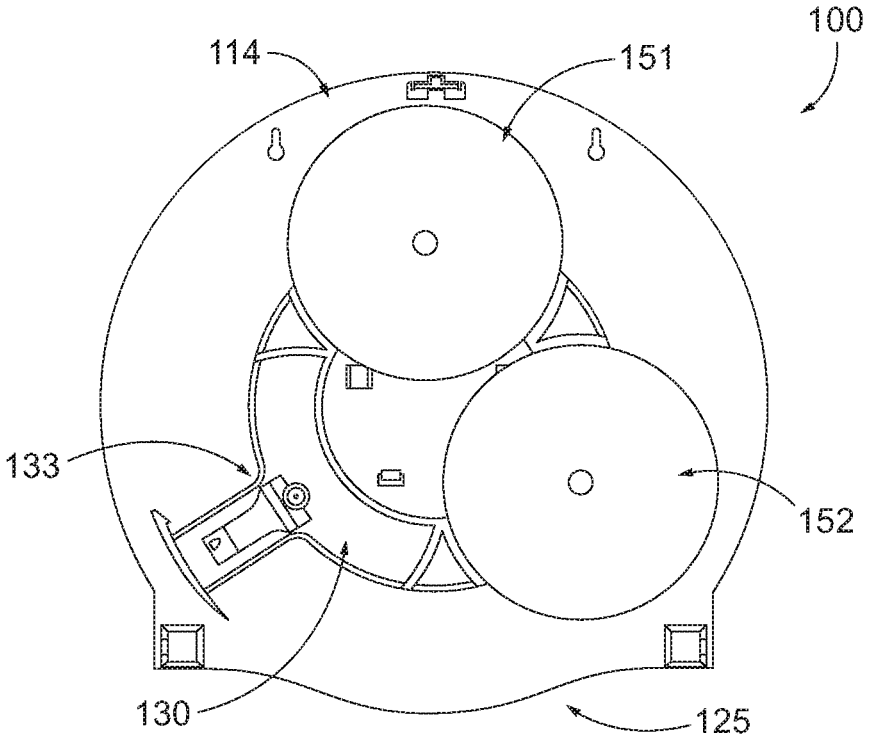

The rotary device 130 (e.g., carousel) may be configured to rotate to move the product rolls into a dispensing position for access by the user. For example, with reference to FIGS. 2A-2B, the rotary device 130 may be configured to rotate to bring a reserve product roll (e.g., product roll 152) into a dispensing position such that it is accessible by a user through the dispensing opening 125 (such as shown in FIG. 2B).

In some embodiments, the rotary device 130 may be configured to prevent rotation and movement of the product rolls until the product roll that is currently in the dispensing position is depleted below a depletion threshold. Such an embodiment ensures that the product rolls are used as much as possible prior to replacement/repositioning, thereby reducing waste. For example, in the depicted embodiment, the third product roll 153 must be depleted before the rotary device 130 rotates the second product roll 152 into a dispensing position.

Figure 3:
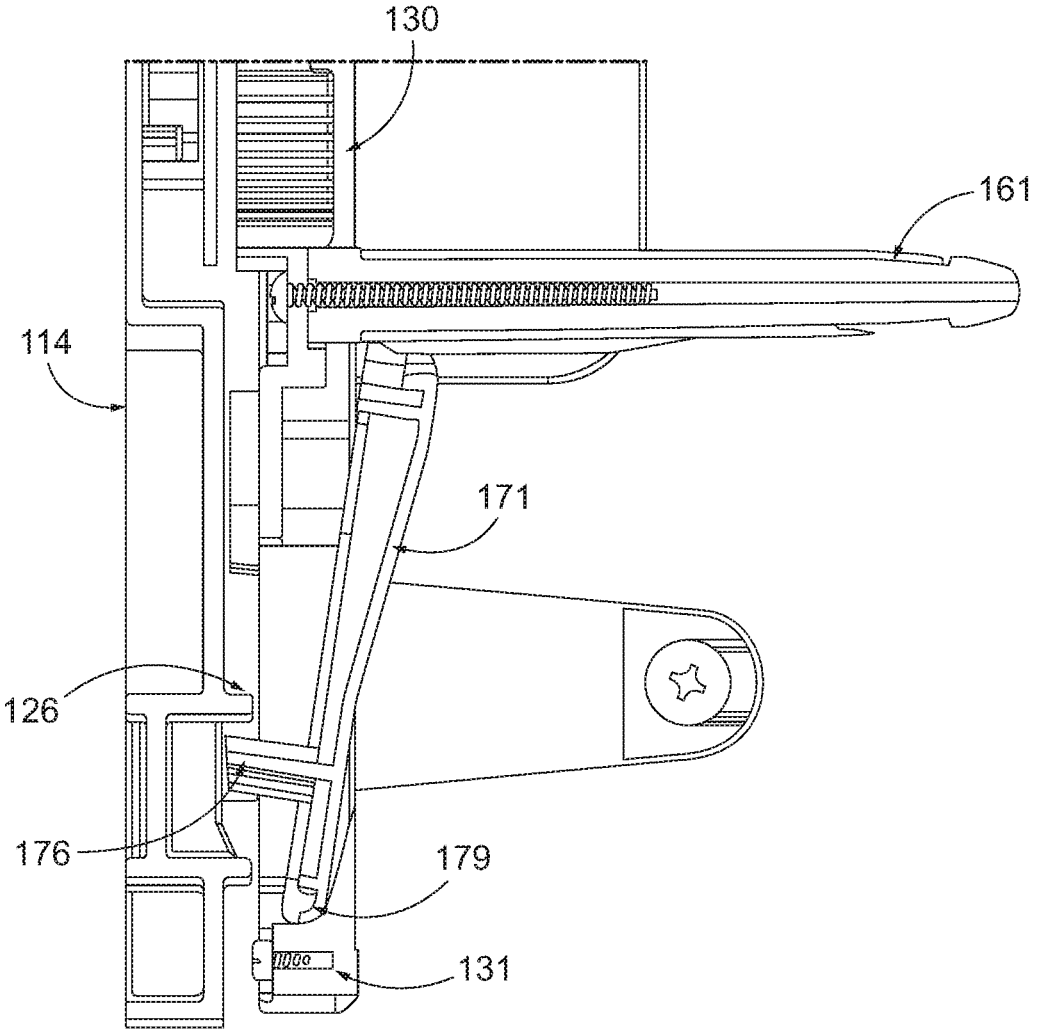
FIG. 3 shows a close-up view of a roll holder for a product roll of the example tissue dispenser of FIG. 1A, in accordance with example embodiments described herein.

In some embodiments, the rotary device 130 may be designed to rotate under the influence of gravity, such that the rotary device 130 is biased toward rotating a replacement product roll into the dispensing position. In such an example embodiment, the rotary device 130 may include one or more blocking features that are configured to prevent rotation of the rotary device 130 until a sufficient amount of sheet product is depleted from the product roll that is in the dispensing position. For example, FIG. 3 shows a close-up view of a roll holder 131 of the rotary device 130. In some embodiments, the rotary device 130 is rotatably attached to the base portion 114 of the housing of the dispenser 100. In order to prevent rotation, the rotary device 130 may have a toggle 171 with a tab 176. When a product roll is present on the spindle 161, the toggle 171 may be forced toward the base portion 114 such that the tab 176 extends toward the base portion 114 and past a base portion wall 126. In this regard, the base portion wall 126 prevents the tab 176 from moving, such as may otherwise occur during rotation of the rotary device 130. However, when the product roll is depleted, toggle 171 may be biased to pivot away from the base portion 114 (such as around the axis 179) so that the tab 176 clears the base portion wall 126 to thereby enable rotation of the rotary device 130. With rotation enabled, gravity (such as due to the offset positioning of the first and second product rolls 151, 152) may cause rotation of the rotary device 130 to bring the second product roll 152 into a dispensing position. When the second product roll 152 moves into the dispensing position, its corresponding tab may automatically move into a position that prevents further rotation of the rotary mechanism 130 (e.g., until a sufficient amount of sheet product is depleted from the second product roll 152). For example, the tab associated with the second product roll 152 may extend toward the base portion 114 and past the base portion wall 126. Further, the roll holder 131 is now in a position (e.g., a reserve position) to receive a new product roll.

In some embodiments, the sheet product dispenser may include a stored energy feature that may assist in breaking the rotary device 130 free from a resting position which once moving may allow gravity to take over to cause rotation of the rotary device 130. The energy stored may be harvested from the last rotation the system completed. An example of this may be a spring plunger that may be depressed, and then when the product roll in the dispensing position is sufficiently depleted, a release action may be performed. The release action may permit the plunger to impart a force upon the rotary device 130 to enable rotation. Such example embodiments, may provide an automatic transfer that occurs without additional steps performed by the user. The automatic transfer may further provide a hygiene benefit through limiting the need for contact by the user. Such an example sheet product dispenser provides a number of benefits including, for example, automatic transfer and high capacity, which helps remove waste from premature product roll replacement.

Restrictive Access Features and the Like for Rotary Sheet Product Dispensers

As described herein, some example embodiments of the present invention include one or more features designed to reduce unnecessary waste. For example, some embodiments are designed to prevent or deter premature removal and/or replacement of a product roll that is in dispensing position. In this regard, some example embodiments include a restrictive access feature that prevents or deters removal or replacement of the product roll in the dispensing position. Some example sheet product dispensers may provide varying levels of access, such varying levels of access may be pre-designed or selected (such as at installation of the dispenser). For example, some example sheet product dispensers permanently prevent premature removal and/or replacement of the dispensing roll, whereas some example sheet product dispensers may enable emergency access through various features. Similarly, some example sheet product dispensers provide features that merely deter or discourage such premature removal or replacement. While the following example sheet product dispensers with such features are focused on rotary-based sheet product dispensers (e.g., described with respect to FIGS. 4A-16B), other types of sheet product dispensers can utilize such or similar features. Indeed, some example restrictive access features are described with other types of sheet product dispensers (such as with respect to FIGS. 17-34B).

In some embodiments, example sheet product dispensers (e.g., sheet product dispenser 100' of FIGS. 4A-4B) may include a roll replacement features (such as a cover or a portion thereof) that is openable to enable insertion and/or replacement of one or more reserve sheet product rolls. Additionally, the sheet product dispenser may include a restrictive access feature that prevents removal of a sheet product roll in the dispensing position (e.g., if the sheet product roll is not sufficiently depleted) and/or installation of a new replacement product roll directly into the dispensing position (e.g., replacing the current dispensing roll). In some sheet product dispensers, the restrictive access feature may prevent or deter removal or replacement of the product roll in the dispensing position even while the roll replacement feature actively enables installation of a replacement product roll into a reserve position. In this regard, the maintainer may be able to insert or replace a sheet product roll in one of the reserve roll positions, but may be unable to replace the sheet product roll being dispensed from. This helps avoid a maintainer from replacing a partially depleted product roll that is being dispensed from (e.g., it is in the dispensing roll position), which may be considered unnecessary waste. Such example embodiments may work well with other features described herein, such as automatically repositioning a reserve roll into the dispensing roll position when the dispensing roll is depleted. In this regard, the maintainer may not need to interact with the product roll in the dispensing roll position and, instead, simply ensure that one or more reserve rolls are available.

Some embodiments of the present invention contemplate still providing access to the maintainer for replacing the product roll that is currently in the dispensing roll position. Indeed, there may be times when the maintainer needs to replace the product roll in the dispensing roll position. For example, liquid may inadvertently enter the product dispenser and ruin the dispensing roll. In some such embodiments, access to the dispensing roll may still be discouraged or more difficult than, for example, access to the one or more reserve rolls to discourage premature replacement of the dispensing roll. For example, in some embodiments, the restrictive access feature may form a blocking feature that covers the dispensing roll position, but may be openable, such as by activation of a release mechanism (or similar feature).

Figure 4A:
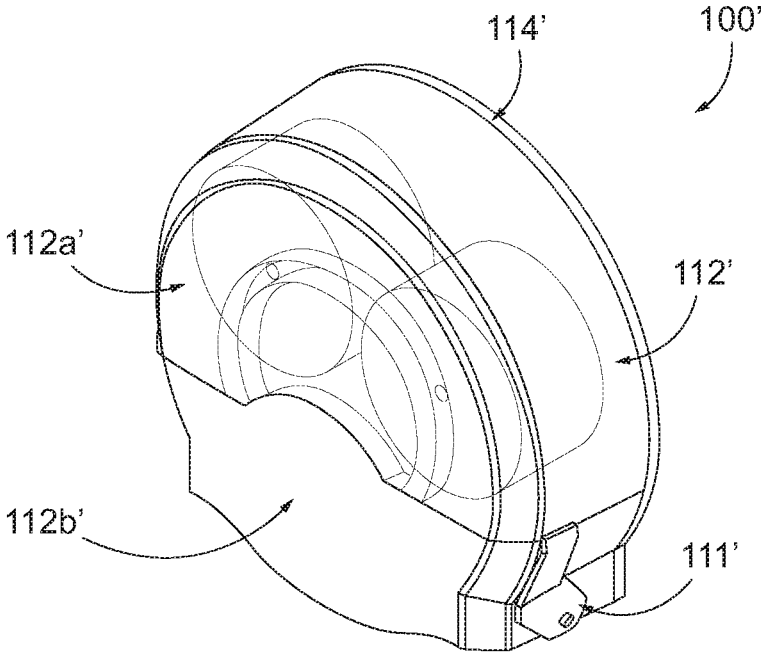
FIG. 4A shows a perspective view of another example sheet product (e.g., tissue) dispenser that holds three product rolls, wherein a portion of the cover of the dispenser is configured to open to enable insertion and/or replacement of one or more of the reserve product rolls, in accordance with example embodiments described herein.
Figure 4B:
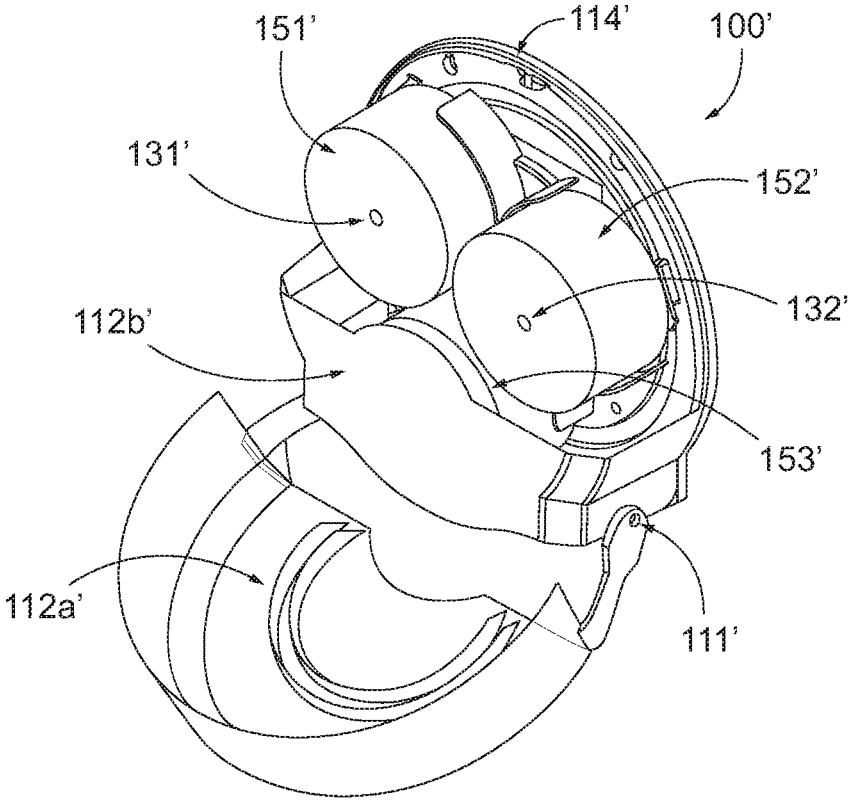
FIG. 4B shows a perspective view of the example tissue dispenser of FIG. 4A, wherein the portion of the cover is open, in accordance with example embodiments described herein.

FIGS. 4A-4B illustrate an example sheet product dispenser 100' with a restrictive access feature that is in the form of a portion of the cover. For example, the cover 112' includes a first portion 112*a*' and a second portion 112*b*'. The first portion 112*a*', when in the closed position, covers the first sheet product roll 151' on the first spindle 131' in the first reserve roll position and the second sheet product roll 152' on the second spindle 132' in the second reserve roll position. In some embodiments, the portion 112*a*' may be transparent or partially transparent, such as to enable a maintainer to visually determine the amount of product remaining in the dispenser. The portion 112*a*' of the cover 112' may be movably (e.g., rotatably) connected to the sheet product dispenser 100', such as around hinge 111'. In this regard, the portion 112*a*' may be moved to an open position (shown in FIG. 4B), thereby revealing and enabling access to the reserve product roll positions (e.g., the position of the first sheet product roll 151' and the second sheet product roll 152'). With such access, the maintainer may insert new product rolls into or replace product rolls in either of the reserve positions. Notably, however, the second portion 112*b*' still covers the product roll 153' that is in the dispensing roll position. In this regard, the maintainer is unable to replace the product roll 153', which may prevent premature replacement of a partially depleted product roll.

Figure 5A:
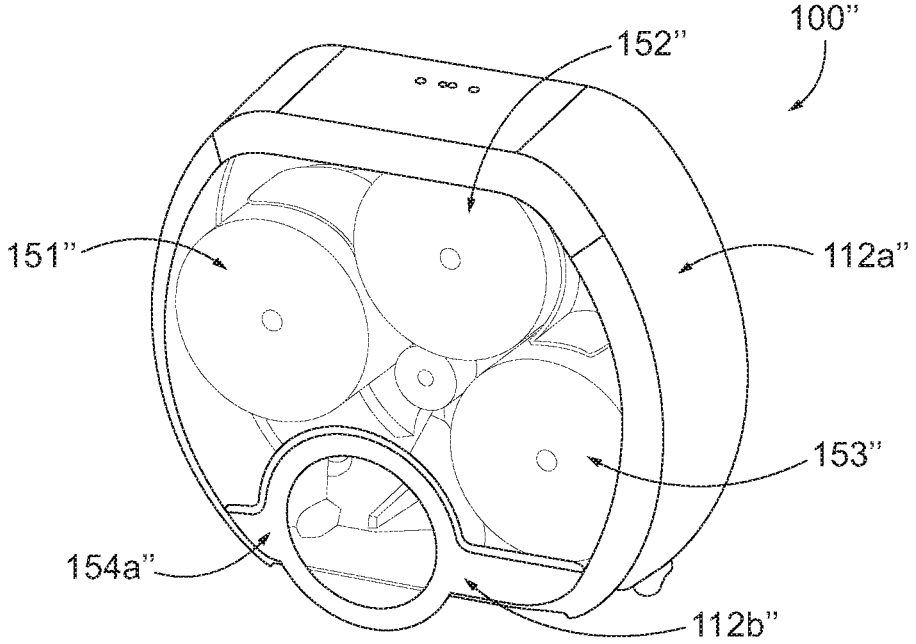
FIG. 5A shows a perspective view of another example sheet product (e.g., tissue) dispenser that holds four product rolls, wherein a first portion of the cover of the dispenser is configured to open to enable insertion and/or replacement of one or more of the reserve product rolls, in accordance with example embodiments described herein.

FIG. 5A shows another example sheet product dispenser 100" with a housing that is sized to hold four product rolls (although example embodiments of the present invention may be configured to hold any number of product rolls). The sheet product dispenser 100" includes a cover with a first portion 112*a*" and a second portion 112*b*'. The first portion 112*a*", when in the closed position (shown in FIG. 5A), covers the reserve roll positions (e.g., the positions corresponding to the first sheet product roll 151", the second sheet product roll 152", and the third sheet product roll 153").

Figure 5B:
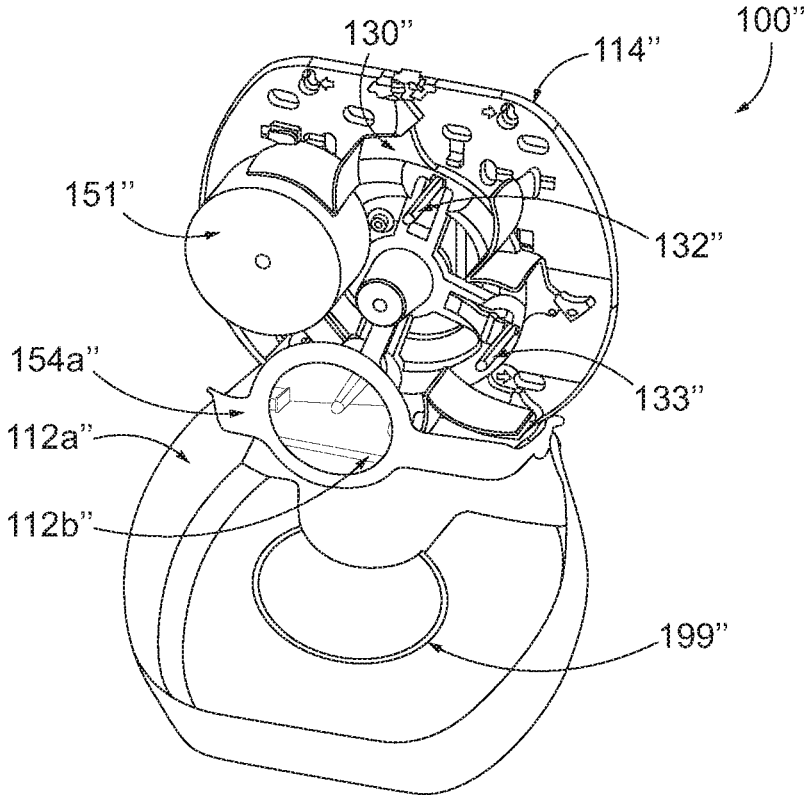
FIG. 5B shows a perspective view of the example tissue dispenser of FIG. 5A, wherein the first portion of the cover is open, in accordance with example embodiments described herein.
Figure 5C:
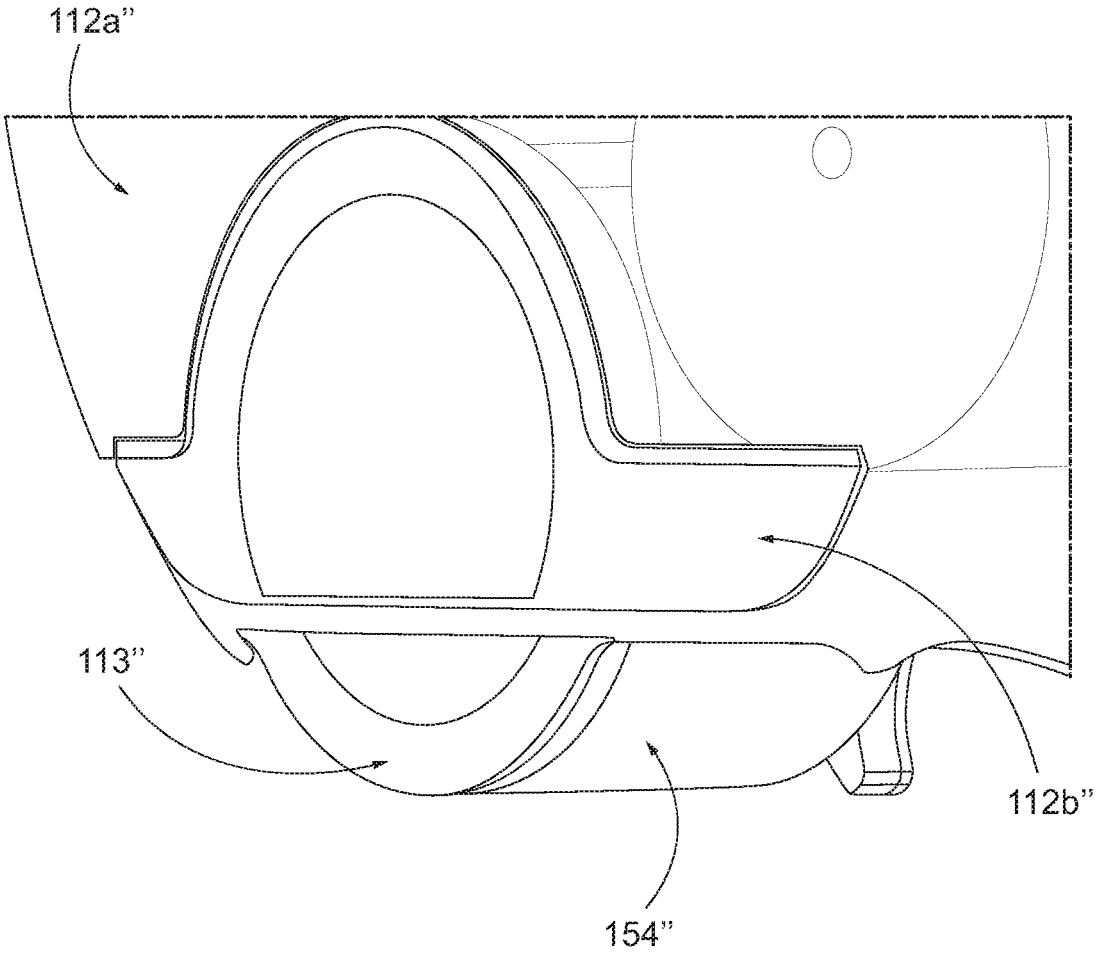
FIG. 5C shows a close up view of a lower portion of a second portion of the cover, in accordance with example embodiments described herein.

The first portion 112*a*" of the cover may be movably (e.g., rotatably) connected to the sheet product dispenser 100". In this regard, the first portion 112*a*" may be moved to an open position (shown in FIG. 5B), thereby revealing and enabling access to the reserve roll positions so as to enable a maintainer to replace or insert product rolls into each of the reserve roll positions. For example, the maintainer may place new product rolls onto spindles 132" and 133" of the rotary device 130. With reference to FIG. 5B, however, the second portion 112*b*" of the cover may still cover the dispensing roll position 154*a*". In this regard, the maintainer is unable to replace the product roll that is in the dispensing roll position, which may prevent premature replacement of a partially depleted product roll.

In some embodiments, the cover may include a static bearing surface (e.g., a rib) that is configured to abut against installed product rolls, such as to push the product rolls back against the back wall housing to maintain smooth movement of the product rolls while the cover is closed (e.g., during rotation of the rotary device). For example, with reference to FIG. 5B, the cover (e.g., the first portion 112*a*" and the second portion 112*b*' (though not shown)) may include a static bearing surface 199" that is positioned to push against installed product rolls (e.g., product roll 151") when the cover portions are in the closed position.

Figure 6A:
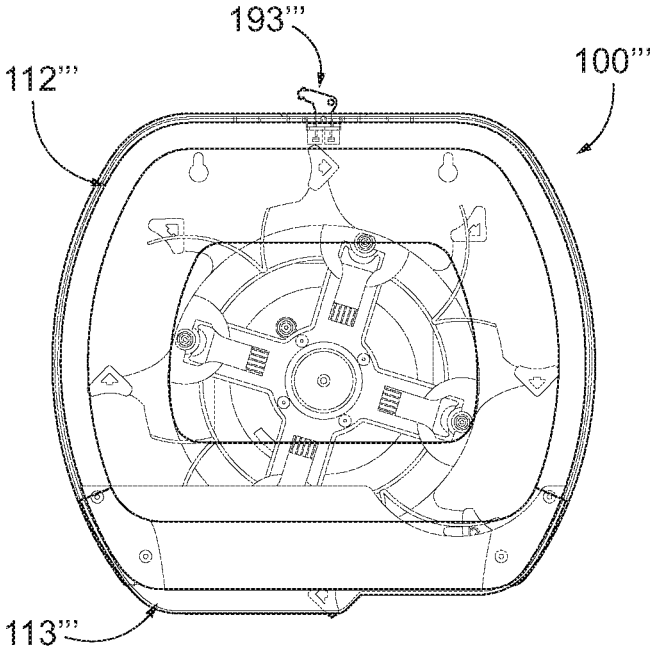
FIG. 6A shows a front view of another example sheet product dispenser, in accordance with example embodiments described herein.
Figure 6B:
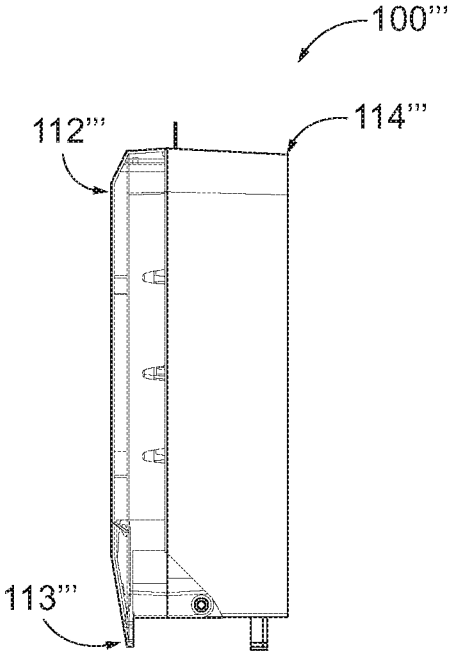
FIG. 6B shows a side view of the example sheet product dispenser of FIG. 6A, in accordance with example embodiments described herein.
Figure 6C:
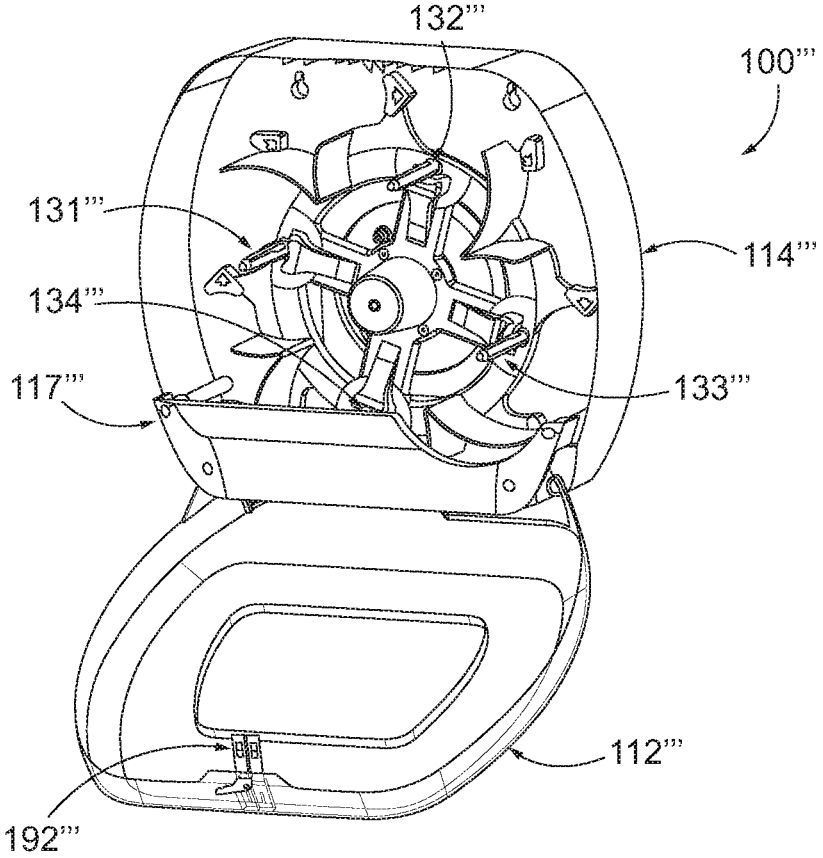
FIG. 6C shows the example sheet product dispenser of FIG. 6A with the cover in the open position, in accordance with example embodiments described herein.

FIGS. 6A-6C illustrate another example sheet product dispenser 100'" that includes a cover 112'" that is openable to a position shown in FIG. 6C. With the cover 112'" in the open position, the maintainer may install replacement product rolls into one or more reserve positions (e.g., on spindles 131'", 132'", or 133'"). Notably, however, a restrictive access feature (e.g., blocking feature 117'") prevents removal of a product roll that is currently in the dispensing position (e.g., installed on spindle 134'") as well as installation of a replacement product roll directly onto the spindle 134'" that is in the dispensing position. In the depicted embodiment, the restrictive access feature (in the form of a blocking feature 117'") is located behind the cover 112' such that it is covered when the cover 112'" is in the closed position. Additionally, of note, the example sheet product dispenser 100'" is designed for improved hygiene performance due to the lip 113'" of the cover 112'" that extends downwardly to more substantially cover the bottom portion of the dispensing product roll (not shown).

As noted above, depending on the desired configuration, the sheet product dispenser may designed with different levels of access to the dispensing roll. In some embodiments, the level of access may be selected, such as at the time of install by the installer, or may be pre-set/predetermined and not changeable thereafter. In some embodiments, the sheet product dispenser may be designed so as to permanently prevent removal of the product roll in the dispensing position and/or installation of a replacement product roll into the dispensing position. For example, the restrictive access feature may be configured with no emergency access. Alternatively, the sheet product dispenser and/or restrictive access feature may enable some level of emergency access to enable removal of the dispensing roll or installation of a replacement roll directly into the dispensing position. For example, a maintainer may utilize one or more tools to remove the restrictive access feature. Other examples include a release mechanism that may be configured to enable movement of the restrictive access feature (e.g., to a position that allows access to the dispensing position) and/or movement of one or more of the spindles (e.g., enable rotation of the rotary device to move the spindle in the dispensing position away from the restrictive access feature—thereby enabling removal and replacement of the corresponding product roll).

In some embodiments, the sheet product dispenser may be configured to prevent removal of one or more product rolls, such as a product roll in the dispensing position, until a sufficient amount of the sheet product on that product roll has been depleted. Such example embodiments attempt to reduce unnecessary waste by preventing a maintainer from prematurely replacing a partially used product roll. In some embodiments, the restrictive access feature may prevent such replacement until the amount of sheet product on the product roll has been depleted below a depletion threshold amount. For example, a trigger mechanism (such as similar to that described with respect to FIG. 3 above) may be utilized to ensure that a sufficient amount of sheet product has been depleted. Other example mechanisms may include utilization of a sheet product level sensor/indicator, among others.

FIGS. 7-9B illustrate example sheet product dispensers that are configured to enable movement of the product roll out of the dispensing position and away from the being blocked or otherwise restricted by the restrictive access feature. Though the following description provides example dispensing roll access (e.g., release or roll movement) mechanisms for moving the product roll, some embodiments of the present invention contemplate other mechanisms, such as mechanisms similar to those described with respect to FIGS. 10A-11B. Likewise, though the following description provides an example sheet product dispenser with a rotary device, some embodiments of the present invention contemplate other ways besides rotating a rotary device to move the product roll in the dispensing roll position away from being blocked by the restrictive access feature.

Figure 7:
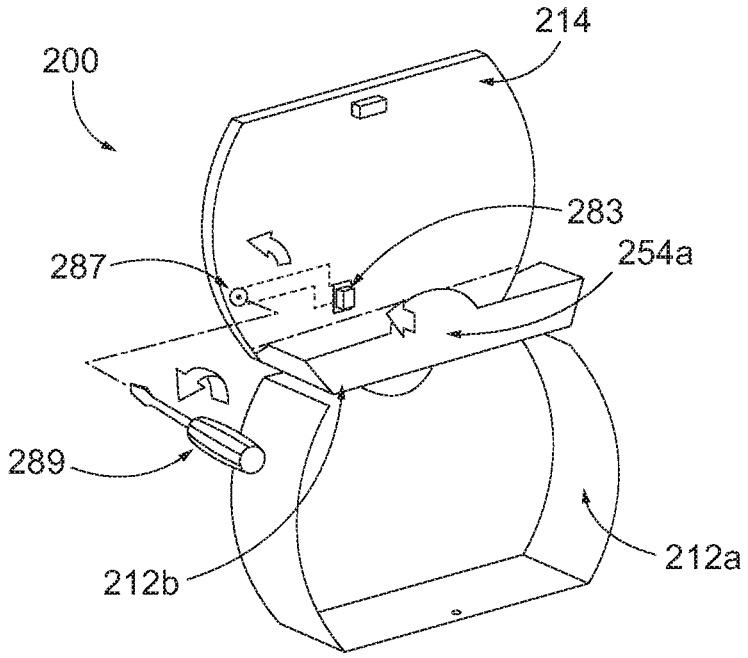
FIG. 7 illustrates an example mechanism for enabling rotation of the rotary mechanism of an example sheet product dispenser, in accordance with example embodiments described herein.
Figure 8:
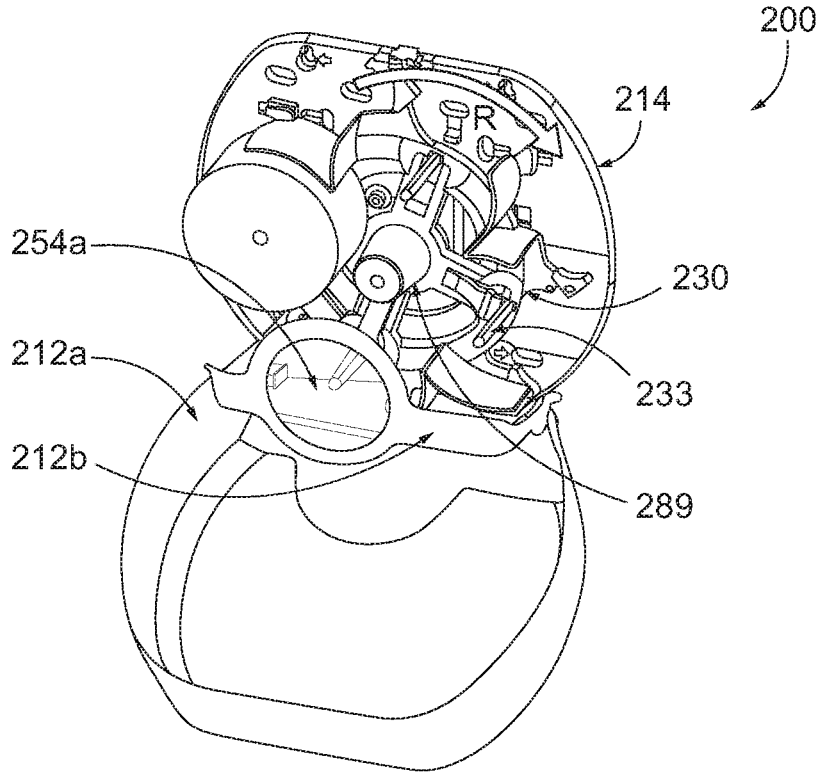
FIG. 8 shows an example sheet product dispenser where the rotary mechanism is able to be rotated, in accordance with example embodiments described herein.

With reference to FIGS. 7-8, an example sheet product dispenser 200 includes a first portion 212*a* of the cover that is shown in the open position. The second portion 212*b* of the cover is fixed to the housing and not operable to move (although some example embodiments may still be employed with a movable second portion 212*b* of the cover). Additionally, the sheet product dispenser 200 includes a rotary device 230 that controls the position of the spindles thereon through rotation, such as among the various reserve roll positions and the dispensing roll position. The example sheet product dispenser 200 includes a dispensing roll access mechanism in the form of a rotation activation mechanism. In the depicted embodiment, with the first portion 212*a* of the cover in the open position, the maintainer may use a tool 289 to operate a release mechanism 287 (e.g., part of the rotation activation mechanism). Depending on the configuration of the rotation activation mechanism, operation of the release mechanism 287 may cause a blocking tab 283 to be removed from engagement with the rotary device 230 so that the rotary device 230 is free to rotate. In such a situation, the maintainer may rotate (e.g., along arrow R) the rotary device 230 such that the product roll that is currently in the dispensing roll position has been removed from behind the second portion 212*b* of the cover—thereby being accessible for replacement by the maintainer. Once replacement is complete, the maintainer may move the new product roll back to the dispensing roll position or may position a reserve product roll in its place.

FIGS. 9A-9B illustrate another example release mechanism for enabling rotation of the rotary device to move a product roll spindle out of the dispensing position (and away from being blocked by the restrictive access feature). With reference to FIG. 9A, the rotary device (not shown) rotates on a central spindle 289'. The central spindle 289' may be designed with one or more tabs that interact with a structure 281' that prevents rotation (e.g., no rotation) or limits rotation (e.g., one-way rotation may, in some embodiments, be allowed). In such a situation, the maintainer may be unable to rotate the central spindle 289' to move the spindle that is in the dispensing position. However, with the cover (not shown) in the open position, the maintainer may operate a release mechanism to enable such rotation of the central spindle 289' (and, thus, the rotary device). For example, a maintainer may slide a finger tab 285' to the right to cause a spring 287' to pull away from central spindle 289'. As the spring 287' moves away, a tapered surface 284' of the spring interacts with an end of a linkage 282', to cause the linkage 282' and, thus, the structure 281' to rotate out of interaction with the central spindle 289'—thereby enabling rotation thereof. The above described release mechanism is just one example mechanism, as many different release (or roll movement) mechanisms are contemplated.

As noted above, in some embodiments, the restrictive access feature may be movable (such as to an open position) to enable removal of the product roll in the dispensing position and/or installation of a replacement roll directly into the dispensing position. For example, FIGS. 10A-11D illustrate some example mechanisms that facilitate opening of the restrictive access feature.

In some embodiments, with reference to FIG. 10A, the maintainer may be required to first open the cover (or a first portion 412*a* thereof) of a sheet product dispenser 400. For example, a maintainer may use a key 494 to unlock a lock 492 to cause the first portion 412*a* of the cover to open.

In some embodiments, once the first portion 412*a* of the cover is open, the maintainer may access a dispensing roll access mechanism (e.g., a release mechanism) to enable opening of the restrictive access feature (e.g., a second portion 412*b* of the cover)—to thereby access the product roll that is in the dispensing roll position. Notably, however, in some embodiments, the first portion 412*a* of the cover need not necessarily be open to enable a maintainer to access or operate a dispensing roll access mechanism—such as to open the second portion 412*b* of the cover. FIGS. 10B-10F illustrate some example dispensing roll access mechanisms contemplated by various embodiments of the present invention.

Figure 10B:
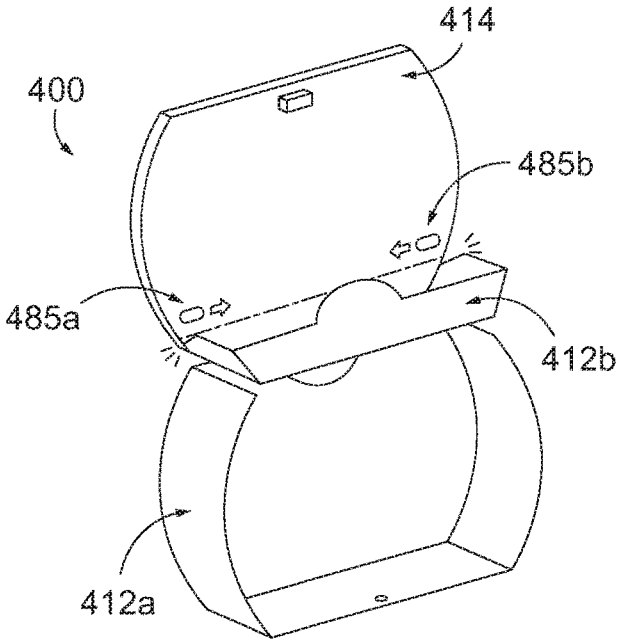

FIG. 10B illustrates a sheet product dispenser 400 with a dispensing roll access mechanism that includes two finger latches 485*a*, 485*b* (although any number of finger latches or other type latches could be used). The finger latches 485*a*, 485*b* may be positioned on the back wall housing 414 and operable by a user to enable opening of the restrictive access feature (e.g., the second portion 412*b* of the cover). In some embodiments, one or more of the finger latches 485*a*, 485*b* may be positioned behind installed product rolls in the reserve roll positions, thereby forcing a maintainer to (at least temporarily) remove those product rolls to access the finger latches 485*a*, 485*b*. An example mechanism with two finger latches is described in greater detail herein with respect to FIGS. 11A-11D.

Figure 10C:
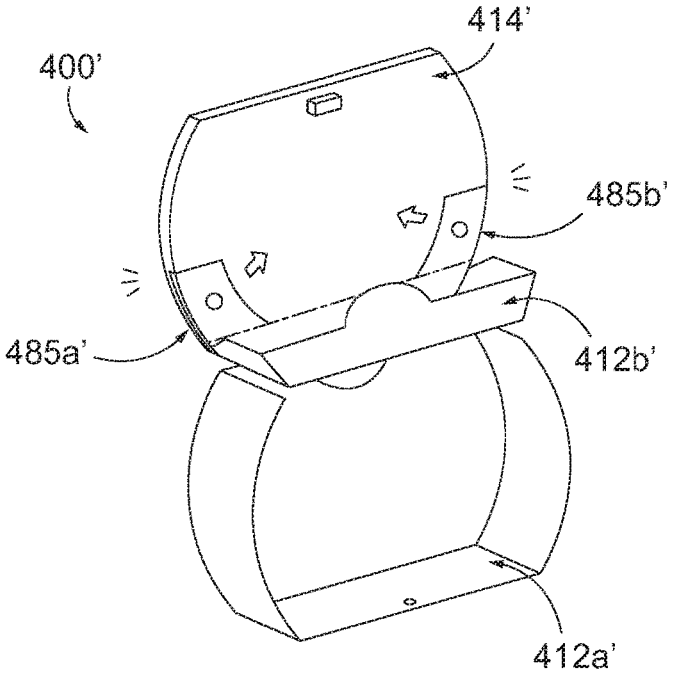

FIG. 10C illustrates a sheet product dispenser 400' with a dispensing roll access mechanism that includes two finger buttons 485*a*', 485*b*' (although any number of finger buttons or other type buttons could be used). The finger buttons 485*a*', 485*b*' may be positioned on the back wall housing 414' and operable by a user to enable opening of the restrictive access feature (e.g., the second portion 412*b*' of the cover). In some embodiments, one or more of the finger buttons 485*a*', 485*b*' may be positioned behind installed product rolls in the reserve roll positions, thereby forcing a maintainer to (at least temporarily) remove those product rolls to access the finger buttons 485*a*', 485*b*'.

Figure 10D:
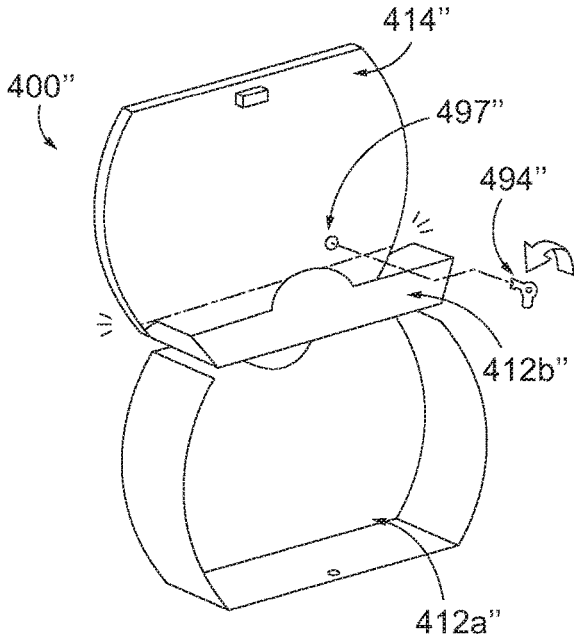

FIG. 10D illustrates a sheet product dispenser 400" with a dispensing roll access mechanism that includes a release mechanism 497" that is operable by a key 494", such as the same key the maintainer uses to open the first portion 412*a*" of the cover. In some embodiments, the release mechanism 497" may be positioned in the back wall housing 414" and behind the first portion 412*a*" of the cover—thereby requiring a maintainer to have to first open the first portion 412*a*" of the cover before access to the release mechanism 497" is available. Additionally, in some embodiments, the release mechanism 497" may be positioned behind installed product rolls in the reserve roll positions, thereby forcing a maintainer to (at least temporarily) remove those product rolls to access the release mechanism 497".

Figure 10E:
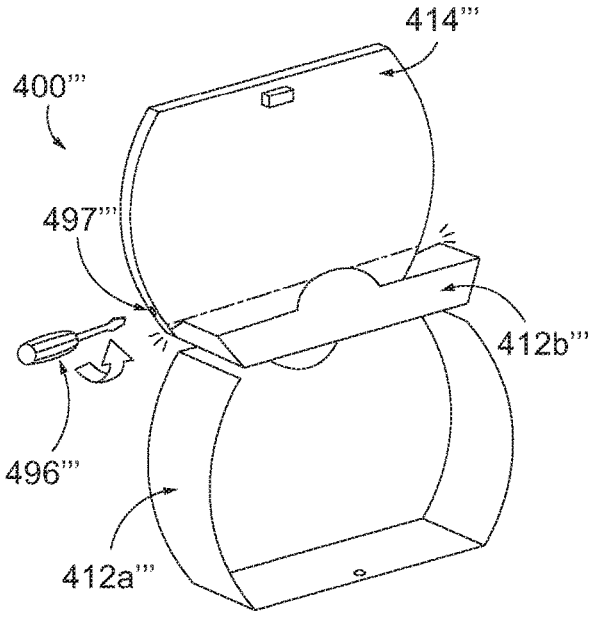

FIG. 10E illustrates a sheet product dispenser 400''' with a dispensing roll access mechanism that includes a release mechanism 497''' that is operable by a tool 496''' to open the restrictive access feature (e.g., the second portion 412*b*''' of the cover). In some embodiments, the release mechanism 497''' may be positioned in the back wall housing 414''', but still accessible even when the first portion 412*a*''' of the cover is closed.

Figure 10F:
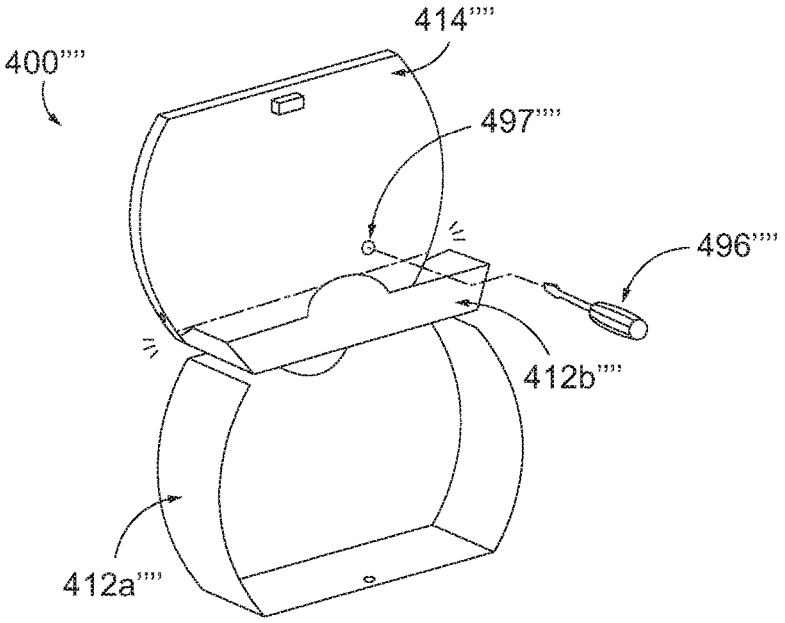

FIG. 10F illustrates a sheet product dispenser 400"" with a dispensing roll access mechanism that includes a release mechanism 497"" that is operable by a tool 496"" to open the second portion 412*b*"" of the cover. In some embodiments, the release mechanism 497"" may be positioned in the back wall housing 414"" and behind the first portion 412*a*"" of the cover—thereby requiring a maintainer to have to first open the first portion 412*a*"" of the cover before access to the release mechanism 497"" is available. Additionally, in some embodiments, the release mechanism 497"" may be positioned behind installed product rolls in the reserve roll positions, thereby forcing a maintainer to (at least temporarily) remove those product rolls to access the release mechanism 497"".

FIGS. 11A-11D illustrate an example dispensing roll access mechanism with structure similar to that shown in FIG. 10B. With the first portion 412*a* of the cover in the open position, the maintainer has access to two finger latches 485*a*, 485*b* that are operably connected to the back housing 414 and accessible with respect to the rotary device 430. In order to operate the dispensing roll access mechanism, the maintainer first slides the first finger latch 485*a* to the left against a bias of the finger latch 485*a*. With reference to FIG. 11B, this action causes a first bar 461*a* to disengage from blocking a collar 462 of a second bar 461*b*. With the second bar 461*b* unblocked, the maintainer is then able to slide the second finger latch 485*b* upwardly against a bias of the finger latch 485*b*. That causes the second bar 461*b* and a connected trigger block 465 to move upwardly. As the trigger block 465 moves upwardly, it causes the pivot features 463*a*, 463*b* to each rotate about a respective pivot point. Notably, each pivot feature 463*a*, 463*b* is connected to a respective linkage 466*a*, 466*b* such that pivoting of the pivot feature 463*a*, 463*b* causes the linkages 466*a*, 466*b* to move toward each other and away from the sides of the product dispenser 400 (as the linkages 466*a*, 466*b* are biased away from each other).

With reference to FIG. 11C, with the linkages 466*a*, 466*b* retracted away from the sides, the restrictive access feature (e.g., the second portion 412*b* of the cover) is able to rotate downwardly (shown in FIG. 11D)—such as around axis 469. In some embodiments, the second portion 412*b* of the cover may be biased (such as due to gravity) to rotate to the open position. With the second portion 412*b* of the cover in the open position, a blocking wall portion 468 will prevent the linkages 466*a*, 466*b* from returning to their original position. Notably, with the second portion 412*b* of the cover in the open position, a maintainer is able to remove and replace the product roll 454 that is in the dispensing roll position. Upon closure of the second portion 412*b* of the cover, the linkages 466*a*, 466*b* may return to their original positions (such as due to their biases), thereby keeping the second portion 412*b* of the cover in the closed position. Likewise, the finger latches 485*a*, 485*b* may be configured to return to their original positions.

In some embodiments, other forms of limited or varying degrees of access to the dispensing position are contemplated. For example, some embodiments of the present invention contemplate a flexible restrictive access feature that can be manipulated to enable removal and replacement of the product roll in the dispensing position. In some such embodiments, the restrictive access feature (e.g., a blocking feature) may be formed of sufficiently flexible/bendable material to enable physical manipulation to move the restrictive access feature (or a portion thereof) away from blocking access to the dispensing position and any currently installed product roll. FIGS. 12A-B illustrate one such example embodiment. In the depicted embodiment, a sheet product dispenser 900 includes a back wall housing 914 and a cover 912. A rotary device 950 holds a first product roll 951 in a dispensing position and three other product rolls 952, 953, and 954 in respective reserve positions. A restrictive access feature (e.g., a blocking feature 917) prevents installation of a replacement product roll directly into the dispensing position (e.g., prevents replacement of the product roll 951, which is in the dispensing position) even when the cover 912 is in the open position. However, a maintainer may be able to flex or bend the restrictive access feature 917 such as along arrow F to enable removal of the product roll 951 in the dispensing position and replacement thereof.

In some embodiments, the degree of accessibility of manipulating or bypassing the restrictive access feature may be set, such as by an installer of the sheet product dispenser. For example, during installation an installer can set whether to enable a maintainer to have emergency access to the dispensing position. FIGS. 13A-B illustrate one such example embodiment. In the depicted embodiment, a sheet product dispenser 1000 includes a back wall housing 1014 and a cover 1012. A rotary device (not shown) is configured to rotate (such as around central spindle 1050) to move one of multiple reserve product rolls into a dispensing position when the product roll in the dispensing position is sufficiently depleted. During installation, an installer can operate a sliding mechanism 1091 to set whether to enable emergency access (or not). In the depicted embodiment, the sliding mechanism 1091 slides within a slot 1092 (e.g., along arrow SS) between a locked position and an unlocked position (shown as icons on the rear side of the back housing 1014). Notably, the ability to move the sliding mechanism 1091 is limited to being accessible only on the rear side of the back housing 1014 such that it is inaccessible once the back housing 1014 is mounted on the wall. This prevents the maintainer from being able to change the level of accessibility—once set by the installer. In the locked position, the sliding mechanism 1091 may be configured in any number of ways to limit manipulation or bypass of the restrictive access feature (e.g., the blocking feature 1017). For example, the sliding mechanism 1091 may prevent or limit rotation of the rotary device—thereby preventing a maintainer from rotating the rotary device to access the product roll in the dispensing position. As another example, the sliding mechanism 1091 may interact with a linkage (not shown) to prevent manipulation or bypass of the restrictive access feature.

Another example embodiment of a restrictive access feature is illustrated in FIGS. 14A-B. FIG. 14A shows a sheet product dispenser 1100 that includes a housing 1114 with a dispensing opening 1125. The housing 1114 is sized to hold three product rolls. A first product roll 1151 is held in a dispensing position (e.g., a tail 1126 of the product roll hangs out of the dispensing opening 1125). Second and third product rolls 1152, 1153 are held in the reserve positions. A cover 1112 (e.g., a roll replacement feature) can be opened to enable installation of a replacement roll into a reserve position. In the depicted embodiment, only the second reserve position is accessible. Such an embodiment is beneficial in a situation where a rotary device (or other mechanism) automatically causes movement of the reserve rolls such that a reserve roll repositions to the dispensing position upon depletion of the product roll in the dispensing position. Further, additional waste possibilities can be limited when the restrictive access feature (e.g., the housing 1114 or a portion thereof) prevents installation of a replacement roll directly into the dispensing position and one or more reserve positions. Thus, the maintainer only has access to some of the reserve positions (e.g., the last reserve position).

Some embodiments of the present invention also contemplate use of a cartridge of product rolls with a sheet product dispenser. In such example embodiments, the cartridge may hold one or more product rolls and be configured for installation (or insertion) into a sheet product dispenser to enable dispensing of the corresponding sheet product. By using a cartridge, a maintainer may only need to (or be able to) replace the entire cartridge (as opposed to individual product rolls). In such an embodiment, the interaction of the cartridge and the sheet product dispenser may limit removal or replacement of the cartridge until a sufficient amount of sheet product is dispensed from the cartridge (e.g., below a cartridge threshold amount). For example, FIG. 15 shows a sheet product dispenser 1200 with a back housing 1214 and a central spindle 1260. A cartridge 1215 may be installed into the sheet product dispenser 1200, such as onto the central spindle 1260. The cartridge holds four product rolls 1251, 1252, 1253, 1254, and the first product roll 1251 is positioned into the dispensing position when the cartridge 1215 is installed into the sheet product dispenser 1200 (e.g., the sheet product from the first product roll 1251 may be accessible through the dispensing opening 1225). Upon sufficient depletion of the sheet product from the first product roll 1251, the cartridge 1215 and the sheet product dispenser 1200 may be configured to automatically move the second product roll 1252 into the dispensing position. However, even with an empty spindle now in a reserve position (because the first product roll 1251 is depleted), a maintainer may not be able to install a replacement roll thereon because the cartridge 1215 does not enable installation of replacement rolls (e.g., the structure of the cartridge 1215 covers the product roll spindles). Further, the cartridge 1215 and the sheet product dispenser 1200 may be configured with a restrictive access feature that prevents removal of the entire cartridge 1215 until a sufficient amount of sheet product has been dispensed from the cartridge (e.g., all the product rolls on the cartridge are sufficiently depleted). In such an example, a maintainer would be prevented from changing the cartridge prematurely.

Some embodiments of the present invention contemplate using visual deterrents for trying to prevent premature replacement of product rolls. For example, FIGS. 16A-B illustrate an example sheet product dispenser 1300 that does not have a restrictive access feature that actively prevents removal or replacement of the product roll in the dispensing position. Instead, the sheet product dispenser 1300 includes a cover 1312 with a transparent (or partially transparent) portion 1312*b* (e.g., a window) that shows the product rolls 1353, 1354 in the second and third reserve positions and an opaque portion 1312*a* that blocks view of the product roll 1351 in the dispensing position and the product roll 1352 in the first reserve position—thereby preventing a user or maintainer from easily seeing the amount of sheet product remaining on those product rolls (e.g., without opening the cover 1312, such as shown in FIG. 16B). Further, it keeps the product rolls 1351, 1352 out of sight and acts as a reminder that the maintainer only needs to install replacement rolls when they can see an empty spindle in the second and/or third reserve position. Though the above example includes a window sized to show the second and third reserve positions, other sized and shaped windows are contemplated, such as showing only the last (e.g., third)

reserve position or showing all the reserve positions and not the dispensing position. Further, in some embodiments, the window concept described above may be used in conjunction with one or more restrictive access features (or other features described herein), such as to provide a further reminder to the maintainer.

Example Two Roll Vertical Sheet Product Dispenser

FIGS. 17-20B illustrate example sheet product (e.g., tissue) dispensers 500, 500' that include two high capacity tissue product rolls positioned in generally vertical arrangement. Such an example tissue dispenser may include one or more features that provide benefits or improvements to prior dispensers. While such features may be described with respect to the below example tissue dispenser(s), some embodiments of the present invention contemplate use of such features with other sheet product dispensers, such as some of the example sheet product dispensers described herein.

FIG. 17 shows an example tissue dispenser 500 that includes two product rolls 551, 552 that are positioned in a generally vertical manner. The first sheet product roll 551 is received by a first roll holder/spindle 531. The second sheet product roll 552 is received by a second roll holder/spindle 532. The tissue dispenser 500 includes a housing with a cover 512 and a base portion 514. The cover 512 may be opened to enable access to allow a user to install a new product roll, such as on an empty roll holder/spindle. The housing may also define a dispensing opening 525 that enables a user to access and tear off (e.g., using perforations) a portion of the tissue product (e.g., a tail of the tissue product may hang down through the dispensing opening 525).

In some embodiments, the sheet product dispenser 500 may include a housing (e.g., cover 512 and base portion 514) that is sized to receive a maximum amount of product with maintaining a minimum necessary footprint. In some embodiments, each product roll includes a large capacity of tissue product (e.g., 1275 feet of tissue product), such that the entire capacity of the tissue dispenser 500 is high (e.g., approximate 2,550 feet).

In some embodiments, the cover 512 (or portions thereof) may be transparent, partially transparent, or translucent such that a user can visually determine an amount of product remaining within the dispenser.

In some embodiments, the sheet product dispenser 500 may include one or more tracks that each correspond to one or more spindles for each product roll. In some embodiments, the spindle(s) may be configured to move (e.g., slide) within the tracks to cause movement of one or more of the sheet product rolls within the dispenser 500. As shown in FIG. 18B, the first spindle 531 may be movably (e.g., slidably) installed within a first track 541 that extends from a bottom end (near the bottom of the dispenser) to a top end (near the top of the dispenser). Likewise, the second spindle 532 may be movably (e.g., slidably) installed within a second track 542 that extends from a bottom end (near the bottom of the dispenser) to a top end (near the top of the dispenser).

In some embodiments, the first and second tracks may be parallel to each other and defined in the base portion 514, such as shown in FIG. 18B. In some embodiments, the first and second tracks 541, 542 may be spaced apart from each other in a vertical plane (e.g., a vertical plane corresponding to the base portion 514 of the housing). By being spaced apart, the first and second spindles can move up and down without being in each other's way—thereby permitting the cycling technique described herein that is used to enable efficient replacement of sheet product rolls.

In some embodiments, the spindles of the sheet product dispenser may be configured to fold between an unfolded orientation and a folded orientation, such as between a horizontal, unfolded orientation (such as shown in FIG. 18B) and a vertical, folded orientation (not shown). For example, in some embodiments, the spindle may be designed to fold to enable the folded spindle to pass behind an installed sheet product roll, such as if the spindle is being moved past the sheet product roll to another position within its corresponding track. For example, the second spindle 532 may fold when moving from a bottom end of the second track 542 to a top end of the second track 542 in order to pass behind the first sheet product roll 551 that is installed on the first spindle 531 as the first sheet product roll 551 and first spindle 531 move to the dispensing position. In some embodiments, the spindle may be biased to the folded orientation such that the spindle moves to the folded orientation upon depletion of an installed sheet product roll.

In some embodiments, the spindle may be configured to return to an unfolded orientation upon reaching a top end of its corresponding track so as to be available for installation of another sheet product roll. For example, an unfolding mechanism may be triggered once the spindle reaches a position proximate a top end of its track to cause the spindle to transition to the unfolded orientation. Alternatively, in some embodiments, a user may manually manipulate the spindle to transition it to the unfolded orientation for installation of a new sheet product roll.

In some embodiments, movement and/or positioning of the first spindle 531 and the second spindle 532 within their corresponding tracks may be controlled. Additionally, in some embodiments, movement of the first spindle 531 within the first track 541 may be correlated with movement of the second spindle 532 within the second track 542. For example, the first spindle 531 may be connected (e.g., through a transfer mechanism, such as a pulley system) to the second spindle 532. Such a transfer mechanism may be present on the back of the base portion 514.

In some embodiments, such as with or without a transfer mechanism, the spindles may be configured to move within their track under the influence of gravity. For example, with reference to FIG. 18B, upon depletion of the second sheet product roll, the weight of the first sheet product roll 551 on the first spindle 531 may cause the first spindle 531 to move downwardly in the first track 541. In some embodiments, downward movement of the first spindle 531 may cause upward (e.g., opposite) movement of the second spindle 532 in the second track 542. In such an embodiment, the transfer mechanism may connect the first spindle 531 to the second spindle 532.

In some embodiments, the sheet product dispenser 500 may be configured to automatically transfer a replacement product roll into a dispensing position upon sufficient depletion of the currently dispensed sheet product roll. For example, FIGS. 18A-18C illustrate an example repositioning of a replacement product roll in the sheet product dispenser 500 upon depletion of the dispensing product roll.

With reference to FIG. 18A, the second sheet product roll 552 is currently in a dispensing position, such as near the dispensing opening 525 (shown in FIG. 17). As such, in the depicted embodiment, the second spindle 532 is positioned near a bottom end of the second track 542 such that the second sheet product roll 552 is in the dispensing position.

Further, the first spindle 531 is positioned near a top end of the first track 541 such that the first sheet product roll 551 is in a reserve position.

Upon sufficient depletion of the second sheet product roll 552, the sheet product dispenser 500 may be configured to automatically transfer the first sheet product roll 551 to the dispensing position and, in some cases, the second spindle 532 to a position near the top of the sheet product dispenser for later loading of a new sheet product roll. As noted above, such movement could be gravity assisted and/or controlled through a transfer mechanism. Such an arrangement may ensure that the currently dispensed sheet product roll is always sufficiently depleted first before the replacement product roll is utilized for dispensing.

For example, with reference to FIG. 18B, the first sheet product roll 551 is configured to move downwardly by movement of the first spindle 531 within the first track 541 toward the bottom end of the first track 541. As the first spindle 531 moves downwardly, the second spindle 532 (which is now empty due to depletion of the second sheet product roll) moves upwardly in the second track 542 toward the top end of the second track 542. Further, as detailed herein, the second spindle 532 may transition to a folded orientation (e.g., with a folding mechanism 562) such that it can pass behind the first sheet product roll 551 as it moves upwardly in the second track 542.

Then, with reference to FIG. 18C, the first spindle 532 may move to the bottom end of the first track 541 such that the first sheet product roll 551 is in the dispensing position. At the same time, the second spindle 532 may move to the top end of the second track 542 and return to an unfolded orientation such that it is ready to receive a new sheet product roll.

With reference to FIGS. 19A-19B, the sheet product dispenser 500 may be user configurable such that the cover 512 may be hinged on either a right side (see hinge 511 in FIG. 19A) or a left side (see hinge 5311' in FIG. 19B). Such versatility may be useful for example tissue product dispensers, which may be placed in a tight space on either the left side or the right side of a toilet in a stall. In this regard, it may be desirable to ensure that the cover can open in a specific direction.

FIGS. 20A-20B illustrate another example sheet product dispenser 500" that includes two high capacity tissue product rolls positioned in a vertical arrangement (similar to sheet product dispenser 500). In some embodiments, the sheet product dispenser (e.g., sheet product dispenser 500") may include one or more portions (e.g., a first portion 512*a*") of the cover (e.g., a roll replacement feature and a restrictive access feature) that are openable to enable insertion and/or replacement of the reserve sheet product roll without enabling replacement of the sheet product roll in the dispensing position. In this regard, the maintainer may be able to insert or replace a sheet product roll in the reserve position, but may be unable to replace the sheet product roll being dispensed from. This helps avoid a maintainer from replacing a partially depleted product roll that is being dispensed from (e.g., it is in the dispensing position), which may be considered unnecessary waste. Such example embodiments may work well with other features described herein, such as automatically repositioning a reserve roll into the dispensing position when the dispensing roll is depleted. In this regard, the maintainer may not need to interact with the product roll in the dispensing position and, instead, simply ensure that the reserve roll is available.

In some embodiments, the restrictive access feature (e.g., the second portion of the cover still covering the dispensing roll) may be openable or otherwise enable access to the dispensing roll, such as separately from the first portion described above. In some of those embodiments, access to the dispensing roll may still be discouraged or more difficult than, for example, access to the reserve roll to discourage premature replacement of the dispensing roll.

FIG. 20A shows an example sheet product dispenser 500" with a cover 512" that includes a first portion 512*a*" and a second portion 512*b*". The first portion 512*a*", when in the closed position, covers the first sheet product roll 551" on the first spindle 531" when in the reserve roll position (although the first portion 512*a*" may cover the second spindle (not shown) when the second spindle is in the reserve roll position—such as described above). In some embodiments, the portion 512*a*" may be transparent or partially transparent, such as to enable a maintainer to visually determine the amount of product remaining in the dispenser. The portion 512*a*" of the cover 512" may be movably (e.g., rotatably) connected to the sheet product dispenser 500", such as around hinges 511". In this regard, the portion 512*a*" may be moved to an open position (shown in FIG. 20B), thereby revealing and enabling access to the reserve product roll position (e.g., the position of the first sheet product roll 551" shown in FIG. 20B). With such access, the maintainer may insert a new product roll into or replace a product roll in the reserve position. Notably, however, the second portion 512*b*" still covers the product roll 552" that is in the dispensing position. In this regard, the maintainer is unable to replace the product roll 552", which may prevent premature replacement of a partially depleted product roll.

Example Two Roll Vertical Sheet Product Dispenser with Open Concept

FIGS. 21-23B illustrate another example sheet product (e.g., tissue) dispenser 600 that includes two high capacity tissue product rolls positioned in generally vertical arrangement. Such an example tissue dispenser may include one or more features that provide benefits or improvements to prior dispensers. While such features may be described with respect to the below example tissue dispenser(s), some embodiments of the present invention contemplate use of such features with other sheet product dispensers, such as some of the example sheet product dispensers described herein.

FIG. 21 shows an example tissue dispenser 600 that includes two product rolls 651, 652 that are positioned in a generally vertical manner. The first sheet product roll 651 is received by a first roll holder/spindle 656. The second sheet product roll 652 is received by a second roll holder/spindle 657. The tissue dispenser 600 includes a housing with a cover 612 and a base portion 614. The cover 612 may be opened to enable access to allow a user to install a new product roll, such as on an empty roll holder/spindle. In some embodiments, the sheet product dispenser 600 may include a housing (e.g., cover 612 and base portion 614) that is sized to receive a maximum amount of product with maintaining a minimum necessary footprint.

In some embodiments, the cover 612 (or portions thereof) may be transparent, partially transparent, or translucent such that a user can visually determine an amount of product remaining within the dispenser.

In some embodiments, the housing may be shaped and/or designed to provide an open type concept. For example, the housing (e.g., the cover 612) may define one or more openings (e.g., dispensing openings 665*a*, 665*b*—shown in FIG. 22A). Each dispensing opening 665*a*, 665*b* may enable a user to access and tear off (e.g., using perforations) a portion of the tissue product (e.g., a tail of the tissue product may hang down through one of the dispensing openings 665*a*, 665*b*). Notably, however, the open concept dispensing openings 665*a*, 665*b* of some embodiments (such as the depicted embodiment), may be sized to provide visual access to a substantial portion of the circumferential surface of the product roll. For example, each dispensing opening 665*a*, 665*b* may enable access to a certain percentage of the circumferential surface of the product roll, such as 25%, 40%, etc. In some embodiments, all the dispensing openings may combine to provide access to greater than 50% (or more) of the product roll.

In some embodiments, the cover 612 may define one or more dispensing openings 665*a*, 665*b* with arcuate shapes so that the amount of visual access for the user is maintained as the product roll decreases. In some embodiments, the cover 612 may still provide hygienic protection and/or security (to prevent undesirable removal of the product roll) in strategic locations. For example, the bottom and/or center of the product roll may be covered.

Having such access will enable a user to easily locate a tail of the product roll—which may often be "lost" at some unknown position on the circumferential surface of the product roll. In this regard, the user may be able to more easily visually identify the tail, which may prevent the user from using their hand to rotate the product roll to find the tail. Such a situation is preferred so as to avoid unnecessary contact with the product roll for hygiene purposes.

In some embodiments, the sheet product dispenser may also provide one or more openings to the replacement product rolls (e.g., the top product roll 651 shown in FIG. 21). In such embodiments, the user may have increased confidence of the amount of product in the dispenser. Additionally, the user may have the option to receive product from either product roll, providing versatility.

In some embodiments, the sheet product dispenser 600 may include a track 641 that enables transfer of the product rolls within the sheet product dispenser 600. In some embodiments, the spindle(s)/roll holder(s) may be configured to move (e.g., slide) within the track 641 to cause movement of one or more of the sheet product rolls within the dispenser 600. For example, the first roll holder 656 and the second roll holder 657 may each be positioned in a spaced apart manner on a shuttle 658 that may travel within the track 641. In this regard, the roll holders may be spaced a distance apart that enables two full product rolls to be loaded at the same time.

In some embodiments, the sheet product dispenser 600 may be configured to automatically transfer a replacement product roll into a dispensing position upon sufficient depletion of the currently dispensed sheet product roll. Such example embodiments, ensure that a sufficient amount of each product roll is utilized to prevent and/or discourage unnecessary waste.

In this some embodiments, the transfer may occur automatically under the influence of gravity. For example, as shown in FIGS. 23A-23B, the shuttle 658 may be movably (e.g., slidably) installed within the track 641. As the dispensing product roll (e.g., product roll 652) is depleted, its diameter shrinks. At some point, after enough of the dispensing product roll is depleted (such as shown in FIG. 22A), the corresponding roll holder 657 (and/or the remaining portion of the product roll) may be small enough to pass into a lower section 664 of the housing. Further, in some embodiments, the weight of the replacement product roll may urge the shuttle to slide downwardly.

In this regard, the shuttle 658 may slide downwardly within the track 641 such that the replacement product roll 651 moves into the dispensing position so that it is accessible through the dispensing openings 665*a*, 665*b* (shown in FIG. 22B). Notably, the second roll holder 657 is then held within the lower section 664 of the housing for later interaction with the maintainer when the cover 612 is opened.

In some embodiments, a control mechanism (not shown) may be positioned, such as at point 645 (shown in FIG. 23A), to hold the product roll in the dispensing position until transfer is desired. For example, the control mechanism may be configured to hold a roll holder in the dispensing position (e.g., shown in FIG. 22A) until a sufficient amount of the product roll is depleted. In some embodiments, a switch, lever, or other feature may be used to cause the control mechanism to release the roll holder 657 (and shuttle 658) such that it is free to move within the track 641 (e.g., downwardly). In some embodiments, the switch, lever, or other feature may be triggered upon sufficient depletion of the product roll. For example, the weight and/or size of the product roll (which both decrease as the product roll is depleted) may be utilized to cause the triggering of the switch, lever, or other feature (e.g., in a similar manner to some other example sheet product dispensers described herein).

In some embodiments, movement of the roll holder(s) and/or shuttle 658 may be controlled, such as using one or more mechanisms (not shown). For example, pulleys or other mechanisms could be installed within the sheet product dispenser 600 to cause such controlled movement.

In some embodiments, the housing may be designed or shaped to enable a partially-used product roll to be positioned within the lower section 664. In some such embodiments, one or more dispensing openings may be designed in the lower section 664 to enable a user to access the partially-used product roll. In some embodiments, the sheet product dispenser 600 may be designed to enable a partially-used product roll to move from the initial dispensing position to the partially-used dispensing position within the lower section 664 of the housing. Such an embodiment may enable a user to access both a partially-used product roll and a full product roll (now in the initial dispensing position).

In some embodiments, the sheet product dispenser 600 may be configured to enable a replacement product roll to be installed without the need (or, in some embodiments, the ability) to move the product roll being currently dispensed from. Such embodiments may be beneficial for ensuring that dispensing continues to occur from the partially-used product roll first. Additionally, it may help ensure that maintainers leave the partially-used product roll to reduce unnecessary waste.

FIGS. 23A-23B illustrate an example process for loading a replacement product roll into the second roll holder 657 once the prior loaded product roll has been sufficiently depleted. In this regard, in some embodiments, the sheet product dispenser 600 may be configured to enable rotation of the shuttle 658 to cause repositioning of the roll holders to enable a full replacement roll to be positioned in the reserve position while a partially-used product roll remains in the dispensing position.

In some embodiments, for example, the track 641 may define multiple sections—a first section 641*a*, a bend section 461*b*, and a vertical section 641*c*. The vertical section 641*c* may enable vertical sliding of the shuttle 658 (and/or roll holders 656, 657). The first section 641*a* may define an opening 643 to the track 641 and be shaped to match rotational movement of the shuttle 658. The bend section 641*b* may define a bend or turn that transfers the shuttle 658 from the first section 641*a* to the vertical section 641*c*.

As shown in FIG. 23A, a product roll may have been sufficiently depleted such that the second roll holder 657 moved (e.g., with the shuttle 658) into the lower section of the housing. Likewise, the first roll holder 656 moved to the position 645 defining the dispensing position for the first product roll 651. As detailed herein, a control mechanism (not shown) may hold the first roll holder 656 at the position 645, such as even when the cover 612 is open.

Upon opening of the cover 612, a maintainer may now move the position of the second roll holder to the reserve position and load a new product roll. For example, with the second roll holder 657 at the bottom of the track 641, an opening or other feature may enable removal of the second roll holder 657 from the track 641 for rotation of the second roll holder 657 and shuttle 658. In this regard, as shown in FIG. 23B, the shuttle 658 and/or second roll holder 657 may be rotated (e.g., along arrow "R") to cause repositioning of the second roll holder 657. In the depicted embodiment, the second roll holder 657 may fit back into and re-engage with the track 641 at the opening 643. In this regard, the second roll holder 657 can move within the first section 641*a* and the bend section 641*b* to a position generally vertically above the first roll holder 656. Accordingly, the maintainer can load a replacement product roll onto the second roll holder 657, which is now in the reserve position.

Example Two Roll Side-by-Side Sheet Product Dispenser

FIGS. 24A-29 illustrate example sheet product (e.g., tissue) dispensers 710, 710' that include two high capacity tissue product rolls positioned side-by-side. Such example two roll side-by-side tissue dispensers may include one or more features that provide benefits or improvements to prior dispensers. While such features may be described with respect to the below example tissue dispenser, some embodiments of the present invention contemplate use of such features with other sheet product dispensers, such as some of the example sheet product dispensers described herein.

FIG. 24A shows an example tissue dispenser 710 that includes two side-by-side product rolls 751, 752. The tissue dispenser 710 includes a housing with a cover 712 that is movable between a closed position (shown in FIG. 24A) and an open position (shown in FIG. 24C), such as through use of a latch 792 shown in FIG. 24C. The tissue dispenser 710 includes a first product roll 751 that is held on a first roll holder 731 and a second product roll 752 that is held on a second roll holder 732. In some embodiments, a dispensing opening 725 enables a user to access and, for example, tear off (e.g., using perforations and/or a cutting arrangement) a portion of the tissue product (e.g., a tail of the tissue product may hang down through the dispensing opening 725). In the depicted embodiment of FIG. 24A, a dispensing door 760 blocks a user access to the second product roll 752, which forces a user to tear off tissue product from the first product roll 751 first.

In some embodiments, the sheet product dispenser may include a housing (e.g., cover 712 and base portion 714) that is sized to receive a maximum amount of product with maintaining a minimum necessary footprint. In such a regard, the housing may be sized to fit a certain diameter of product roll (or product rolls). Notably, the larger the diameter of the product roll, the higher the capacity per revolution (e.g., the farther you get away from the center, the more product fits on the product roll per revolution of the product roll). For example, near the center, only three perforated sheets may form a full revolution, whereas, further away from the center, it may take six perforated sheets to form a full revolution.

In some embodiments, each product roll includes a large capacity of tissue product (e.g., 1,495 feet of tissue product), such that the entire capacity of the tissue dispenser 710 is high (e.g., almost 3,000 feet). By providing a high capacity of tissue product, a large number of users can receive tissue dispensed without a need to replace any product rolls within the dispenser. In this regard, there can be an increased amount of time between needed maintenance (such as to replace a product roll). Further, less ordering may need to occur. Moreover, providing a greater capacity of tissue product within the dispenser may lead to less situations where the dispenser is completely empty.

In some embodiments, the sheet product dispenser may have a transparent, partially transparent, or translucent cover (or portion thereof) so that a user can easily determine the amount of product remaining on one or more product rolls within the dispenser. For example, the tissue dispenser 710 of FIG. 24A includes a partially transparent cover that enables a maintainer to quickly visually determine the amount of product remaining on the product rolls to thereby make a determination as to whether they need to insert a replacement product roll. Alternatively, in some embodiments, the sheet product dispenser may include an opaque cover, such as shown with the example dispenser 710' in FIG. 24B.

In some embodiments, the sheet product (e.g., tissue) dispenser may be configured to hang on a wall proximate a bathroom fixture (e.g., a toilet). In this regard, the tissue dispenser may be designed to enable a user sitting on the toilet to reach over and interact with a product roll within the dispenser to receive (e.g., tear off) a portion of the tissue product. As such, the housing of the tissue dispenser may be sized and configured to comply with certain height and/or orientation requirements.

In some embodiments, the tissue product may include periodic perforations along the product roll that enable easy removal of sheets of the tissue product. In some embodiments, the perforations may be spaced at pre-set intervals that are industry standard, such as 4-8 inches. Alternatively, some embodiments of the present invention may set the intervals to a greater length, such as 8-20 inches, which may help reduce waste, as it may encourage some users to take a fewer number of sheets and decrease overall length of sheet product per user. Additionally or alternatively, some embodiments of the present invention may provide one or more cutting arrangements that can be used to cut off a portion of the tissue product. Other product roll embodiments may provide a roll with no perforations (not shown). In those cases, a serrated edge profile may be incorporated to assist in tissue separation.

In some embodiments, the sheet product dispenser may be sized and/or designed to provide increased coverage for improved hygiene compliance. For example, the tissue dispenser 710 in FIG. 24A includes extra coverage for the product rolls 751, 752 in the form of a lower portion 713 of the housing. Such extra coverage may prevent a user (who may have dirty hands) from touching certain portions of the product roll, as less of the product roll is available for interaction with the user—thereby providing more beneficial hygiene. Notably, the lower portion 713 may provide coverage for the lower part of the product rolls, which may have otherwise been exposed in other sheet product dispensers. In some embodiments, the lower portion 713 may be an extra part of the housing that provides a different section (such as shown in FIG. 24A). Alternatively, the entire housing (e.g., cover 712) could be enlarged to include the lower portion 713' (such as shown in FIG. 24B). An additional benefit of the example tissue dispenser 710' shown in FIG. 24B is that there is a greater amount of space that can receive a larger product roll, as the curvature of the cover 712' follows that of the outer circumference of the product roll (e.g., product roll 752).

In some embodiments, the sheet product dispenser may include one or more stationary roll holders, such as the roll holder 731 shown in FIG. 24C. A stationary roll holder may be configured to apply a friction force (e.g., drag) onto the inside of the product roll, such force may be useful, for example, for enabling a user to tear off a portion of the tissue product.

In some embodiments, the sheet product dispenser may include one or more rotatable roll holders, such as the roll holder 732 shown in FIG. 24C. The roll holder 732 in FIG. 24C includes a bearing spindle that is configured to rotate with the core of the sheet product. In some embodiments, the rotation speed of the bearing spindle may be adjustable such as to enable a user to adjust the freedom of rotation of the roll holder (e.g., the amount of force a user needs to cause the roll holder to rotate). A closer view of an example rotatable roll holder 732 can be seen in FIG. 25, which shows a cross-sectional view of the tissue dispenser 710 taken along line 25-25 in FIG. 24B. In the depicted embodiment, the rotatable roll holder 732 includes an inner drum 732*a* and an outer drum 732*b*. The outer drum 732*b* may engage with an inner surface of the product roll 752 and be configured to rotate with respect to the inner drum 732*a* (e.g., in some embodiments, the outer drum 732*b* may rotate with the sheet product roll while the inner drum 732*a* remains stationary).

In some embodiments, the roll holder may be configured to enable adjustment of the friction force (e.g., drag) on the rotational freedom of the roll holder. In such an example embodiment, the adjustment of the friction force may be influential on the customer's usage of the product (e.g., higher friction may reduce the amount of sheet product taken per user—which can reduce overall costs). For example, in some cases, too low of a friction force may result in overspin of the product roll during dispensing/rotation.

For example, FIG. 26A shows an example roll holder 732 that enables adjustment of the friction force on the rotation of the roll holder 732. In the depicted embodiment, the outer drum 732*b* of the roll holder 732 is rotatable, such as illustrated by arrow B. The roll holder 732 may include a rotation adjustment feature 795 that enables adjustment of friction force on the outer drum 732*b*. In the depicted example embodiment, the rotation adjustment feature 795 is a rotatable ring 795 that can rotate counter-clockwise or clockwise, such as illustrated by arrow A. One or more tabs 796 extend inwardly from the rotation ring 795 and are configured to interact with (e.g., abut) a friction creation feature 798. The friction creation feature 798 may include an elongated cantilevered portion that has a first end 798*a* and a second end 798*b*. Depending on the position of the tabs 796 with respect to the elongated cantilevered portion, more or less friction force may be applied to an outer surface 732*c* of the outer drum 732*b*—thereby enabling adjustment of the amount of friction force for adjusting the freedom of rotation of the roll holder.

In the depicted embodiment, rotation of the rotation ring 795 in the counter-clockwise direction may cause the tab 796 to move along the friction creation feature 798 toward the first end 798*a*. With the tab 796 applying pressure at a position on the friction creation feature 798 more toward the first end 798*a*, more friction force is applied on the outer surface 732*c* of the outer drum 732*b*—such as to impart more friction force on the rotation of the outer drum 732*b*. In contrast, rotation of the rotation ring 795 in the clockwise direction may cause the tab 796 to move along the friction creation feature 798 toward the second end 798*b*. With the tab 796 applying pressure at a position on the friction creation feature 798 more toward the second end 798*b*, less friction force is applied on the outer surface 732*c* of the outer drum 732*b*—such as to impart less friction force on the rotation of the outer drum 732*b*. In such a regard, a user may cause adjustment of the friction force applied to the outer drum 732*b* by rotating the rotation ring 795 in either the counter-clockwise or clockwise direction.

FIGS. 26B and 26C illustrate two different rotational positions of the rotation ring 795. In FIG. 26B, the rotation ring 795 has been rotated to a first position such that the tab 796 is positioned toward the first end 798*a*. As shown, a tapered surface 796*a* of the tab 796 abuts against the friction creation feature 798 to cause a first amount of force to be applied to the outer surface 732*c* of the outer drum 732*b*. In FIG. 26C, the rotation ring 795 has been rotated to a second position such that the tab 796 is positioned toward the second end 798*b*. As shown, the tapered surface 796*a* of the tab 796 abuts against the friction creation feature 798 to cause a second amount of force (e.g., a lesser force than the first amount of force) to be applied to the outer surface 732*c* of the outer drum 732*b*. In such a regard, more force may be required to cause the outer drum 732*b* to rotate when the rotation ring 795 is in the first position than when the rotation ring 795 is in the second position. In some embodiments, one or more stops 799 can be positioned in the path of rotation of the tab 796 in order to bound the rotational freedom of the rotation ring. In the depicted embodiment, a base portion of the friction creation feature 798 may be another stop that can work with the stop 799 to create a range of positions for the tab 796. In some embodiments, the stops can be positioned to prevent a user from adjusting the friction force to be too high or too low.

The above described embodiment provides an example roll holder that enables adjustment of the freedom of rotation of the roll holder. In this regard, some embodiments of the present invention contemplate other mechanisms or features that enable adjustment of the freedom of rotation of the roll holder. Along similar lines, though the depicted example roll holder is shown for a product roll with a relatively large inner diameter, such roll holders configured for use with other size product rolls are also contemplated.

In some embodiments, the amount of friction force applied to the roll holder may be pre-set, such as at manufacturing. In some embodiments, the friction force may be designed to an amount of friction force that is determined to be ideal for product usage. In some embodiments, material components (such as materials with certain tensile strengths, etc.) could be used to obtain the desired friction force. Additionally or alternatively, various mechanisms or friction features (e.g., a friction creation feature) could be used. In such example embodiments, the roll holder may include or not include an adjustment feature (such as described above) depending on the desired capability for the user.

Some example embodiments, such as the examples described herein, advantageously apply a friction force to the spindle instead of the product roll. By applying the friction force to the spindle directly, the desired rotation effect is achieved without damage or wear to the product roll or other negative effects, such as pre-mature product separation (which may otherwise occur if the friction force was applied to a surface of the product roll).

While the depicted embodiment shows a combination of a stationary roll holder 731 and a rotatable roll holder 732, in some embodiments, similar configurations of roll holders per dispenser may be provided. For example, each roll holder of a dispenser may be configured to be stationary.

In some embodiments, the sheet product dispenser may include a dispensing door that is configured to block a user's access to one or more product rolls while another product roll is available for dispensing. FIG. 27A illustrates an example dispensing door 710. In the depicted embodiment, the dispensing door 760 is configured to slide within the dispensing opening 725 between a first position that blocks access to the second product roll 752 (shown in FIG. 27A) and a second position that enables access to the second product roll 752. In some embodiments, moving the dispensing door 760 into the second position may also block access to the first product roll 751 if it is present (second position not shown). The dispensing door 760 may include a handle 762 that enables a user (e.g., maintainer) the ability to easily grasp and cause movement of the dispensing door 760.

In some embodiments, the dispensing door 760 may include a blocking protrusion 764 that extends upwardly into the housing. The blocking protrusion 764 may be configured to prevent the dispensing door 760 from being moved from its current position (e.g., from the first position) until a sufficient amount of product is depleted from the first product roll 751. For example, with reference to FIG. 27A, the outer circumferential surface 771 of the first product roll 751 extends below the blocking protrusion 764 such that the dispensing door 760 would be not movable to the second position. In this regard, the first product roll 751 has not depleted below a depletion threshold that would cause the outer surface 771 of the product roll 751 to be at a plane above the blocking protrusion 764. In some embodiments, the height of the blocking protrusion 764 may be designed to achieve a desired depletion threshold to help ensure that the desired amount of product (e.g., all or near all of the tissue on the product roll) from the first product roll 751 was used before a user could access the second product roll 752.

In some embodiments, the blocking protrusion 764 may be flexible in one direction but not the other. For example, the blocking protrusion 764, such as through a one-way spring, may be biased in the upright orientation (shown), but flexible to rotate downwardly in one direction to enable the dispensing door to pass by an installed product roll. For example, in some embodiments, the blocking protrusion 764 may be biased to an upright position (shown), but may be configured to rotate downwardly to the left if a force is applied on its right side (764*b*). However, it may also be configured to prevent rotation downwardly to the right if a force is applied to its left side (764*a*). Thus, for example, if the dispensing door 760 were positioned in the second position (not shown), such as under an installed product roll 751, the maintainer or user could still move the dispensing door 760 back to the first position (shown) once the second product roll 752 is depleted, thereby revealing a full first product roll 751 for use. In this regard, the user may completely deplete the second product roll 752 before utilizing the first product roll 751 that was placed in reserve. Additionally, however, the dispensing door 760 may still retain its intended function to prevent access to the second product roll 752 when it is in the first position (shown) and the first product roll 751 is not sufficiently depleted. In this regard, the blocking protrusion 764 may be configured to stay upright and not rotate downwardly if a user or maintainer attempts to move the dispensing door 760 to the second position while there is still an installed first product roll 751.

In some embodiments, a second blocking protrusion may also be placed on the opposite end (760*b*) of the dispensing door 760. Such a second blocking protrusion may be configured to rotate downwardly in one direction (such as described above) to enable desired movement of the dispensing door 760 even with an installed product roll.

In some embodiments, the blocking protrusion 764 may be rigidly fixed in the upright orientation. In such situations, once the dispensing door 760 is moved to the second position (not shown), a maintainer may move the dispensing door 760 back to the first position when installing a replacement first product roll 751. In such a circumstance, the dispensing door 760 may cover up a partially depleted second product roll 752, which is available for use after depletion of the first product roll 751.

In some embodiments, the sheet product dispenser may include a spring bias between the dispensing door 760 and the housing, such as for limiting contact of the dispensing door 760 and the product roll to reduce and/or prevent drag being imparted on the product roll. In some embodiments, a detent may be applied to the housing or dispensing door 760 to hold the dispensing door 760 in a user-positioned location after the first product roll 751 was depleted and the second product roll 752 was exposed. The detent may, in some embodiments, counteract the spring bias as the dispensing door 760 may otherwise be biased to return to a first position blocking the second product roll 752. In some embodiments, opening of the cover 712 may disengage the detent and permit the dispensing door 760 to be returned to the first position, such as by the spring.

In some embodiments, the sheet product dispenser may be configurable to enable removing or deactivating the dispensing door 760 (or enabling a user to move it out of the way altogether). For example, FIG. 27B shows a tissue dispenser 710' with the dispensing door removed from the dispensing opening 725'. In such an embodiment, a user may access either the first product roll 751 or the second product roll 752 for receiving a portion of the tissue product, which may be desirable for certain uses.

In some embodiments, the sheet product dispenser may include one or more indication features that can provide a user with information. For example, the sheet product dispenser may include an indication feature that may provide a user with a reminder to replace a sheet product roll that has been sufficiently depleted (e.g., depleted below a depletion threshold) and/or avoid replacement of a sheet product roll that has not been sufficiently depleted. Such an indication feature may not only help remind a user to replace a product roll, but also cause the user to wait until the product roll has reached the indication feature—thereby avoiding unnecessary waste. In some embodiments, the indication feature may be hidden from the user until the sheet product roll has been depleted below the depletion threshold.

For example, with reference to FIG. 28, the tissue dispenser 710 may include an indication feature 780 that is positioned on a base portion 714. The indication feature 780 may surround the roll holder 731, 732 and provide a visual reminder of the need for a replacement sheet product roll to be inserted when a sufficient amount of the current sheet product roll has been depleted. In the depicted embodiment, the indication feature 780 may include a line 782 that extends around the roll holder 731 and matches an outline of a theoretical sheet product roll with an amount of product remaining that is at or below the depletion threshold. In this regard, the indication feature 780 would be hidden from the user while the sheet product roll includes an amount of product greater than the depletion threshold, but revealed at the appropriate time (such as when a sufficient amount of sheet product has been depleted). In some embodiments, the line 782 may include a pattern (e.g., be dotted, dot-line-dot, etc.) and/or have a color or shading. In some embodiments, the indication feature may include instructions such as "Do Not Replace Until Below the Dotted Line" (although other instructions could be provided). While the above described embodiment includes a "line", other indication features are contemplated (such as shaded areas, texture, molded features, among others).

In some embodiments, the sheet product dispenser may include a lock and/or latch that enables a user to open the cover, such as to load a new product roll into the dispenser. In some embodiments, the latch/lock may be positioned on a front face of the cover or the top of the cover to enable easier access (as the dispenser may be positioned in a bathroom stall). FIG. 29 shows an example latch 792 with one key hole 793 that are on the cover 712. A user may insert a key into hole 793 to detach the latch portion on the cover from the latch portion 790 on the base portion 714 (see e.g., FIG. 24C). In some embodiments, the latch/lock could be convertible between a key lockable configuration and a keyless (e.g., button) configuration. In some embodiments, the latch may be configured to convert between configurations while still being held within the dispenser such that there is no extra piece that can be lost after initial setup.

Example Three Roll Drop in Sheet Product Dispenser

FIGS. 30A-34B illustrate various example sheet product (e.g., tissue) dispensers 800, 800', 800" that include three high capacity tissue product rolls positioned in generally horizontal arrangement (though a generally vertical arrangement and various diagonal arrangements are also contemplated). Such example tissue dispensers may include one or more features that provide benefits or improvements to prior dispensers. While such features may be described with respect to the below example tissue dispenser(s), some embodiments of the present invention contemplate use of such features with other sheet product dispensers, such as some of the example sheet product dispensers described herein.

Figure 32A:
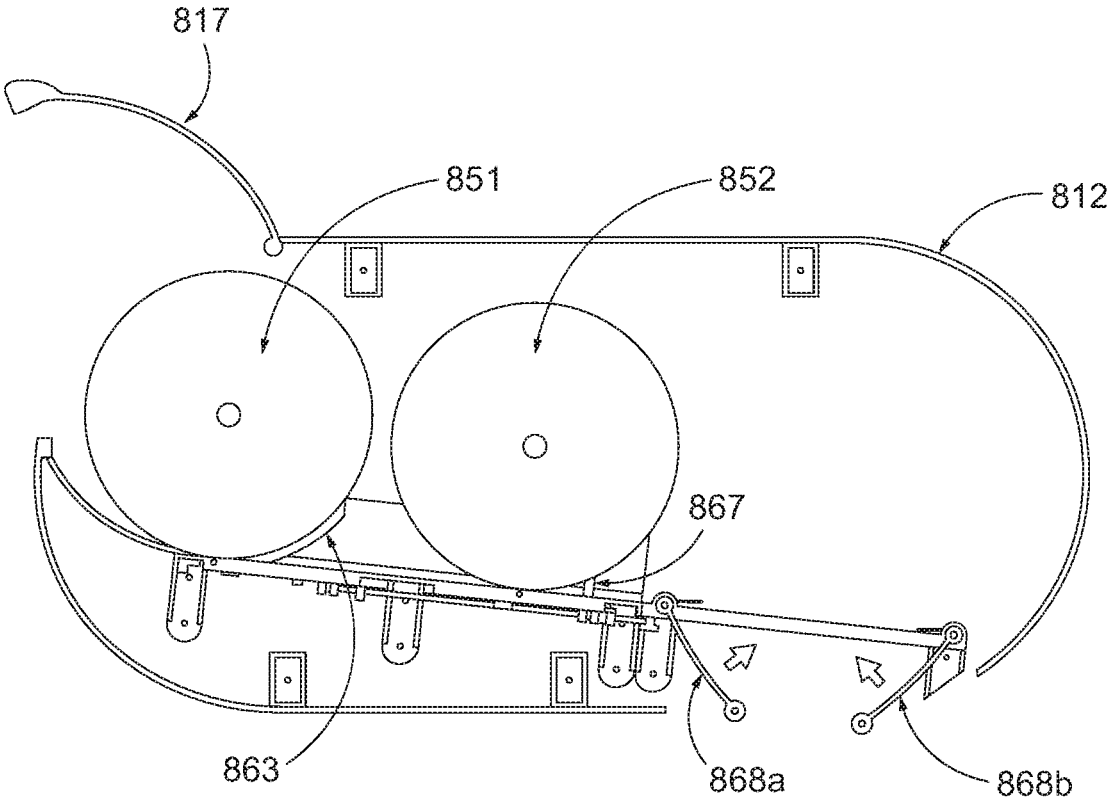

FIGS. 30A-30B show an example tissue dispenser 800 that includes three product rolls 851, 852, 853 that are positioned in a horizontal manner on a transfer rail 860. The tissue dispenser 800 includes a housing with a cover 812. The cover 812 may include a loading door 817 that can be opened to enable access to allow a user to insert (e.g., drop in) a new product roll, such as through a loading opening in the cover 812. In some embodiments, the loading door 817 may include a handle 819 (such as shown in FIG. 30B). FIG. 32A shows the loading door 817 in the open position. While example embodiments of the sheet product dispenser 800 are described with a housing configured to hold three sheet product rolls, some embodiments of the present invention may be configured to hold any number of sheet product rolls (e.g., two, four, five, etc.).

In some embodiments, the sheet product dispenser 800 may be configured to enable receipt and holding of the product rolls without roll holders or spindles. In this regard, there is no need for a user to install a new product roll on a roll holder or spindle. Instead, the product rolls can be simply dropped in the housing (e.g., through a loading opening). In some embodiments, the transfer rail 860 may be designed to enable the product rolls to move between staging positions within the housing (such as will be described in greater detail herein). In some embodiments, the transfer rail 860 may be designed to enable the product rolls to fall or roll under the influence of gravity between the various staging positions. In such a regard, in some embodiments, the natural shape of the product rolls may be advantageously utilized during rolling movement. In a similar manner, as will also be described in greater detail herein, the natural weight of the product rolls may also be advantageously utilized during operation of the sheet product dispenser. In some embodiments, the loading opening may be sized to receive a single product roll, thereby preventing insertion of multiple product rolls. In some embodiments, the loading opening may be sized and/or configured with restrictive loading access, such as to prevent improperly sized product rolls from entering the dispenser. Such example embodiments may prevent competitor product rolls from being used with the dispenser 800.

In some embodiments, the sheet product dispenser may include a housing (e.g., cover 812 and base portion) that is sized to receive a maximum amount of product with maintaining a minimum necessary footprint. In some embodiments, each product roll includes a large capacity of tissue product (e.g., 963 feet of tissue product), such that the entire capacity of the tissue dispenser 800 is high (e.g., approximate 2,889 feet).

In some embodiments, the cover 812 (or portions thereof) may be transparent, partially transparent, or translucent such that a user can visually determine an amount of product remaining within the dispenser.

In some embodiments, the sheet product dispenser 800 may (such as through the transfer rail 860) define one or more positions for the product rolls. The product rolls may be held (at least temporarily) in such positions. In some embodiments, the sheet product dispenser 800, such as through a body of a transfer rail 860, may be configured to define a dispensing position and one or more reserve positions for the product rolls. In some embodiments, the dispensing position may be in a horizontal plane that is below a corresponding horizontal plane for the one or more reserve positions. Likewise, a first reserve position may be in a horizontal plane that is below a horizontal plane for a second reserve position, and so on. In such a manner, gravity may assist in movement of the sheet product rolls between the various positions.

Figure 32B:
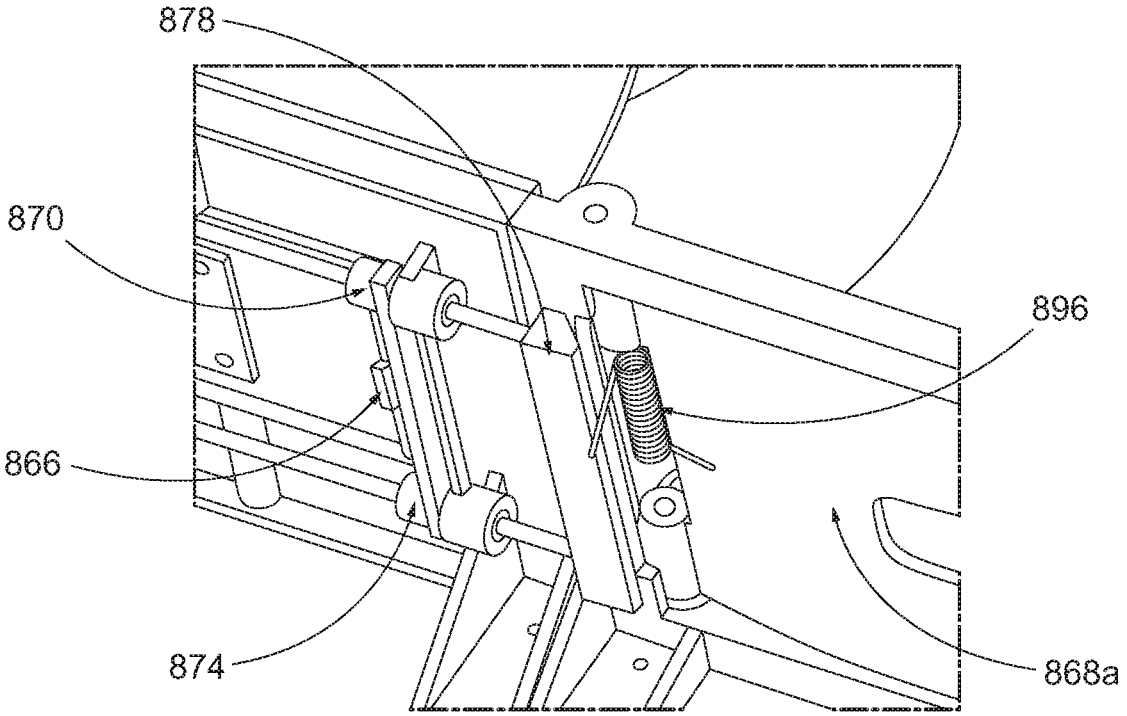
Figure 32C:
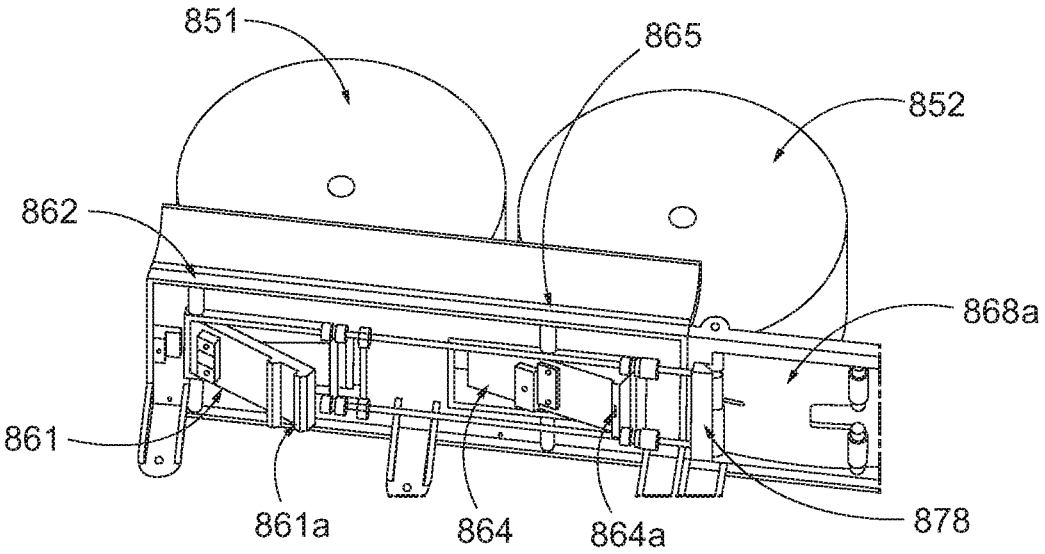
Figure 32D:
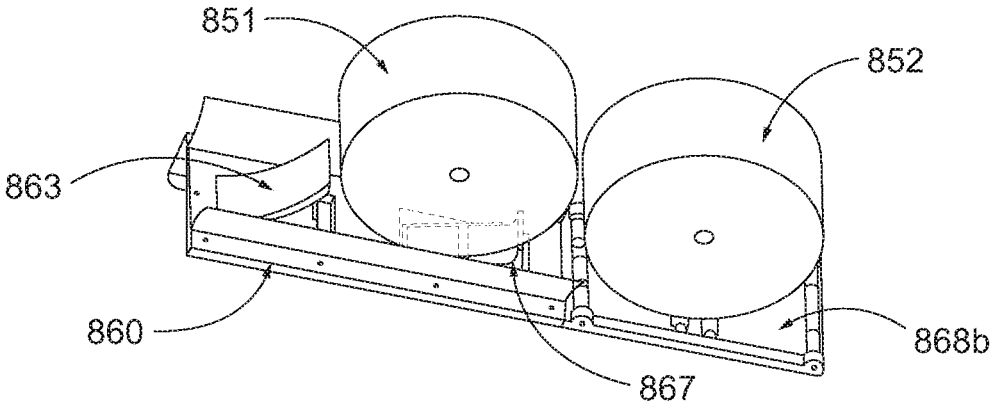

For example, with reference to FIGS. 30A and 31A, the sheet product dispenser 800 and transfer rail 860 may define a dispensing position where the third sheet product roll 853 is currently held. In this regard, the third sheet product roll 853 is positioned within a dispensing position slot 869 within the transfer rail 860 and held up by two dispensing flaps 868*a*, 868*b*. In some embodiments, the dispensing flaps 868*a*, 868*b* may be movable between a first position (such as shown in FIG. 30A) and a second position (such as shown in FIGS. 32B and 32C). The dispensing flaps 868*a*, 868*b* may be biased to the second position such that they may return to a plane that is approximately within the dispensing slot 869 (such as shown in FIGS. 32B and 32C) when there is no sheet product roll applying weight thereon. However, the weight of the sheet product roll may be enough to overcome the bias to cause the dispensing flaps 868*a*, 868*b* to move toward the first position such that the sheet product roll may be in a dispensing position and able to be accessed by a user (such as with the third sheet product roll 853 as shown in FIG. 30A). The bias on the dispensing flaps 868*a*, 868*b* may be designed such that the dispensing flaps 868*a*, 868*b* slowly move back toward the second position as the third sheet product roll 853 becomes depleted (and, thus, weighs less).

The dispensing position may be defined such that a portion of a sheet product roll (e.g., a dispensing roll such as the third sheet product roll 853 shown in FIG. 30A) protrudes through (e.g., hangs out of) or is accessible through a dispensing opening 825 in the housing of the sheet product dispenser 800. In such a manner, a user may receive (e.g., tear off using, for example, perforations) a portion of the tissue product from the dispensing roll (e.g., a tail of the tissue product may hang down through the dispensing opening 825). Two dispensing rollers 869*a*, 869*b* may be positioned on the end of each dispensing flap 868*a*, 868*b* respectively. The dispensing rollers 869*a*, 869*b* may aid in rotation of the third sheet product roll 853 as a user receives a portion of the tissue product. In some embodiments, two dispensing flaps 868*a*, 868*b* may be separated by a gap to enable some of the sheet product to protrude (e.g., hang) therethrough. Additionally, in some embodiments, such a gap may provide an opening or access region for the user to more easily find a tail of the product roll (e.g., when the tail is lost or there is a new product roll).

The sheet product dispenser 800 (e.g., through the transfer rail 860) may also define one or more reserve positions. For example, with reference to FIGS. 30A and 31A, the sheet product dispenser 800 and transfer rail 860 may define a first reserve position where a first replacement roll (e.g., the second sheet product roll 852 shown in FIG. 30A) is currently held and a second reserve position where a second replacement roll (e.g., the first sheet product roll 851 shown in FIG. 30A) is currently held. In this regard, the sheet product dispenser 800 may house one or more replacement product rolls that are ready to transfer to the dispensing position upon depletion of the sheet product roll in the dispensing position (e.g., the third sheet product roll 853 shown in FIG. 30A).

In some embodiments, the one or more reserve positions may be one or more positions in which a sheet product roll is held (at least temporarily) within the housing (such as on the transfer rail 860). For example, with reference to FIG. 32A, the second sheet product roll 852 may be held in a first reserve position by a first blocking element 867 of the transfer rail 860. In the depicted embodiment, the first blocking element 867 prevents the second sheet product roll 852 from rolling down the transfer rail 860, such as would otherwise occur due to the influence of gravity. Such as described in greater detail herein, the first blocking element 867 may be configured to prevent movement of the second sheet product roll 852 until the dispensing roll (e.g., the third sheet product roll 853) is depleted below a depletion threshold. In some embodiments, such as described herein, the first blocking element 867 may be attached (or integral) to a first replacement door 864.

Similarly, with reference to FIG. 32A, the first sheet product roll 851 may be held in a second reserve position by a second blocking element 863 of the transfer rail 860. In the depicted embodiment, the second blocking element 863 prevents the first sheet product roll 851 from rolling down the transfer rail 860, such as would otherwise occur due to the influence of gravity. Such as described in greater detail herein, the second blocking element 863 may be configured to prevent movement of the first sheet product roll 851 until the dispensing roll (e.g., the third sheet product roll 853) is depleted below a depletion threshold. In some embodiments, such as described herein, the second blocking element 863 may be attached (or integral) to a second replacement door 861.

In some embodiments, the sheet product dispenser 800 may be configured to, upon depletion of the currently dispensed sheet product roll, cause one or more replacement product rolls to move within the housing such that another sheet product roll is moved into the dispensing position. Such embodiments help ensure a reduction in waste as most (if not all) of the currently dispensed sheet product roll must be used prior to transferring to using a new sheet product roll. Further, such example transfer automatically occurs without user interaction.

FIGS. 32A-32E illustrate repositioning of replacement product rolls in the example dispenser of FIG. 30A upon depletion of the dispensing product roll (or depletion below a depletion threshold). For example, FIG. 32A illustrates that the third sheet product roll 853 has been depleted. In some embodiments, the dispensing product roll may be completely depleted. In some embodiments, a remaining portion of the dispensing product roll may be small enough to fall through the gap between the dispensing flaps 868*a*, 868*b*. Notably, while FIG. 32A shows the dispensing flaps 868*a*, 868*b* in the first position, the dispensing flaps 868*a*, 868*b* (due to a bias) would actually have moved to the second position such that they are, for example, parallel with the dispensing slot 869. This is shown in FIG. 32B, which also illustrates an example spring 896 that can be used to bias the dispensing flap 868*a*.

The transfer rail 860 may include a transfer linkage 870 that is configured to facilitate movement of the one or more replacement rolls within the dispenser 800 upon sufficient depletion of the currently dispensed sheet product roll. For example, with reference to FIG. 32B, a transfer linkage 870 may be movably (e.g., slidably) attached to the transfer rail 860. In this regard, the transfer linkage 870 may be configured to slide between a first transfer position that prevents movement of the replacement roll(s) (shown in FIG. 31B) and a second transfer position that enables movement of the replacement roll(s) (shown in FIG. 32C).

With reference to FIG. 31B, the one or more replacement product rolls (e.g., the first and second sheet product rolls 851, 852) may each be positioned over a replacement door. The term "door" as used herein is not meant to be limiting, as it may refer to any type of feature that is movable between two or more positions, such as a platform that may rotate/pivot/oscillate about an axis. In some embodiments, each replacement door is movable (e.g., pivotable) between a blocking position and a retracted position. In the depicted embodiment, the second sheet product roll 852 (in the first reserve position) rests on a first replacement door 864 and the first sheet product roll 851 (in the second reserve position) rests on a second replacement door 861. Further, in some embodiments, each replacement door may include a pivot axis (e.g., pivot axis 865 for the first replacement door 864 and pivot axis 862 for the second replacement door 861) and be configured such that the replacement door can move to the retracted position under the influence of the weight of a sheet product roll resting thereon.

In some embodiments, the transfer linkage 870 may include one or more transfer blocking elements that prevent movement of the replacement door(s) to their retracted position even with the sheet product roll(s) positioned on the replacement door(s). For example, with reference to FIG. 31B, a first transfer blocking element 874 of the transfer linkage 870 may be positioned under an end 866 of the first replacement door 864 to prevent movement of the first replacement door 864 to the retracted position. Likewise, a second transfer blocking element 871 of the transfer linkage 870 may be positioned under an end of the second replacement door 861 to prevent movement of the second replacement door 861 to the retracted position. In such a manner, the first and second replacement doors 861, 864 may be held in the blocking position such that the blocking elements 863, 867 of each replacement door 861, 864 prevent movement of the corresponding sheet product rolls 851, 852.

With reference to FIG. 32C, upon depletion of the currently dispensed sheet product roll below a depletion threshold, the dispensing flaps 868*a*, 868*b* may move (such as due to a spring bias) to the second position. In response, a bias of the transfer linkage 870 will cause the transfer linkage 870 to move toward the second transfer position, thereby removing the first transfer blocking element 874 from underneath the first replacement door 864 and the second transfer blocking element 871 from underneath the second replacement door 861. In such a regard, each of the first replacement door 864 and the second replacement door 861 are configured to move to their retracted position under the weight of their corresponding sheet product rolls 852, 851, respectively, resting thereon. This removes the first blocking element 867 from interacting with the second sheet product roll 852 and the second blocking element 863 from interacting with the first sheet product roll 851—enabling the second sheet product roll 852 to move (e.g., roll) under the influence of gravity to the dispensing position and the first sheet product roll 851 to move (e.g., roll) under the influence of gravity to the first reserve position (shown in FIG. 32D).

During movement of the sheet product rolls, each replacement door is free to (and may be biased to) move back to the blocking position such that it is ready to receive and block a new sheet product roll.

Figure 32E:
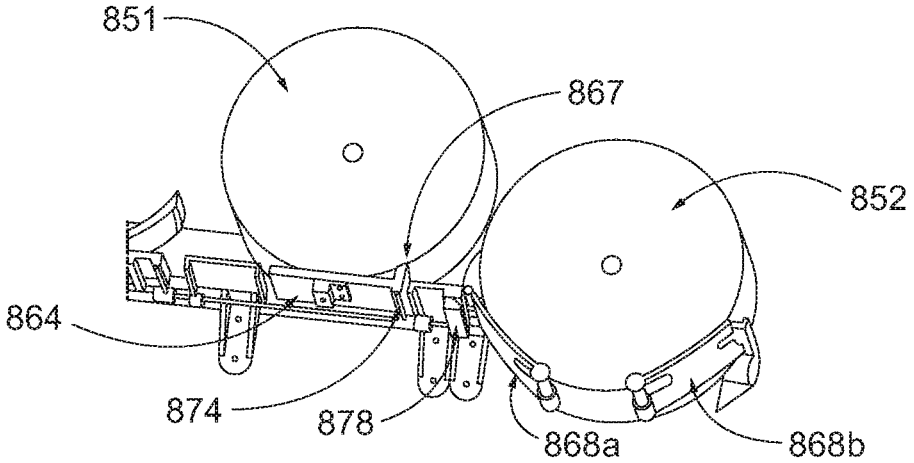

With reference to FIG. 32E, once the second sheet product roll 852 moves into the dispensing position, the dispensing flaps 868*a*, 868*b* move away from the second position and toward the first position under the weight of the second sheet product roll 852. In response, the dispensing flap 868*a* forces the transfer linkage 870 back to the first transfer position. This causes the first transfer blocking element 874 to be moved back underneath the first replacement door 864 to again prevent movement of the first replacement door 864 to the retracted position. Likewise, the second transfer blocking element 871 has moved back underneath the second replacement door 861 to again prevent movement of the second replacement door 861 to the retracted position.

In such a configuration, a user is now able to insert or load a new replacement product roll. For example, a user may simply drop in a new sheet product roll through the loading opening. The new sheet product roll will move (e.g., roll) up to the second blocking element 863 of the second replacement door 861 thereby positioning the new replacement product roll in the second reserve position. The sheet product dispenser 800 is now reloaded and automatic transfer was completed, leaving the second sheet product roll 852 in the dispensing position and ready to be dispensed.

In some embodiments, the sheet product dispenser 800 (such as through the transfer rail 860) may be configured to maintain separation between the sheet product rolls even during movement of the sheet product rolls between positions. Such an embodiment may avoid friction and energy losses that may be formed when product rolls touch each other. Further, such an embodiment may avoid possible failures or jamming scenarios. In some embodiments, the positioning of the replacement doors and blocking elements and/or tolerances/biases of the various components may be configured to ensure such separation is maintained.

With reference to FIGS. 33A-33B, the sheet product dispenser 800 may be user configurable such that there may be a left side orientation (see FIG. 33A) or a right side orientation (see FIG. 33B). Such versatility may be useful for example tissue product dispensers, which may be placed in a tight space on either the left side or the right side of a toilet in a stall. In this regard, it may be desirable to ensure that the loading opening and/or loading door 817 may be easily accessible to enable a maintainer to drop the new product roll in the dispenser 800. In the depicted embodiment of FIG. 33A, the transfer rail 860 is shown in a left side orientation since a maintainer may drop in a new product roll on the left side of the transfer rail 860 and it may move (when appropriate) toward the dispensing slot 869 and the dispensing position on the right side of the dispenser 800. In the depicted embodiment of FIG. 33B, the transfer rail 860' is shown in a right side orientation since a maintainer may drop in a new product roll on the right side of the transfer rail 860' and it may move (when appropriate) toward the dispensing slot 869' and the dispensing position on the left side of the dispenser 800. In some embodiments, the housing of the dispenser 800 may be mountable to achieve either a left side or a right side orientation.

While the above described embodiments include an example sheet product dispenser with the product rolls in a generally horizontal arrangement, some embodiments of the present invention contemplate an example sheet product dispenser with similar features where the product rolls are in a generally vertical arrangement. In such an example embodiment, the user may drop the new product roll in from the top of the dispenser housing and the user may access the currently dispensed sheet product roll from the bottom of the dispenser housing. Further, in some such example embodiments, the transfer rail may be configured to enable gravity-assisted movement of the sheet product rolls between vertical replacement and dispensing positions. In some embodiments, the vertically arranged sheet product dispenser may hold two sheet product rolls. In some embodiments, the dispensing opening of the vertically arranged sheet product dispenser may be sized to only enable a sheet product roll with a sufficient amount of the sheet product depleted to pass through the dispensing opening—thereby enabling the replacement product roll to move into the dispensing position.

FIGS. 34A-34B illustrate another example sheet product dispenser 800" that includes three high capacity tissue product rolls positioned in a generally horizontal arrangement (similar to sheet product dispenser 800). In some embodiments, the sheet product dispenser (e.g., sheet product dispenser 800") may include one or more portions (e.g., a first portion 812*a*") of the cover that are openable to enable insertion and/or replacement of one or more reserve sheet product rolls without enabling replacement of the sheet product roll in the dispensing position. In this regard, the maintainer may be able to insert or replace a sheet product roll in one of the reserve positions, but may be unable to replace the sheet product roll being dispensed from. This helps avoid a maintainer from replacing a partially depleted product roll that is being dispensed from (e.g., it is in the dispensing position), which may be considered unnecessary waste. Such example embodiments may work well with other features described herein, such as automatically repositioning a reserve roll into the dispensing position when the dispensing roll is depleted. In this regard, the maintainer may not need to interact with the product roll in the dispensing position and, instead, simply ensure that the reserve rolls are available.

In some embodiments, the second portion of the cover still covering the dispensing roll may be openable or otherwise enable access to the dispensing roll, such as separately from the first portion described above. In some of those embodiments, access to the dispensing roll may still be discouraged or more difficult than, for example, access to the one or more reserve rolls to discourage premature replacement of the dispensing roll.

FIG. 34A shows an example sheet product dispenser 800" with a cover 812" that includes a first portion 812*a*" and a second portion 812*b*". The first portion 812*a*", when in the closed position, covers the first sheet product roll 851" (in the dispensing position), the second sheet product roll 852" (in the first reserve roll position), and the third sheet product roll 853" (in the second reserve roll position). In some embodiments, the portion 812*a*" may be transparent or partially transparent, such as to enable a maintainer to visually determine the amount of product remaining in the dispenser. The portion 812*a*" of the cover 812" may be movably (e.g., rotatably) and/or removably connected to the sheet product dispenser 800". In this regard, the portion 812*a*" may be removed (shown in FIG. 34B), thereby revealing and enabling access to, at least, the reserve product roll positions (e.g., the position of the second sheet product roll 852" and the third sheet product roll 853". With such access, the maintainer may insert new product rolls into or replace product rolls in either of the reserve positions. Further, in the depicted embodiment, the opening of the portion 812*a*" of the cover 812" also enables access to the first sheet product roll 851", although such access could be restricted with additional features (e.g., blocking elements, etc.). Depending on the configuration, however, in some embodiments, access to the dispensing roll (e.g., sheet product roll 851") may still be prevented, which may prevent premature replacement of a partially depleted product roll.

Method of Manufacturing

Associated systems and methods for manufacturing example sheet product dispensers described herein are also contemplated by some embodiments of the present invention.

Additional Example Embodiments

The following are some additional example embodiments of the present invention.

In an example embodiment, a sheet product dispenser is provided. The sheet product dispenser comprises a housing, a dispensing opening defined in the housing, and a transfer rail positioned within the housing. The transfer rail is configured to receive a first sheet product roll in a dispensing position and at least one second sheet product roll in a reserve position. The dispensing position is proximate the dispensing opening such that a user may receive a portion of the first sheet product roll that is in the dispensing position through the dispensing opening. The dispensing position is defined in a first horizontal plane that is below a second horizontal plane of the reserve position such that gravity acts on the second sheet product roll that is in the reserve position to bias the second sheet product roll toward the dispensing position. The transfer rail includes at least one blocking element configured to prevent movement of the second sheet product roll from the reserve position until the first sheet product roll is depleted below a depletion threshold. The transfer rail further includes a body that enables the second sheet product roll to move from the reserve position to the dispensing position under the influence of gravity.

In some embodiments, the reserve position is a first reserve position. The transfer rail is configured to receive a third sheet product roll in a second reserve position. The second reserve position is defined in a third horizontal plane that is above the second horizontal plane of the first reserve position such that gravity acts on the third sheet product roll that is in the second reserve position to bias the third sheet product roll toward the first reserve position. The transfer rail further includes a second blocking element configured to prevent movement of the third sheet product roll from the second reserve position until the first sheet product roll is depleted below a depletion threshold.

In some embodiments, the body of the transfer rail is configured to maintain separation of the second sheet product roll and the third sheet product roll when the second sheet product roll moves from the first reserve position to the dispensing position and the third sheet product roll moves from the second reserve position to the first reserve position such that the second sheet product roll and the third sheet product roll do not touch.

In some embodiments, the body of the transfer rail is configured to enable the second sheet product roll to roll along an outer circumferential surface from the reserve position to the dispensing position under the influence of gravity.

In some embodiments, the housing is defined to receive the first sheet product roll and the second sheet product roll in a substantially horizontal arrangement.

In some embodiments, the dispensing opening is defined proximate a bottom side and a first side of the housing. The housing defines a loading opening proximate a top side and a second side of the housing. The first side of the housing is opposite the second side of the housing. The loading opening is sized to receive a new sheet product roll. The transfer rail is configured to receive and direct the new sheet product roll toward the reserve position under the influence of gravity such that a user may drop the new sheet product roll into the loading opening. In some embodiments, the first side of the housing may be a left side of the housing and the second side of the housing may be a right side of the housing. In some embodiments, the first side of the housing may be a right side of the housing and the second side of the housing may be a left side of the housing.

In some embodiments, the housing is defined to receive the first sheet product roll and the second sheet product roll in a substantially vertical arrangement. In some embodiments, the dispensing opening is defined proximate a bottom side of the housing. The housing defines a loading opening proximate a top side of the housing. The loading opening is sized to receive a new sheet product roll. The transfer rail is configured to receive and direct the new sheet product roll toward the reserve position under the influence of gravity such that a user may drop the new sheet product roll into the loading opening.

In some embodiments, the transfer rail is configured to hold the first sheet product roll in the dispensing position without a spindle or a roll holder. The transfer rail is configured to hold the second sheet product roll in the reserve position without a spindle or a roll holder.

In some embodiments, the transfer rail includes a replacement door that is pivotable between a blocking position and a retracted position. The blocking element is defined on the replacement door and configured to prevent movement of the second sheet product roll from the reserve position when the replacement door is in the blocking position. When the replacement door is in the retracted position, the blocking element is removed from engagement with the second sheet product roll to enable movement of the second sheet product roll. The transfer rail includes at least one dispensing flap pivotable between a first position and a second position. The dispensing flap is biased toward the second position. When the first sheet product roll is in the dispensing position, the dispensing flap is moved toward the first position due to the weight of the first sheet product roll. The dispensing flap moves toward the second position as the first sheet product roll is depleted. The dispensing flap moves into the second position when the first sheet product roll is depleted below the depletion threshold. The transfer rail further includes a transfer linkage that is movable between a first transfer position and a second transfer position. The transfer linkage is configured to block movement of the replacement door toward the retracted position in the first transfer position. The transfer linkage is configured to not block movement of the replacement door toward the retracted position in the second transfer position. The transfer linkage is biased toward the second transfer position. The transfer linkage is held in the first transfer position while the at least one dispensing flap is away from the second position. Depletion of the first sheet product roll below the depletion threshold causes the dispensing flap to move to the second position, which causes the transfer linkage to move to the second transfer position, which enables the replacement door to move to the retracted position due to the weight of the second sheet product roll to enable the second sheet product roll to move to the dispensing position under the influence of gravity.

In some embodiments, the replacement door is biased to the blocking position such that once the weight of the second sheet product roll is removed the replacement door returns to the blocking position to prevent another sheet product roll from moving past the reserve position. The dispensing flap moves away from the second position as the second sheet product roll enters the dispensing position which causes the transfer linkage to move to the first transfer position to block movement of the replacement door to the retracted position upon receipt of the another sheet product roll in the reserve position.

In some embodiments, the reserve position is a first reserve position and the transfer rail is configured to receive a third sheet product roll in a second reserve position. The second reserve position is defined in a third horizontal plane that is above the second horizontal plane of the first reserve position such that gravity acts on the third sheet product roll that is in the second reserve position to bias the third sheet product roll toward the first reserve position. The transfer rail further includes a second blocking element configured to prevent movement of the third sheet product roll from the second reserve position until the first sheet product roll is depleted below a depletion threshold. The transfer rail further includes a second replacement door that is pivotable between a blocking position and a retracted position. The second blocking element is defined on the second replacement door and configured to prevent movement of the third sheet product roll from the second reserve position when the second replacement door is in the blocking position. When the second replacement door is in the retracted position, the second blocking element is removed from engagement with the third sheet product roll to enable movement of the third sheet product roll. The transfer linkage is configured to block movement of the second replacement door toward the retracted position in the first transfer position. The transfer linkage is configured to not block movement of the second replacement door toward the retracted position in the second transfer position. Depletion of the first sheet product roll below the depletion threshold causes the dispensing flap to move to the second position, which causes the transfer linkage to move to the second transfer position, which enables the second replacement door to move to the retracted position due to the weight of the third sheet product roll to enable the third sheet product roll to move to the first reserve position under the influence of gravity.

In some embodiments, the housing defines a cover that includes a first portion and a second portion. The first portion covers the reserve position and is configured to be removable to enable access to the reserve position.

Another example embodiments provides a sheet product dispenser that comprises a housing defining a top and a bottom. The housing includes a cover and a base portion. The sheet product dispenser further includes a dispensing opening defined in the housing proximate the bottom of the housing. The sheet product dispenser further includes a first spindle configured to receive a first sheet product roll and a second spindle configured to receive a second sheet product roll. The sheet product dispenser further includes a first track defined in the base portion. The first spindle is configured to move within the first track between a top end proximate the top of the housing to a bottom end proximate the bottom of the housing. When the first sheet product roll is at the bottom end of the first track, the first sheet product roll is positioned proximate the dispensing opening such that a user may receive a portion of the first sheet product roll through the dispensing opening. The sheet product dispenser further includes a second track defined in the base portion. The second spindle is configured to move within the second track between a top end proximate the top of the housing to a bottom end proximate the bottom of the housing. When the second sheet product roll is at the bottom end of the second track, the second sheet product roll is positioned proximate the dispensing opening such that the user may receive a portion of the second sheet product roll through the dispensing opening. The sheet product dispenser further includes a transfer mechanism that connects the first spindle and the second spindle. When the first sheet product roll and first spindle are at the bottom end of the first track, the transfer mechanism is configured to prevent movement of the second sheet product roll and second spindle toward the bottom end of the second track until the first sheet product roll is depleted below a depletion threshold.

In some embodiments, when the second sheet product roll is received by the second spindle, the second spindle is biased to move toward the bottom end of the second track due to the influence of gravity imparted on, at least, the second sheet product roll. In some embodiments, the transfer mechanism is configured to enable movement of the second spindle and the second sheet product to the bottom end of the second track when the first sheet product roll is depleted below the depletion threshold. In some embodiments, when the first sheet product roll is depleted below the depletion threshold, the transfer mechanism is configured to cause the first spindle to move toward the top end of the first track as the second spindle moves toward the bottom end of the second track. In some embodiments, the first spindle is biased to a folded orientation such that the first spindle moves to the folded orientation when the first sheet product roll is depleted below the depletion threshold. When the first spindle is in the folded orientation, the first spindle is able fit behind the second sheet product roll as the first spindle moves toward the top end of the first track. In some embodiments, the first spindle is configured to return to an unfolded orientation when the first spindle reaches a position proximate the top end of the first track.

In some embodiments, the first track is parallel to the second track.

In some embodiments, the first track is spaced apart from the second track in a vertical plane corresponding to the base portion of the housing.

In some embodiments, the cover includes a first portion and a second portion. The first portion covers the top end of the first track and the top end of the second track. The first portion is configured to be movable to enable access to one of the first spindle in an instance in which the first spindle is positioned at the top end of the first track or the second spindle in an instance in which the second spindle is positioned at the top end of the second track.

In yet another example embodiment, a sheet product dispenser is provided. The sheet product dispenser comprises a housing and at least one roll holder attached to the housing. The at least one roll holder is configured to receive a sheet product roll. The at least one roll holder comprises a bearing spindle. The bearing spindle is configured to rotate with the sheet product roll. The rotation speed of the bearing spindle is adjustable to define a force needed by a user to cause rotation of the sheet product roll.

In some embodiments, the sheet product dispenser further comprises at least one second roll holder attached to the housing and configured to receive a second sheet product roll. The at least one second roll holder comprises a fixed bearing spindle that does not rotate with the sheet product roll.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A sheet product dispenser comprising:

a housing defining a dispensing position and a reserve position, wherein the housing is configured to hold a first roll of sheet product in the dispensing position and a second roll of sheet product in the reserve position, wherein the housing is configured to enable a user to receive a portion of the first roll of sheet product that is in the dispensing position;

a roll replacement feature that is configured to enable installation of a replacement roll of sheet product into the reserve position, wherein the roll replacement feature comprises a cover that is movable between a closed position and an open position; and a restrictive access feature configured to prevent installation of the replacement roll of sheet product directly into the dispensing position in an instance in which the roll replacement feature enables installation of the replacement roll of sheet product in the reserve position, wherein the restrictive access feature comprises a blocking feature that covers at least the dispensing position to prevent installation of the replacement roll of sheet product directly into the dispensing position, wherein the blocking feature is fixedly attached to the housing such that the blocking feature is not movable.

2. The sheet product dispenser of claim 1, wherein the restrictive access feature is further configured to prevent, when the first roll of sheet product is in the dispensing position, removal of the first roll of sheet product and installation of the replacement roll of sheet product directly into the dispensing position in an instance in which the roll replacement feature enables installation of the replacement roll of sheet product in the reserve position.

3. The sheet product dispenser of claim 1, wherein the restrictive access feature is configured to permanently prevent installation of the replacement roll of sheet product directly into the dispensing position such that there is no emergency access that enables installation of the replacement roll of sheet product directly into the dispensing position.

4. The sheet product dispenser of claim 1, wherein the restrictive access feature is configured to permanently prevent removal of the first roll of sheet product in an instance in which an amount of sheet product remaining on the first roll of sheet product is greater than a removal threshold amount of sheet product.

5. The sheet product dispenser of claim 1 further comprising an emergency access feature that enables a maintainer to at least one of manipulate or bypass the restrictive access feature to enable installation of the replacement roll of sheet product directly into the dispensing position.

6. The sheet product dispenser of claim 1, wherein the sheet product dispenser is configured to enable selection by an installer of either enabling emergency access or disabling emergency access, wherein the restrictive access feature is configured to permanently prevent installation of the replacement roll of sheet product directly into the dispensing position in an instance in which emergency access is disabled, wherein a maintainer is able to at least one of manipulate or bypass the restrictive access feature to enable installation of the replacement roll of sheet product directly into the dispensing position in an instance in which emergency access is enabled.

7. The sheet product dispenser of claim 1 further comprising a roll movement feature that is selectively actuable to enable movement of the first roll of sheet product away from the blocking feature and the dispensing position to enable the replacement roll of sheet product to replace the first roll of sheet product.

8. The sheet product dispenser of claim 7, wherein the cover is configured to prevent a user from being able to selectively actuate the roll movement feature when the cover is in the closed position.

9. The sheet product dispenser of claim 1, wherein the cover is configured to cover the blocking feature when the cover is in the closed position.

10. The sheet product dispenser of claim 1, wherein the cover is not configured to cover the blocking feature when the cover is in the closed position.

11. The sheet product dispenser of claim 1, wherein the blocking feature is formed at least partially of a flexible material that can be flexed to enable installation of the replacement roll of sheet product directly into the dispensing position while the blocking feature is flexed from an original position.

12. The sheet product dispenser of claim 1 further comprising a roll movement feature that is configured to automatically move the first roll of sheet product out of the dispensing position in an instance in which the first roll of sheet product is depleted below a predetermined depletion threshold.

13. The sheet product dispenser of claim 1 further comprising a depletion access feature that is configured to, in an instance in which the first roll of sheet product is depleted below a predetermined depletion threshold, automatically enable a maintainer the ability to at least one of manipulate or bypass the restrictive access feature to enable installation of the replacement roll of sheet product directly into the dispensing position.

14. The sheet product dispenser of claim 1, wherein the roll replacement feature comprises an opening in the housing that enables insertion of the replacement roll of sheet product into the housing, and wherein the restrictive access feature comprises a portion of the housing that covers the dispensing position.

15. The sheet product dispenser of claim 14, wherein the housing is configured to be installed such that the reserve position is generally vertically above and aligned with the dispensing position.

16. The sheet product dispenser of claim 14, wherein the housing is configured to be installed such that the reserve position is generally horizontally aligned with the dispensing position.

17. A sheet product dispenser comprising:

a housing defining a dispensing position and a reserve position, wherein the housing is configured to hold a first roll of sheet product in the dispensing position and a second roll of sheet product in the reserve position, wherein the housing is configured to enable a user to receive a portion of the first roll of sheet product that is in the dispensing position;

a roll replacement feature that is configured to enable installation of a replacement roll of sheet product into the reserve position, wherein the roll replacement feature comprises a cover that is movable between a closed position and an open position; and a restrictive access feature configured to prevent, when the first roll of sheet product is installed in the dispensing position, removal of the first roll of sheet product in an instance in which:

an amount of sheet product remaining on the first roll of sheet product is greater than a removal threshold amount of sheet product; and the roll replacement feature enables installation of the replacement roll of sheet product in the reserve position, wherein the restrictive access feature comprises a blocking feature that covers at least the dispensing position to prevent installation of the replacement roll of sheet product directly into the dispensing position, wherein the blocking feature is fixedly attached to the housing such that the blocking feature is not movable.

18. The sheet product dispenser of claim 17, wherein the restrictive access feature is configured to permanently prevent removal of the first roll of sheet product in an instance in which the amount of sheet product remaining on the first roll of sheet product is greater than the removal threshold amount of sheet product such that there is no emergency access that enables premature removal of the first roll of sheet product.

19. The sheet product dispenser of claim 17 further comprising an emergency access feature that enables a maintainer to at least one of manipulate or bypass the restrictive access feature to enable removal of the first roll of sheet product in an instance in which the amount of sheet product remaining on the first roll of sheet product is greater than the removal threshold amount of sheet product.

* * * * *